US011401840B2

(12) United States Patent
Looney

(10) Patent No.: US 11,401,840 B2
(45) Date of Patent: Aug. 2, 2022

(54) APPARATUS AND METHOD FOR VALVE TIMING IN AN INTERNAL COMBUSTION ENGINE

(71) Applicant: LSE R&D ENGINEERING LIMITED, Hong Kong (HK)

(72) Inventor: Allen Eugene Looney, Hong Kong (HK)

( * ) Notice: Subject to any disclaimer, the term of this patent is extended or adjusted under 35 U.S.C. 154(b) by 0 days.

(21) Appl. No.: 17/028,028

(22) Filed: Sep. 22, 2020

(65) Prior Publication Data

US 2021/0003043 A1 Jan. 7, 2021

Related U.S. Application Data

(63) Continuation-in-part of application No. 16/509,156, filed on Jul. 11, 2019, now Pat. No. 11,220,934.

(60) Provisional application No. 62/697,183, filed on Jul. 12, 2018.

(51) Int. Cl.

| | |
|---|---|
| ***F01L 1/12*** | (2006.01) |
| ***F01L 1/02*** | (2006.01) |
| ***F01L 1/26*** | (2006.01) |
| ***F01L 7/06*** | (2006.01) |
| ***F01L 7/14*** | (2006.01) |
| ***F02F 1/22*** | (2006.01) |

(52) U.S. Cl.

CPC ..... *F01L 1/267* (2013.01); *F01L 1/026* (2013.01); *F01L 1/12* (2013.01); *F01L 7/06* (2013.01); *F01L 7/14* (2013.01); *F02F 1/22* (2013.01)

(58) Field of Classification Search

CPC ... F01L 1/267; F01L 1/026; F01L 1/12; F01L 1/34; F01L 7/04; F01L 7/06; F01L 7/10; F01L 7/14; F01L 7/16; F01L 7/18; F01L 7/021; F01L 7/025; F01L 7/026; F01L 7/029; F01L 13/0015; F01L 2001/0537; F01L 2301/02; F01L 2820/034; F02F 1/22; F04D 25/22; F04D 29/284; F05D 2220/40

See application file for complete search history.

(56) References Cited

U.S. PATENT DOCUMENTS

| | | | | | |
|---|---|---|---|---|---|
| 3,534,716 | A | * | 10/1970 | Odawara | F01L 7/14 123/302 |
| 4,418,658 | A | * | 12/1983 | DiRoss | F01L 7/06 123/190.14 |
| 5,558,049 | A | * | 9/1996 | Dubose | F01L 7/028 123/190.14 |
| 6,029,617 | A | * | 2/2000 | Lambert | F01L 1/34 123/190.14 |

(Continued)

*Primary Examiner* — Grant Moubry
(74) *Attorney, Agent, or Firm* — Kevin Mark Klughart

(57) ABSTRACT

Apparatus for controlling valve timing in an internal combustion engine locates a first valve port in a first side of the engine cylinder and a second valve port in a second side of the engine cylinder. A first rotating valve disc and a second rotating valve disc are respectively disposed next to the first and second valve port. Each rotating valve disc includes a valve port. Each disc rotates in synchronism with the crankshaft to align its' port with the respective first and second valve ports. A variety of intake devices coupled to the first rotating valve disc control intake air flow into the engine cylinder, and a variety of exhaust devices coupled to the second rotating valve disc control exhaust gas flow from the engine cylinder.

44 Claims, 44 Drawing Sheets

(56) References Cited

U.S. PATENT DOCUMENTS

| | | | | |
|---|---|---|---|---|
| 7,845,318 | B2 * | 12/2010 | Park | F01L 7/08 123/80 D |
| 8,714,119 | B2 * | 5/2014 | Pett, Jr. | F02B 75/18 123/53.6 |
| 9,677,434 | B2 * | 6/2017 | Pattakos | F01L 7/06 |

* cited by examiner

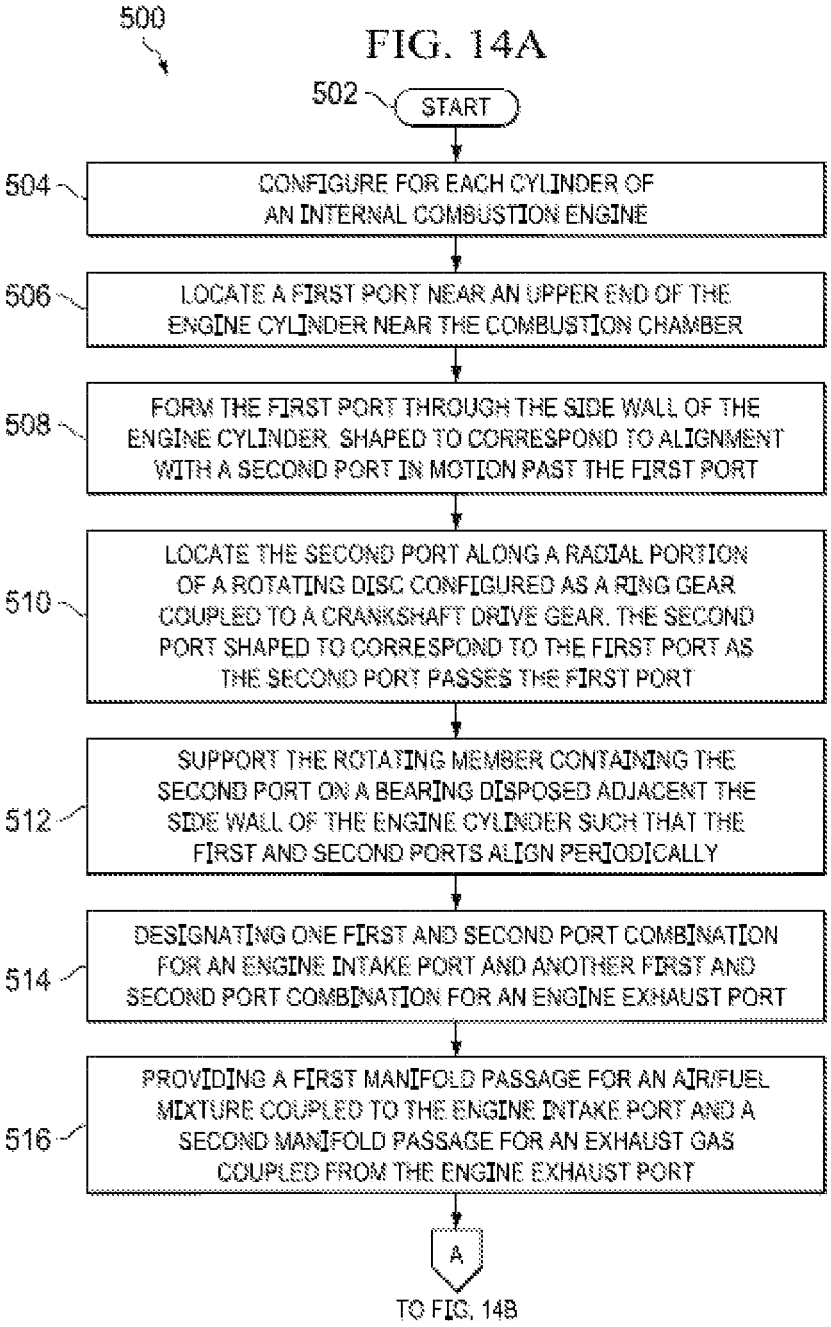
500
FIG. 14A
502
START
504
CONFIGURE FOR EACH CYLINDER OF AN INTERNAL COMBUSTION ENGINE
506
LOCATE A FIRST PORT NEAR AN UPPER END OF THE ENGINE CYLINDER NEAR THE COMBUSTION CHAMBER
508
FORM THE FIRST PORT THROUGH THE SIDE WALL OF THE ENGINE CYLINDER SHAPED TO CORRESPOND TO ALIGNMENT WITH A SECOND PORT IN MOTION PAST THE FIRST PORT
510
LOCATE THE SECOND PORT ALONG A RADIAL PORTION OF A ROTATING DISC CONFIGURED AS A RING GEAR COUPLED TO A CRANKSHAFT DRIVE GEAR. THE SECOND PORT SHAPED TO CORRESPOND TO THE FIRST PORT AS THE SECOND PORT PASSES THE FIRST PORT
512
SUPPORT THE ROTATING MEMBER CONTAINING THE SECOND PORT ON A BEARING DISPOSED ADJACENT THE SIDE WALL OF THE ENGINE CYLINDER SUCH THAT THE FIRST AND SECOND PORTS ALIGN PERIODICALLY
514
DESIGNATING ONE FIRST AND SECOND PORT COMBINATION FOR AN ENGINE INTAKE PORT AND ANOTHER FIRST AND SECOND PORT COMBINATION FOR AN ENGINE EXHAUST PORT
516
PROVIDING A FIRST MANIFOLD PASSAGE FOR AN AIR/FUEL MIXTURE COUPLED TO THE ENGINE INTAKE PORT AND A SECOND MANIFOLD PASSAGE FOR AN EXHAUST GAS COUPLED FROM THE ENGINE EXHAUST PORT
A
TO FIG. 14B

APPARATUS AND METHOD FOR VALVE TIMING IN AN INTERNAL COMBUSTION ENGINE

CROSS-REFERENCE TO RELATED APPLICATIONS

The present application is a Continuation-In-Part of U.S. patent application Ser. No. 16/509,156 filed Jul. 11, 2019 and entitled INTAKE AND EXHAUST VALVE SYSTEM FOR AN INTERNAL COMBUSTION ENGINE. The application Ser. No. 16/509,156 claims priority to U.S. Provisional Application Ser. No. 62/697,183 filed Jul. 12, 2018 and entitled VALVE SYSTEM FOR AN INTERNAL COMBUSTION ENGINE.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present application relates generally to internal combustion engines and more particularly to apparatus and methods for control of the intake and exhaust valve systems of internal combustion engines.

2. Description of Related Art Including Information Disclosed Under 37 CFR 1.97 and 37 CFR 1.98

An internal combustion engine admits a combustible mixture, usually air and a fuel such as gasoline or a blend of gasoline and ethanol into a closed chamber to be ignited by an energetic impulse such as an electric spark. In the case of diesel engines, ignition occurs when the incoming air is heated by compression and mixed with fuel injected into the combustion chamber. The expansion of the ignited fuel forces movement of a piston or other component coupled through reciprocating or rotary motion to cause cyclic rotation of an output shaft called a crankshaft. The rotating crankshaft may be coupled through a transmission or driveshaft to provide motive force to a machine such as a vehicle or appliance. The output of the engine may be controlled by adjusting the air/fuel mixture inlet into the combustion chamber.

In the design of internal combustion engines, there are three kinds of timing functions that must be satisfied: (1) timing the valves that control the passage of air into and exhaust gases out of the combustion chamber; (2) timing the injection of fuel into the air/fuel mixture or into the combustion chamber; and (3) timing the spark or other energetic impulse that provides ignition of the air/fuel mixture in the combustion chamber.

The conventional types of apparatus for the intake and exhaust valve systems for internal combustion engines are well known, including camshaft-controlled reciprocating poppet-valve mechanisms wherein the spring-loaded valves activated by a camshaft embedded in the engine block and driven by a gear attached to the crankshaft that meshes with a gear attached to the camshaft. Alternatively, the camshaft may be located outside the engine block and driven by a toothed belt and pulley configuration synchronized with the crankshaft. The camshaft has precisely-shaped lobes that convert the rotary motion of the camshaft to linear motion through a mechanical system of lifters, push rods, and rocker arms mounted on the cylinder head to the valve stems (a so-called "valve train") that reciprocate in valve guide passages through the cylinder head. The poppet valves on the opposite end of the valve stems are held closed under spring tension until the camshaft lobe raises the lifter in a motion imparted through the valve train to open the valve. Alternatively, the camshaft may be mounted on the cylinder head directly above the valves where the lobes on the camshaft can directly contact the valve stem or an intervening valve lifter. The camshaft may be driven by a chain or belt coupled to a sprocket or pulley attached to the crankshaft. These types of poppet valve trains are complex, have many precision moving parts of relatively high mass subject to reciprocating motion and wear, provide significant restriction to the flow of air or air/fuel mixture and exhaust gases, and require substantial maintenance.

What is needed is a conceptually simple mechanism for operating the intake and exhaust valves of an internal combustion engine that is efficient, practical, and cost effective.

BRIEF SUMMARY OF THE INVENTION

A valve system for an internal combustion piston engine having a crankshaft rotatably mounted in a crankcase portion of an engine block, and an engine cylinder formed within the engine block and open at a lower end thereof into the crankcase, comprising a first fixed port disposed through a side wall of the engine cylinder into an upper portion of the engine cylinder; and a second port disposed through a rotating port member along one radius of the rotating port member; wherein the rotating port member is disposed to rotate alongside the side wall of the engine cylinder such that the second port and the first fixed port are in a communicating alignment keyed to the revolution of the crankshaft. The system preferably includes at least one rotating drive member for coupling the rotation of the crankshaft to rotation of the rotating port member to control timing of the communicating alignment of the first fixed and second rotatable ports. The depictions of the invention herein are not drawn to exact scale in some instances to accentuate the feature and in others to highlight the fitment of the various embodiments in concert with well-known internal combustion engine concepts.

In one aspect, the at least one rotating drive member comprises a ring gear attached to the crankshaft and aligned with the axis of the crankshaft and having a plurality of gear teeth around the ring gear that mesh with corresponding teeth formed around the rotating port member. In this aspect the number of gear teeth around the rotating drive member equals half the number of gear teeth disposed around the rotating port member such that the rotating drive member rotates two complete revolutions for each revolution of the rotating port member for four cycle operation. In an alternate aspect, the number of gear teeth around the rotating drive member equals the number of gear teeth disposed around the rotating port member such that the rotating drive member rotates one complete revolution for each revolution of the rotating port member for two cycle operation.

In a second embodiment, the rotating port member comprises a rotating disc having a plurality of gear teeth disposed around the perimeter of the disc, and a cylindrically-formed ring having first and second parallel edges and coaxially attached at the first edge thereof to a side of the rotating disc facing the engine cylinder, wherein the second port is formed in the ring between the first and second parallel edges. In this embodiment, the first port comprises a first aperture disposed through a portion of a top side of the engine cylinder disposed opposite the open end of the engine cylinder, a second aperture is disposed in the cylindrically-formed ring, the second aperture having a shape and size that corresponds with the first port when the first and second ports are in communicating alignment; and the top side of the engine cylinder is a cylinder head.

In one aspect of the second embodiment, the at least one rotating drive member comprises a ring gear attached to the crankshaft aligned with the axis of the crankshaft and having a plurality of gear teeth around the ring gear that mesh with corresponding teeth formed around the rotating port member. In this aspect the number of gear teeth around the rotating drive member equals half the number of gear teeth disposed around the rotating port member such that the at least one rotating drive member rotates two complete revolutions for each revolution of the rotating port member for four cycle operation. In an alternate aspect the number of gear teeth around the rotating drive member equals the number of gear teeth disposed around the rotating port member such that the at least one rotating drive member rotates one complete revolution for each revolution of the rotating port member for two cycle operation.

In another embodiment, an apparatus for controlling valve timing in an internal combustion engine comprises an engine block forming a crankcase open to a lower end of an engine cylinder, a crankshaft rotatingly disposed in the crankcase, and a piston disposed within the engine cylinder and reciprocatingly coupled to the crankshaft; a first fixed valve port formed in a first side of the engine cylinder and a second fixed valve port formed in a second side of the engine cylinder opposite the first side; a first rotating valve disc (RVD-1) and a second rotating valve disc (RVD-2) respectively disposed adjacent each first and second fixed valve port formed in the engine cylinder; wherein each RVD-1 and RVD-2 respectively includes an inner valve port and rotates in synchronism with the crankshaft to align the inner valve port formed in the RVD-1 and the RVD-2 with the respective first and second fixed ports. The apparatus preferably includes an intake device coupled to the first RVD for controlling intake air flow into the engine cylinder and an exhaust device coupled to the second RVD for controlling exhaust gas flow from the engine cylinder.

In other aspects, the intake device may comprise any of the following: an intake manifold; a spool formed by axle housing, an inner RVD with an inner valve port and an outer RVD with an outer valve port, the valve ports connected by a straight, tubular channel for intake air; a spool as described except the inner and outer valve ports are connected by a helical tubular channel; an impeller attached to the inner RVD that rotates with the RVD within an impeller housing to function as a centrifugal compressor; and an impeller attached to the inner RVD that rotates with the RVD within an impeller housing configured with a volute around its perimeter.

In other aspects, the exhaust device may comprise any of the following: an exhaust manifold; a spool formed by an axle housing, an inner RVD with an inner valve port and an outer RVD with an outer valve port, the valve ports connected by a straight, tubular channel for intake air; a spool as described except the inner and outer valve ports are connected by a helical tubular channel; an impeller attached to the inner RVD that rotates with the RVD within a impeller housing to function as a centrifugal compressor; and an impeller attached to the inner RVD that rotates with the RVD within an impeller housing configured with a volute around its perimeter.

In another embodiment, which adapts the rotating valve concept to a valve-in-head configuration of an internal combustion engine, a first fixed valve port is formed in a first side of a cylinder head of the engine cylinder and the second fixed valve port is formed in a second side of the cylinder head of the engine cylinder; the RVD-I and the RVD-E are each configured as a rotating disc having a ring gear disposed around its perimeter; and a cylindrical tube, its axis aligned along the axis of each RVD-I and RVD-E, is attached at a first end thereof to a face of the respective RVD-I or the RVD-E and oriented proximate the cylinder head of the engine; wherein the inner valve port of each RVD-I or RVD-E is formed in a side wall of the cylindrical tube; and each RVD-I and RVD-E is disposed to rotate in synchronism with the rotation of the crankshaft such as to align the inner valve port of each RVD-I or RVD-E respectively with the first fixed valve port and the second fixed valve port.

In its simplest form, the invention comprises a method for controlling valve timing in an internal combustion engine, comprising the step of providing separately, for each intake and exhaust system, a rotating valve port disc adjacent a fixed valve port formed in a side of an engine combustion cylinder, wherein the rotating valve port disc rotates in synchronism with a crankshaft in the engine to periodically align a port in the rotating valve port disc with the fixed valve port, and wherein the port in the rotating valve port disc is coupled through a conduit to the atmosphere.

BRIEF DESCRIPTION OF THE SEVERAL VIEWS OF THE DRAWINGS

FIGS. 14A and 14B illustrate a method for timing the operation of intake and exhaust valves of an internal combustion engine according to the present invention.

DETAILED DESCRIPTION OF THE INVENTION

Figure 1A:
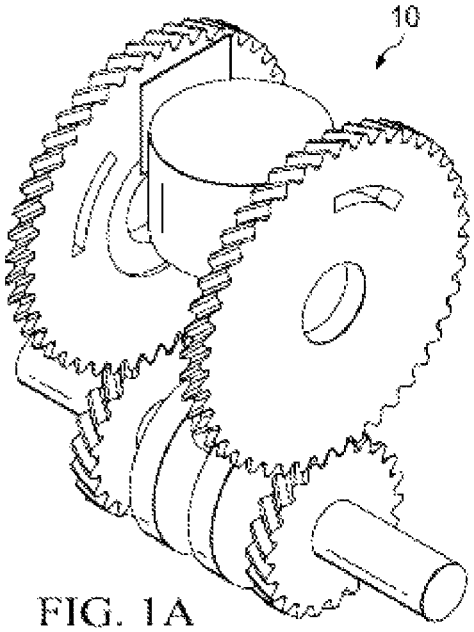
FIGS. 1A through 1J illustrate isometric views depicting several members of the family of embodiments of the present invention.

In an advance in the state of the art, the disclosed invention eliminates the conventional camshaft and reciprocating valve train to control the timing of the intake and exhaust cycles of an internal combustion engine ("ICE") such as the well-known two or four cycle, spark ignition engines. The system includes intake and exhaust port valves for admitting the air/fuel mixture into the cylinder and exhausting the burned gases of combustion from the cylinder. Timing or synchronizing the opening and closing of these valves is one of the three kinds of timing functions that must be satisfied in an internal combustion engine: timing the valves, the injection of fuel, and the spark or other energetic impulse that provides ignition of the air/fuel mixture.

In principle, the valves are configured as ports or apertures formed in a rotating member disposed adjacent fixed intake and exhaust ports into or out of the engine cylinder. The concept is illustrated in the attached concept figures for a single cylinder, four cycle engine, but is adaptable to two cycle engines and other operating cycles. The drawings include views of several alternative embodiments, depending on the location of the fixed ports into the cylinder and the configuration of the rotating ports for their cyclical, synchronized alignment with the fixed ports.

The illustrated specimens depict variations of the rotating valve port ("RVP") concept embodied in the disclosed invention. In some examples the RVP periodically aligns with a fixed valve port formed in the side wall of the engine cylinder. In other examples, the RVP periodically aligns with a fixed valve port formed in the top side or ceiling of the engine cylinder, typically called the cylinder head. In both examples, the valve ports open into a combustion chamber disposed in the upper portion of the engine cylinder. Each engine cylinder includes an intake valve port and an exhaust valve port that communicates with the combustion chamber of the engine cylinder. Inlet or outlet passages coupled with the intake or exhaust ports respectively may be parts of a manifold as in a typical internal combustion engine.

In the following descriptions of the drawings, several terms need defining. The engine cylinder in the embodiments illustrated herein, through which the piston reciprocates, includes a combustion chamber at the end opposite the crankcase. The combustion chamber may reside within the upper portion of the cylinder and include a portion of its volume in a cylinder head that forms the top side of the cylinder. The engine cylinder may be defined by a cylinder wall having an inside surface and an outside surface, referred to herein as a side wall. The rotating valve port structure, may be a disc or ring gear, or a ring gear having a cylindrical ring or a cylindrical extension of one side of the ring gear. In some embodiments, the cylindrical ring may have a relatively short axial length; in other embodiments, the cylindrical ring may be elongated to have a more substantial length so that it resembles a tubular component, the cylindrical ring may be open to the atmosphere on just one end or on both ends respective of engine configuration.

The rotating valve port structure (aka rotating port member) may also be understood as a driven gear that meshes with a drive gear attached to the crankshaft and shares its axis with the crankshaft. Further, the rotating valve port may be supported by a bearing disposed on an axle such as a shoulder bolt secured to the engine block. Details of the bearing and axle are omitted from the drawings to provide clarity of the essential features of the rotating valve port concept.

Bearings and axles are mechanical elements that are well-understood by persons skilled in the art. In one example, a bushing or bearing disposed on a shoulder bolt as an axle may be used to support the rotating valve port. Alternatively, a semi-circular cradle (see, e.g., FIG. 11) may support the rotating valve port in a cradle like structure. Bearing surfaces may include babbit-type bearing inserts, ball bearings, bushings, or simply bearing surfaces that are hardened or coated with wear-resistant ceramic compounds. Other surfaces in contact with moving parts may also be hardened or coated with wear-resistant ceramic compounds.

Figure 3:
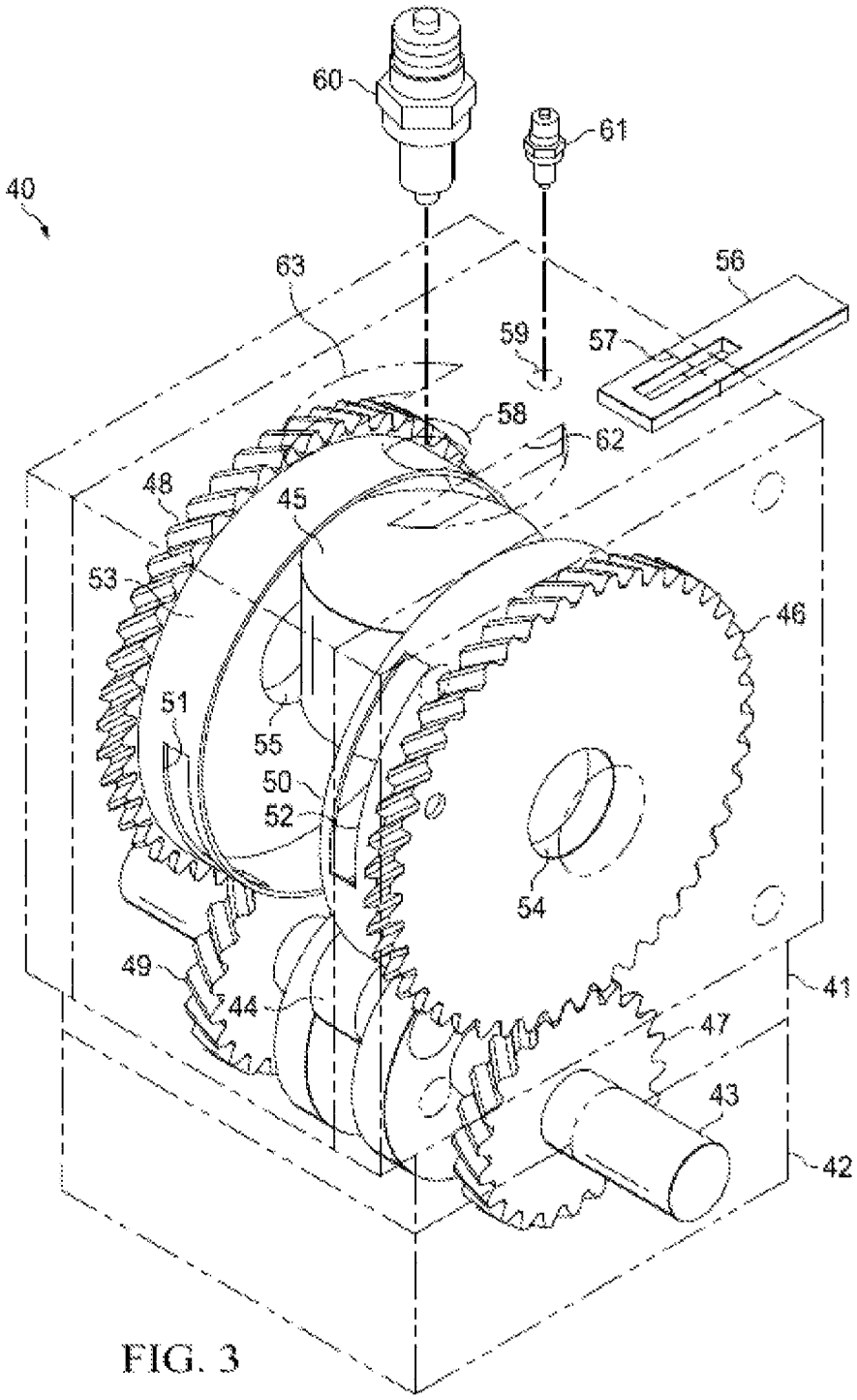
FIG. 3 illustrates an isometric view of a second embodiment of the present invention.
Figure 4:
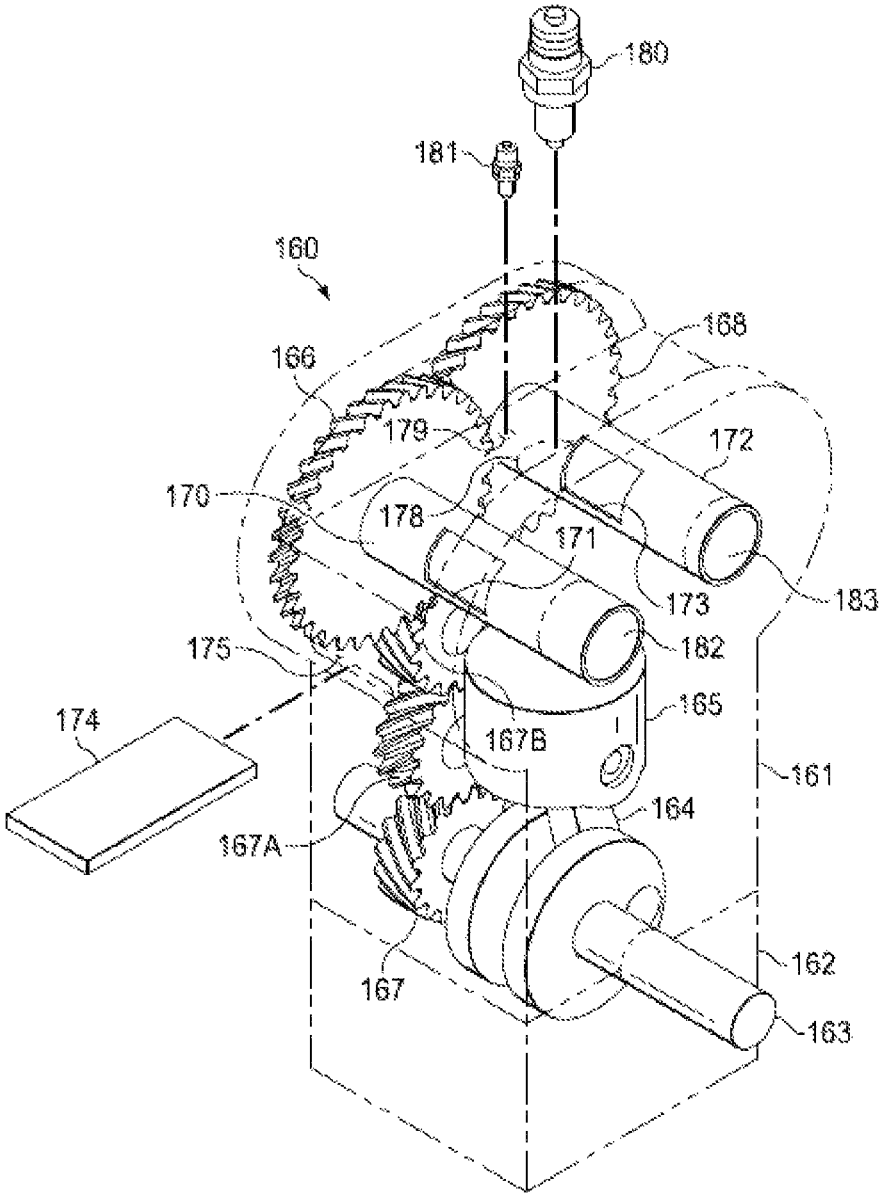
FIG. 4 illustrates an isometric view of a third embodiment of the present invention.
Figure 6:
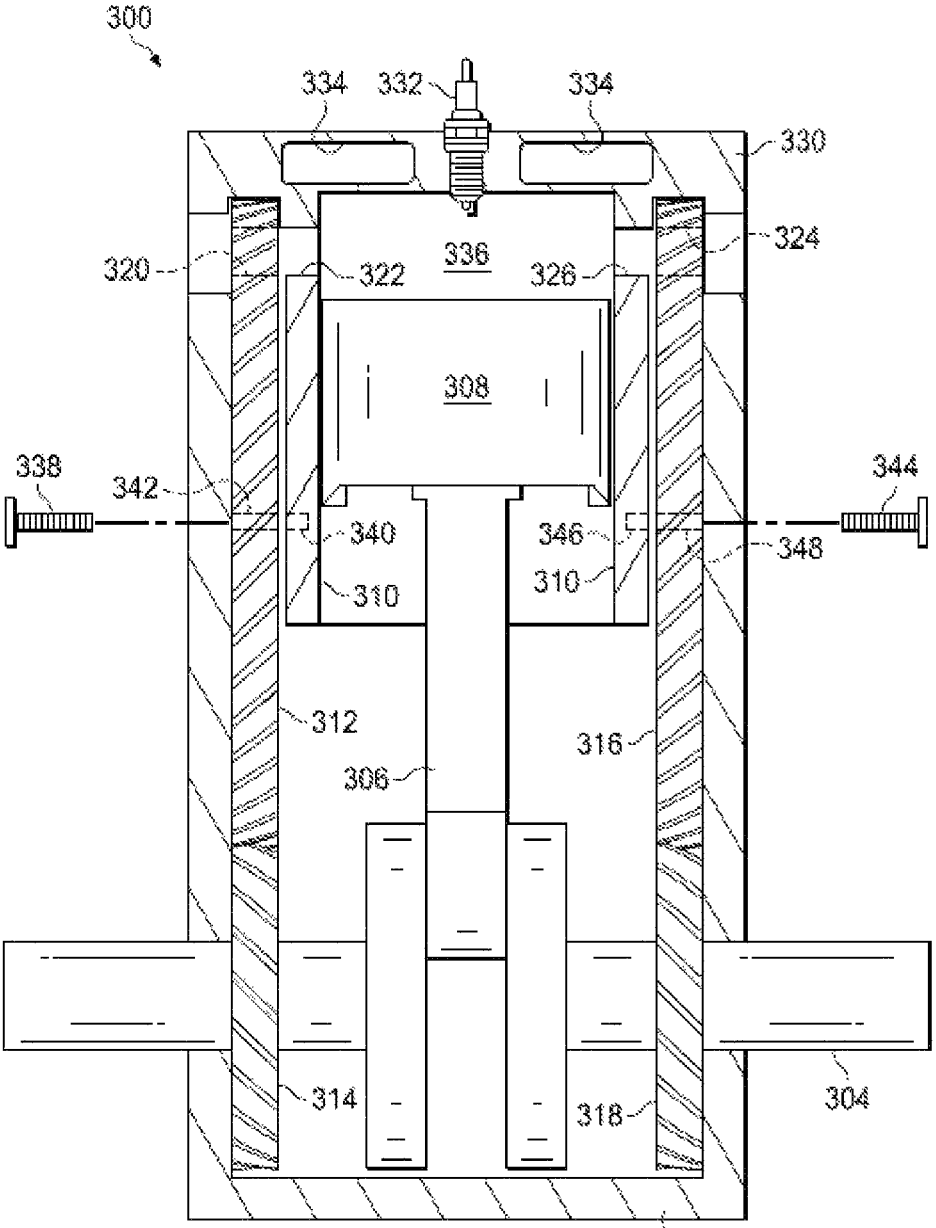
FIG. 6 illustrates a schematic cross section of a conceptual embodiment of the present invention.
Figure 7:
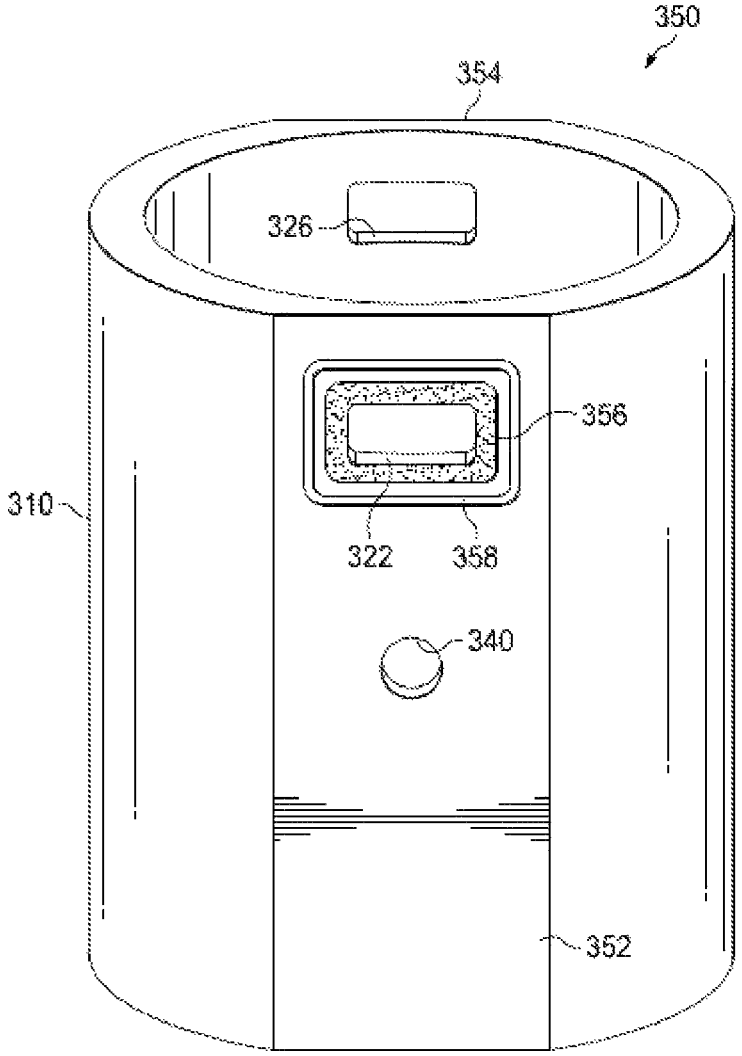
FIG. 7 illustrates a side view of an engine cylinder as formed in the embodiment of FIG. 2.
Figure 11:
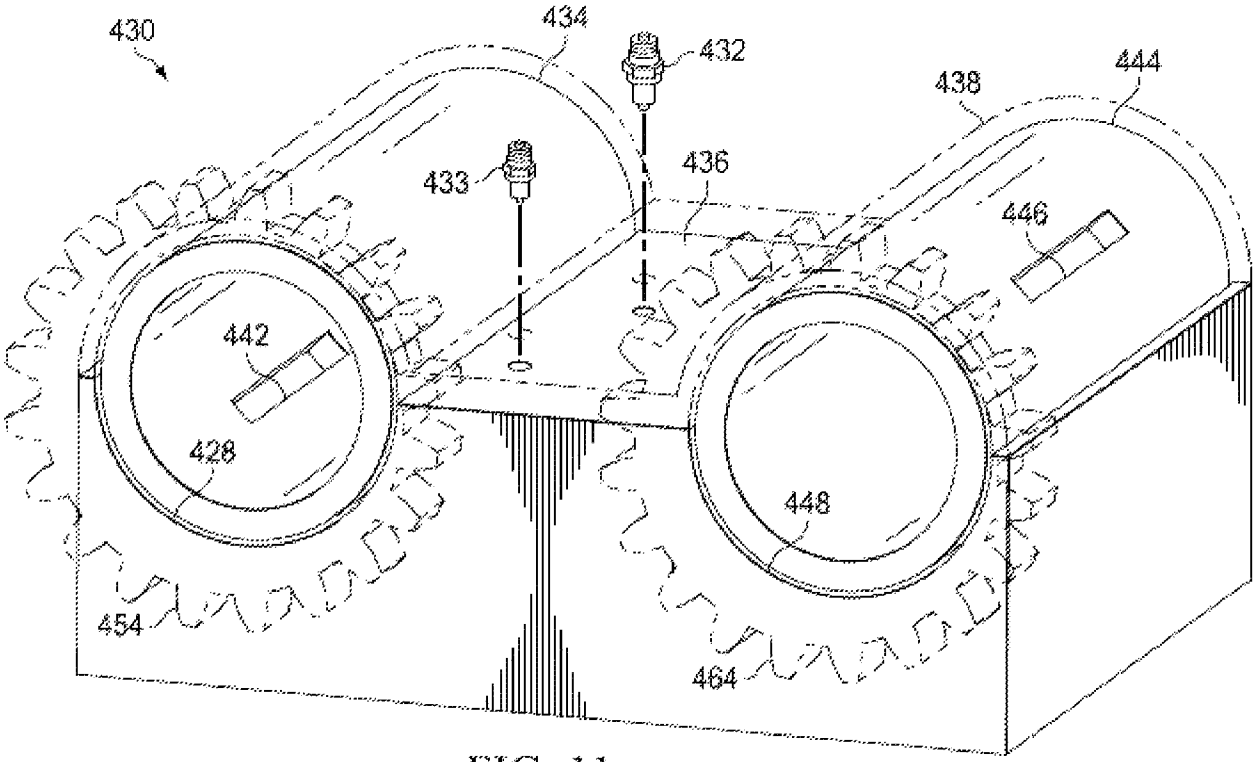
FIG. 11 illustrates an isometric view of a cylinder head portion of the embodiment of FIG. 4.
Figure 12:
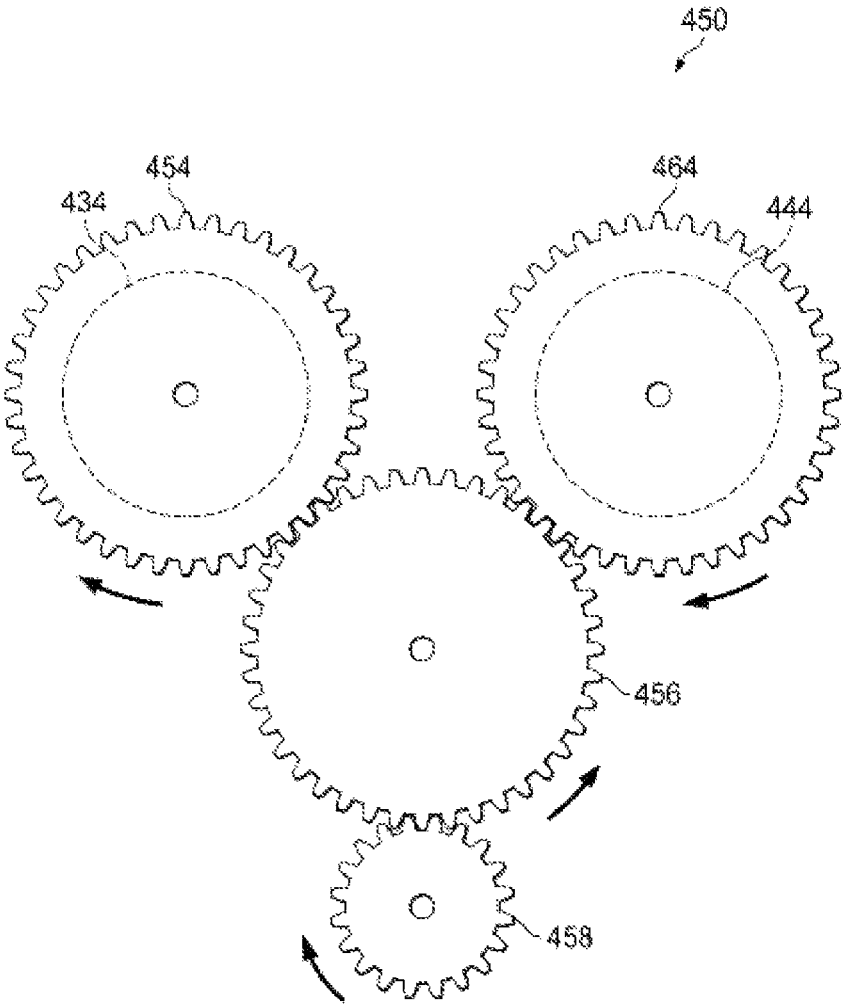
FIG. 12 illustrates a timing gear set for use with the embodiment of FIG. 11.
Figure 13A:
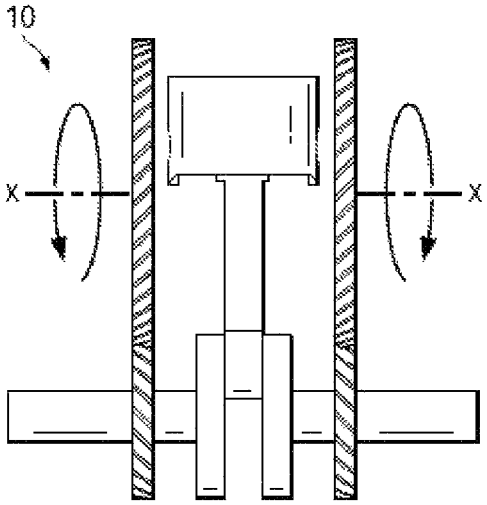
FIG. 13 illustrates a family of symbolic cross section drawings that correspond to the members of the family of embodiments depicted in FIG. 1.
Figure 13B:
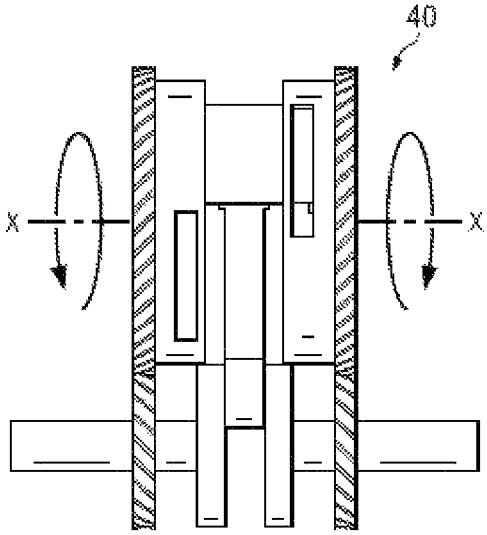
Figure 13C:
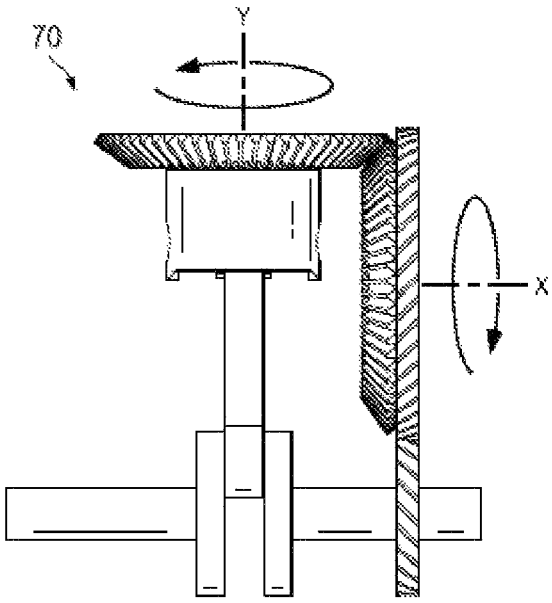
Figure 13D:
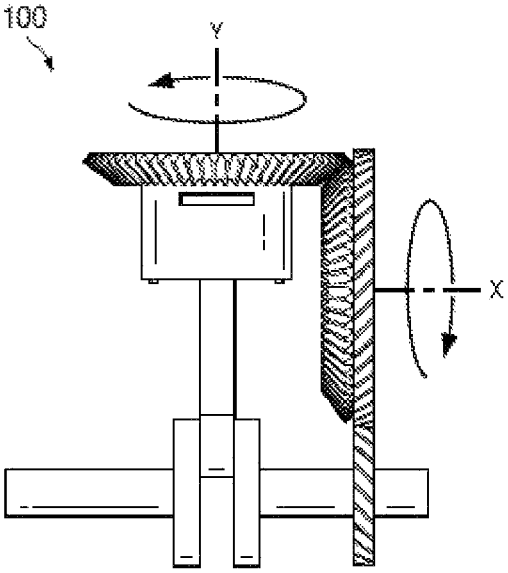
Figure 13E:
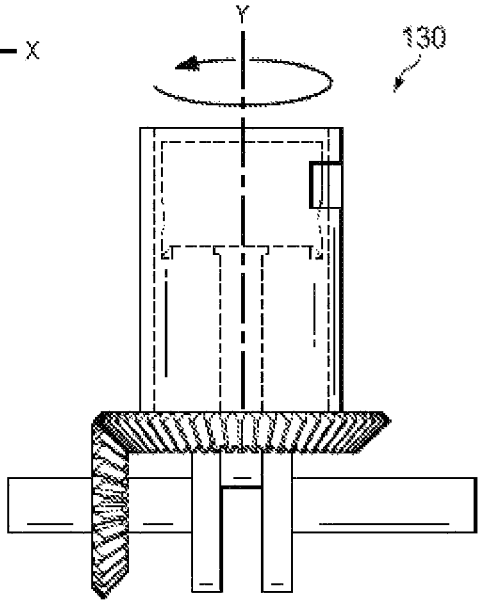
Figure 13F:
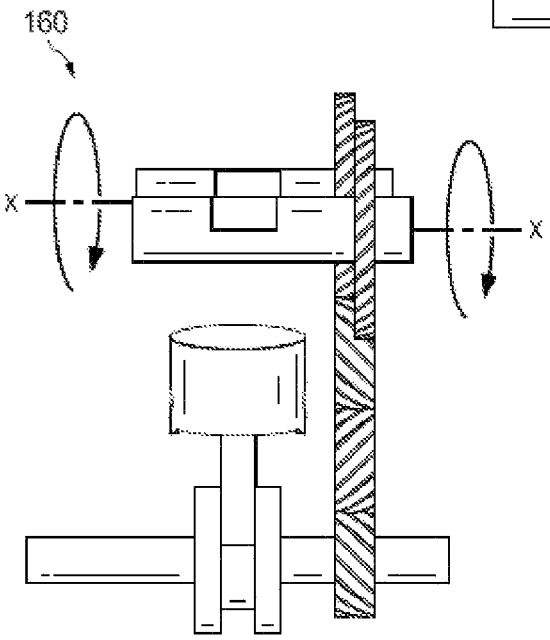
Figure 13G:
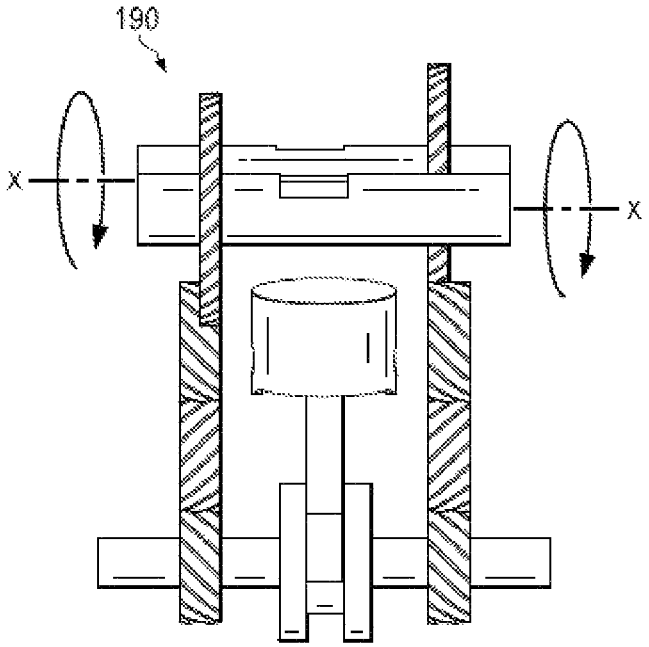
Figure 13H:
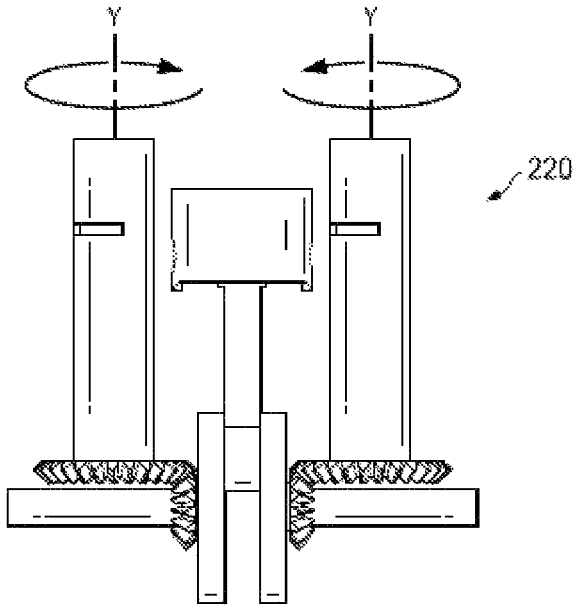
Figure 13I:
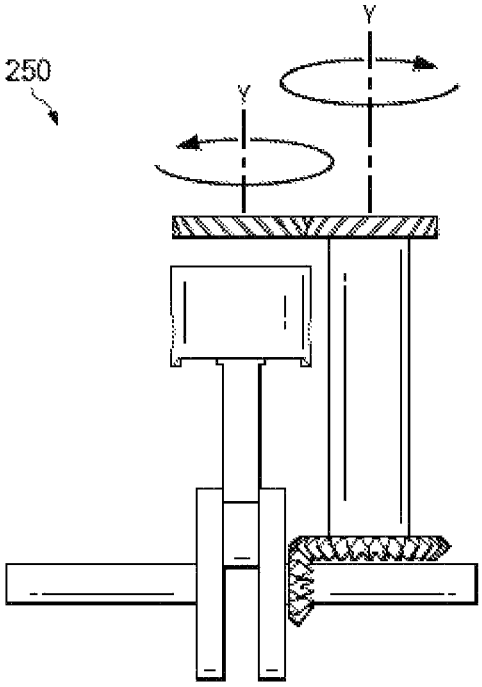
Figure 13J:
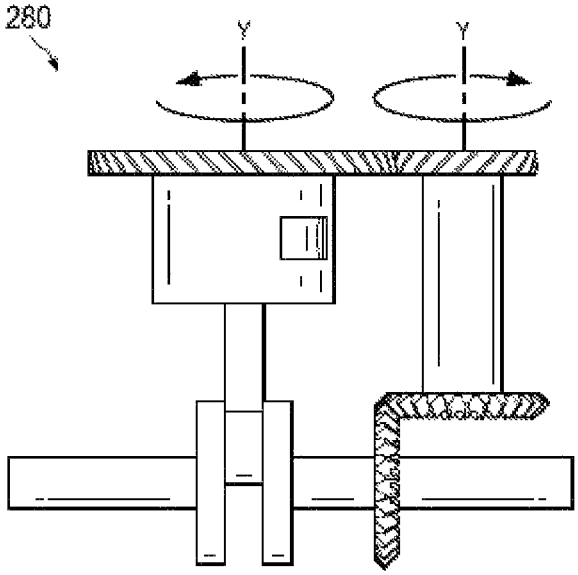

The drawings are organized as follows. FIG. 1 depicts isometric views of each of ten exemplary embodiments of the rotating valve port concept. FIGS. 2 through 5 depict enlarged examples of four of the embodiments shown in FIG. 1 to illustrate the relationships of essential parts of the engines. The four embodiments of FIGS. 2 through 5 illustrate two basic configurations of the invention: type (A) placing the rotating valve port along the outer side of the engine cylinder (FIGS. 2 and 5), and type (B) placing the rotating valve port over the top side of the engine cylinder to connect the inlet or exhaust passages through the cylinder head (FIGS. 3 and 4). FIG. 6 is a schematic cross section view of a type A configuration to describe the structure and operation of the side-disposed rotating valve port embodiments. FIG. 7 illustrates one embodiment of a sealing structure around a valve port in a type A configuration. FIGS. 8A through 8D, 9 and 10 depict several states of a secondary Multi-Stage valve for use with embodiments of the rotating valve concept to vary the cross section area of the intake or exhaust ports; its use is only shown on the intake port. FIGS. 11-12 are schematic depictions of a type B configuration—the top-side-disposed rotating valve port embodiments. FIG. 13 illustrates symbolic representations of the ten embodiments shown in FIG. 1. FIG. 14 provides a flow chart of a method of timing the operation of the intake and exhaust valves. FIG. 15 depicts one embodiment of a sealing structure that confines leakage gases to the immediate region around the joint in the port passages between the rotating and fixed portions of the port structure. Further, in regard to FIGS. 1 through 5, the engine cylinder, combustion chamber, and manifolds are omitted from the isometric views to more clearly show the relationship of the rotating valve ports with the piston, as will become clear in the following description. The view in FIG. 6 includes the engine cylinder head and the combustion chamber.

FIGS. 1A through 1J illustrate isometric views depicting several members of the family of embodiments of the present invention. The illustrations include a crankshaft and piston assembly, the rotating gear elements, and an outside of an engine block, but omit the engine cylinder, cylinder head and manifolds to more clearly depict the essential components of the structure. Ten configurations are shown, representing two orientations of a rotating valve port disposed next to the outer side of an engine cylinder (type A) or next to the top or cylinder head of the engine cylinder (type B). The concepts of the invention are illustrated for a single cylinder, four cycle engine but are adaptable to multiple cylinder engines formed for four or two cycle operation, and to engines designed to operate on gasoline, diesel and other types of fuels. Each of the embodiments may be associated with an identifier of the form RVP-1, RVP-2, . . . RVP-10, where RVP denotes a "rotating valve port" configuration. Examples RVP-1, 4, 5, 8 and 10 depict type A embodiments of the port configuration and RVP-2, 3, 6, 7 and 9 depict type B embodiments of the port configuration.

The rotating valve port is formed in a rotating gear or a cylindrical extension of one side of the rotating gear. The rotating gear (aka a rotating port or driven gear) is driven by a drive gear disposed on a rotating crankshaft. In some implementations an idler gear may be disposed between the drive gear and the rotating valve port gear. In embodiments having the rotating port formed in a cylindrical extension of one side of the rotating gear, the cylindrical extension is configured as a cylindrically-formed ring or tube having first and second parallel edges that define the ends of the cylindrical extension. In some embodiments the cylindrical extension appears as a "short" cylinder; in other embodiments, the cylindrical extension appears as a longer cylinder. In either case, the cylindrical extension may be coaxially attached at the first edge thereof to a side of the rotating disc facing the engine cylinder, such that the second port is formed in the ring between the first and second parallel edges as shown in FIG. 1B for the RVP-2, FIG. 1F for the RVP-6, and FIG. 1G for the RVP-7 configurations.

In general, the rotating ports, and the fixed ports formed in the outer wall of the engine cylinder, may be formed as an aperture elongated in the radial direction of rotation of the rotating port valve. A fixed port in the outer side wall of the engine cylinder may be oriented along a perimeter of the engine cylinder surface, and formed as a radial sector matching the rotating port. Alternatively, the fixed and rotating ports may be formed as a simple rectangular shape varied from square to elongated, or it may be formed to be round or oval. Other shapes and orientation are possible and not limited to these alternatives. As the rotating valve passes the fixed port in the wall of the engine cylinder, the valve opens as the rotating valve port passes over the fixed port, first increasing in open area cross section, reaching a maximum aperture, then decreasing in open area cross section. The shape of the valve ports may be varied to adjust the particular valve opening profile to suit the characteristics of the engine design. For example, the shape may be tailored to vary the speeds of the increase and decrease in the port apertures.

Figure 1B:
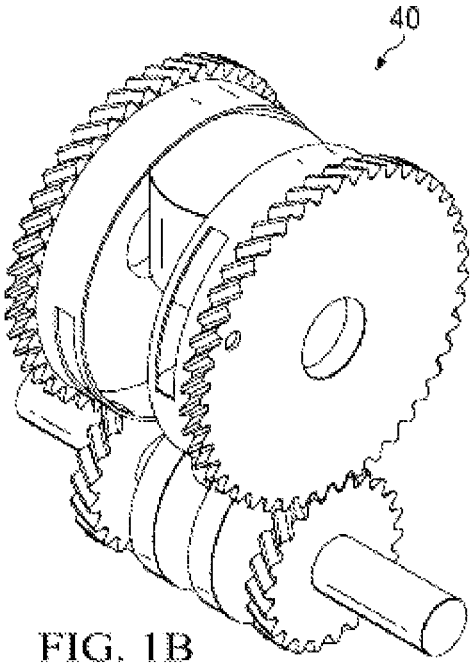

RVP-1 (reference number 10) in FIG. 1A shows a first and a second rotating gear, each disposed on opposite sides of a piston. Each rotating gear includes a port formed through the body of the gear near the perimeter of the gear. As the gear rotates, the port in that gear becomes periodically aligned with a fixed port in an upper side wall of the engine cylinder. This embodiment may be considered the original and most basic implementation. RVP-2 (40) in FIG. 1B is similar but is different in one key aspect: the rotating ports are formed in a short, cylindrical extension of the side of each rotating gear facing the piston. The cylindrical extension may be formed as a thin ring in which the axial length of the ring body is substantially greater than the radial thickness of the ring. As the RVP gear rotates, the cylindrical extension or ring revolves in a relief formed in the engine block and cylinder head (the relief is not shown in FIG. 1B) such that the rotating port becomes periodically aligned over a fixed port in the cylinder head that forms the top end of the engine cylinder. During the period that the port apertures are aligned, incoming air (or air/fuel mixture) is inlet from an intake manifold passage (not shown), or outgoing exhaust gas is outlet into an exhaust manifold passage (not shown).

Figure 1C:
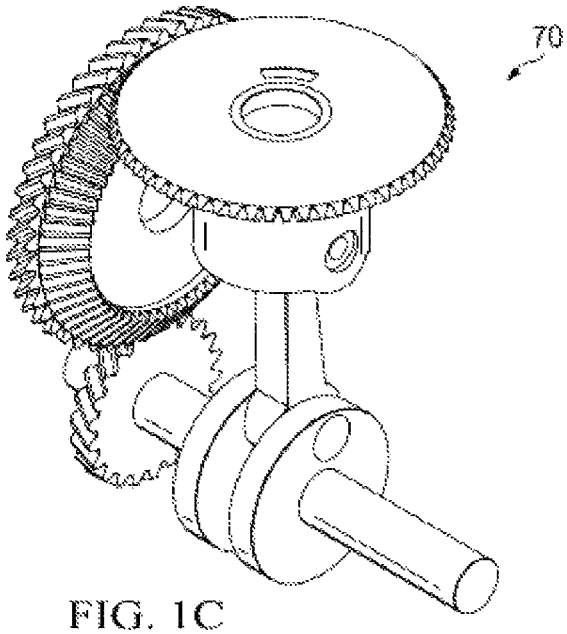
Figure 1D:
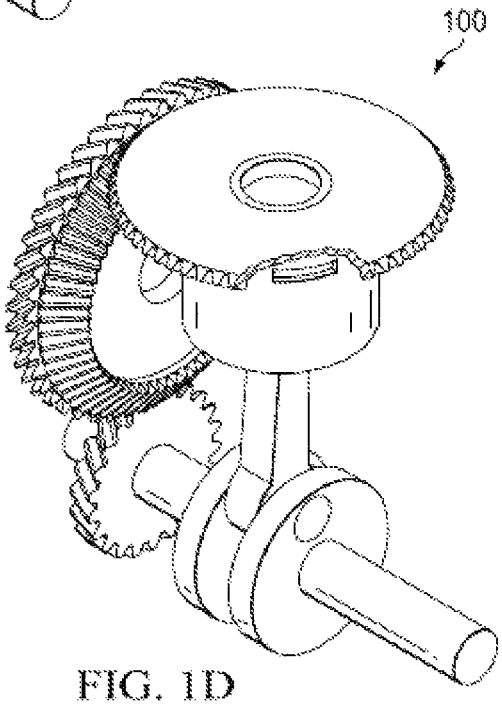
Figure 1E:
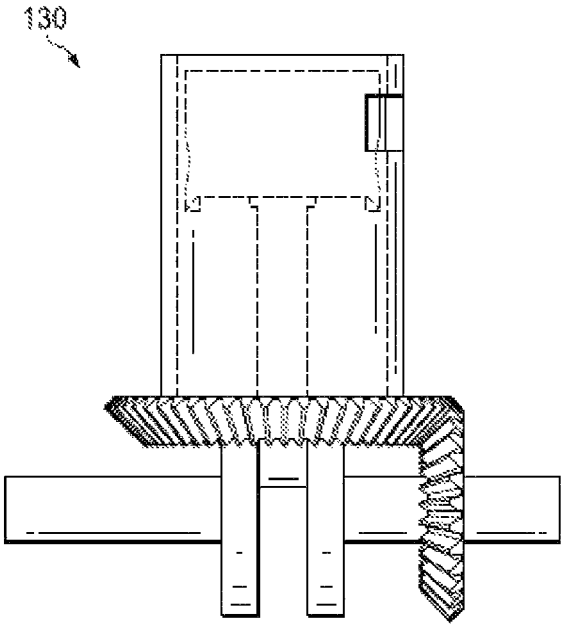
Figure 1F:
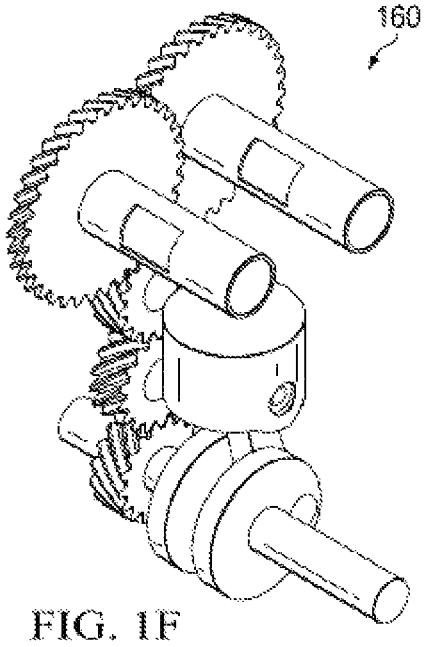
Figure 1G:
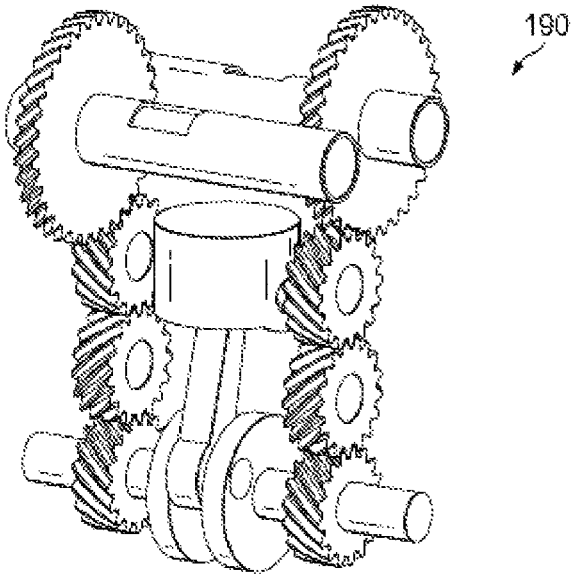
Figure 1H:
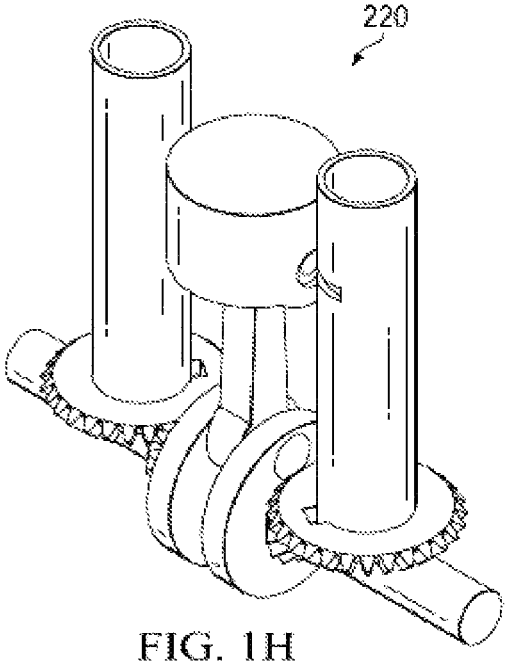
Figure 1I:
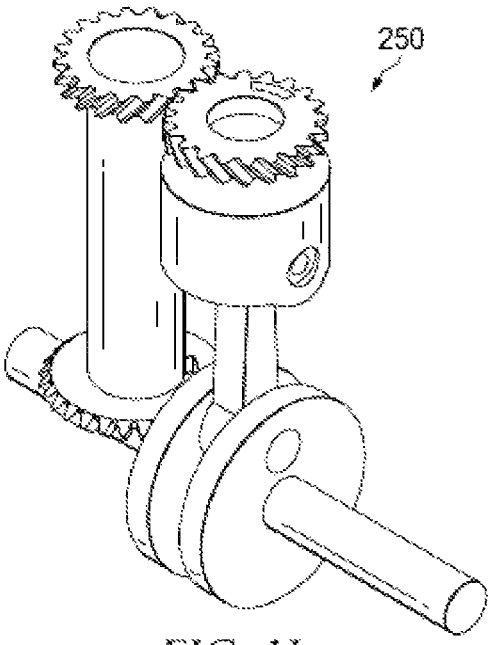

RVP-3 (70) in FIG. 1C and RVP-9 (250) in FIG. 1I are variations or alternate embodiments of the top-side placement of the rotating port, in which the port is formed in a gear that rotates in a plane parallel with the top side of the cylinder and over and above the fixed ports in the cylinder head or top side of the cylinder.

RVP-6 (160) in FIG. 1F and RVP-7 (190) in FIG. 1G are variations or alternate embodiments of the top-side placement of the rotating port, in which the port is formed in a cylindrical extension of the rotating gear and positioned over and above the fixed ports in the cylinder head or top side of the cylinder.

Figure 1J:
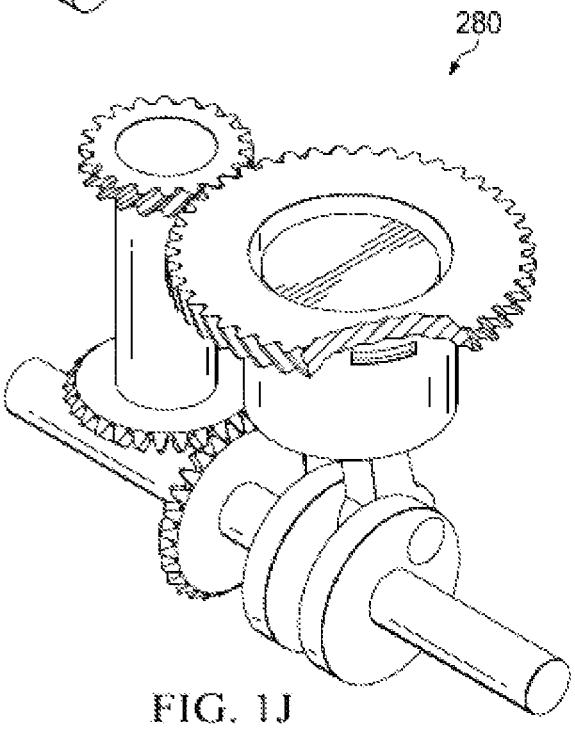

RVP-4 (100) in FIG. 1D and RVP-10 (280) in FIG. 1J are variations or alternate embodiments of the side-placement of the rotating port, in which the rotating port is formed in a downward-disposed cylindrical extension of a rotating gear whose axis of rotation is along a centerline of the engine cylinder. These two embodiments differ in the combination of driven gears coupling the rotating gear to the crankshaft. RVP-4 (100) in FIG. 1D employs a single drive gear; RVP-10 (280) in FIG. 1J employs first and second small drive gears disposed on opposite ends of an intermediate cylindrical coupling tube.

RVP-5 (130) in FIG. 1E and RVP-8 (220) in FIG. 1H are variations or alternate embodiments of the side-placement of the rotating port in which the rotating port is formed in the wall of a cylindrical extension that rotates on an axis coincident (RVP-5) in FIG. 1E or parallel (RVP-8) in FIG. 1H with the axis of the engine cylinder and periodically positions the rotating port in alignment with the fixed port in the side wall of the engine cylinder. RVP-5 (130) places the rotating cylinder around the engine cylinder such that its axis of rotation is shared with—i.e., coincident with—the axis of the engine cylinder. RVP-8 (220) places the rotating cylinder alongside the engine cylinder on an axis of rotation separate from the engine cylinder.

Of the ten configurations depicted in FIG. 1, two examples of a side-placement of the rotating valve port will be described in FIGS. 2 and 5; similarly, two species of a top-side placement of the rotating valve port will be described in FIGS. 3 and 4. All of the examples use similar concepts and components in structure and operation. Each of the components is identified by a reference number and bears the same reference number if shown in more than one figure. However, FIGS. 2, 3, 4, and 5 omit the engine cylinder in the isometric views for clarity. Reference to FIG. 6, which depicts the engine cylinder 310 and a cylinder head 330 in cross section, illustrates the relationship of the cylinder valve ports 322 (intake) and 326 (exhaust) in the engine cylinder 310.

Figure 2:
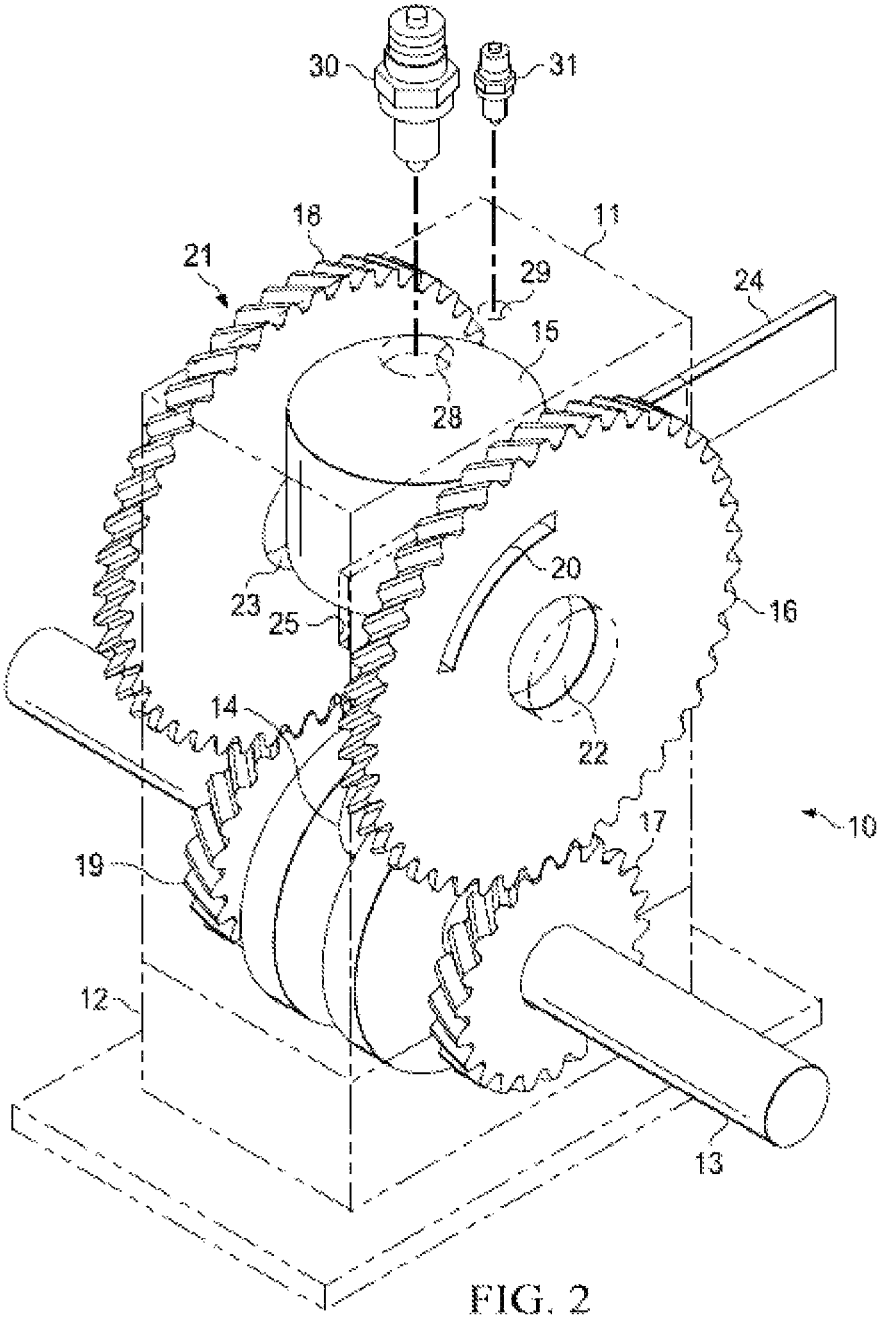
FIG. 2 illustrates an isometric view of a first embodiment of the present invention.

FIG. 2 illustrates an isometric view of a first embodiment RVP-1 (10) of the present invention, an example of an engine assembly 10 having a side-placement of the rotating valve port concept. The engine assembly 10 includes in outline an engine block 11, a crankcase 12, and a crankshaft 13 supported in the junction of the engine block 11 and crankcase 12. A piston 15 is coupled to the crankshaft 13 by a connecting rod 14 for reciprocating motion within the engine cylinder 310 (See FIG. 6). On a first side of the assembly 10 is a rotating gear 16 that meshes with a drive gear 17 on the crankshaft 13 such that the rotating gear 16 rotates next to the first side of the engine cylinder 310. In the rotating gear 16 an intake port 20 is formed through the body of the rotating gear 16, and the rotating gear 16 rotates about an axis on a center 22. Similarly, on a second side of the assembly 10 is a rotating gear 18 that meshes with a drive gear 19 on the crankshaft 13 such that the rotating gear 18 rotates next to the second side of the engine cylinder 310. In the rotating gear 18 an exhaust port 21 (not visible in this view, but see, e.g., exhaust port 324 in FIG. 6) is formed through the body of the rotating gear 18, and the rotating gear 18 rotates about an axis on a center 23.

Continuing with FIG. 2, a multi-stage throttle valve 24 ("MS valve") is shown withdrawn from a passage 25. The MS valve may be positioned between the rotating intake valve port 20 and the fixed intake valve port in the wall of the engine cylinder 310 (See FIG. 6) and configured to vary the cross sectional area of the passage through the intake into the engine cylinder 310. Operation of the valve 24 will be described in FIG. 8. An aperture 28 may be threaded and provided for an igniter such as a spark plug 30 or other electrical or energetic ignition component including, for example a laser igniter or a glow plug to initiate combustion of the air/fuel mixture. Another aperture 29 may be threaded and provided for a fuel injector 31 when direct fuel injection into the engine cylinder is provided, which is preferred in the illustrated embodiment. As well-known in the art, the fuel may be introduced or injected into a port or manifold passage using a fuel metering device such as a carburetor to be mixed with the incoming air to produce the air/fuel mixture in the correct (i.e., stoichiometric) proportions before it is admitted through an intake port into the engine cylinder. Another example of the latter would be a throttle-body injection structure, where both a throttle valve and a fuel injector are disposed along an intake port of a manifold, in the manner of a conventional carburetor.

FIG. 3 illustrates an isometric view of a second embodiment RVP-2 of the present invention, an example of a top-side placement of the rotating valve port concept. The engine assembly 40 includes in outline an engine block 41, a crankcase 42, and a crankshaft 43 supported in the junction of the engine block 41 and crankcase 42. A piston 45 is coupled to the crankshaft 43 by a connecting rod 44 for reciprocating motion within the engine cylinder 310 (See FIG. 6). On a first side of the assembly 40 is a rotating gear 46 that meshes with a drive gear 47 on the crankshaft 43 such that the rotating gear 46 rotates next to the first side of the engine cylinder 310. On the rotating gear 46 an intake port 52 is formed in a cylindrical ring—a short cylindrical extension 50 of the rotating gear 46, and the rotating gear 46 rotates about an axis on a center 54. Similarly, on a second side of the assembly 40 is a rotating gear 48 that meshes with a drive gear 49 on the crankshaft 43 such that the rotating gear 48 rotates next to the second side of the engine cylinder 310. In the rotating gear 48 an exhaust port 51 is formed in a short cylindrical extension 53 of the rotating gear 48, and the rotating gear 48 rotates about an axis on a center 55.

Continuing with FIG. 3, a multi-stage throttle valve 56 is shown withdrawn from a passage 57. The valve 56 may be positioned between the rotating intake valve port 52 and the fixed intake valve port 62 in broken outline in the upper part of the engine cylinder (not shown for clarity, but the engine cylinder is in the position shown in FIG. 6 to be described) in the engine block 41 and configured to vary the cross sectional area of the passage through the intake valve ports 52, 62 into the engine cylinder. Operation of the valve 56 will be described in FIG. 8. An aperture 58 may be threaded and provided for a spark plug 60 or other energetic ignition device. Another aperture 59 may be threaded and provided for a fuel injector 61.

FIG. 4 illustrates an isometric view of a third embodiment RVP-6 of the present invention, in a second example of a top-side placement of the rotating valve port concept. It is drawn with a perspective to depict the rotating valves more clearly by locating the respective gears on the back side of the view in FIG. 4. The engine assembly 160 includes in outline an engine block 161, a crankcase 162, and a crankshaft 163 supported in the junction of the engine block 161 and crankcase 162. A piston 165 is coupled to the crankshaft 163 by a connecting rod 164 for reciprocating motion within the engine cylinder 310 (See FIG. 6).

Continuing with FIG. 4, on a first side of the assembly 160 is a rotating gear 166 that is coupled through idler gears 167B and 167A to a drive gear 167 disposed on the crankshaft 163 such that the rotating gear 166 causes the cylindrical extension 170 attached to the rotating gear 166 along their common axis to rotate and position the rotating port aperture 171 formed in the cylindrical extension 170 to align with a fixed port (not shown) in the top side of the engine cylinder 310. Similarly, a second rotating gear 168 may also be coupled through the idler gears 167B and 167A to the drive gear 167 disposed on the crankshaft 163 such that the rotating gear 168 causes its cylindrical extension 172 attached to the rotating gear 168 along their common axis to rotate and position the rotating port aperture 173 formed in the cylindrical extension 172 to align with a fixed port (not shown) in the top side of the engine cylinder 310. The multi-stage valve 174 shown in this view reciprocates in the multi-stage valve port 175 similar to the multi-stage valves shown in FIG. 3. An aperture 178 may be threaded and provided for a laser igniter or spark plug 180. Another aperture 179 may be threaded and provided for a fuel injector 181.

A word about implementation of RVP-6 and RVP-7, shown in FIGS. 1F and 1G with a lower (intermediate) idler gear 167A and a second upper (intermediate) idler gear 167B for transferring the rotation of the crankshaft to the rotating valve gears 166 and 168. Two idler gears are shown as one preferred configuration that avoids more difficult space considerations likely if a single idler gear is used. Another issue is the gear ratios necessary to synchronize the valve operations with the four cycle or two cycle timing sequences. It will also be noted that the second rotating valve gear 168 may be offset from the plane of the first rotating valve gear 166 to permit them being driven by the same drive-and-idler gear configuration. These and other related issues will be discussed further during the description of FIG. 12.

Figure 5:
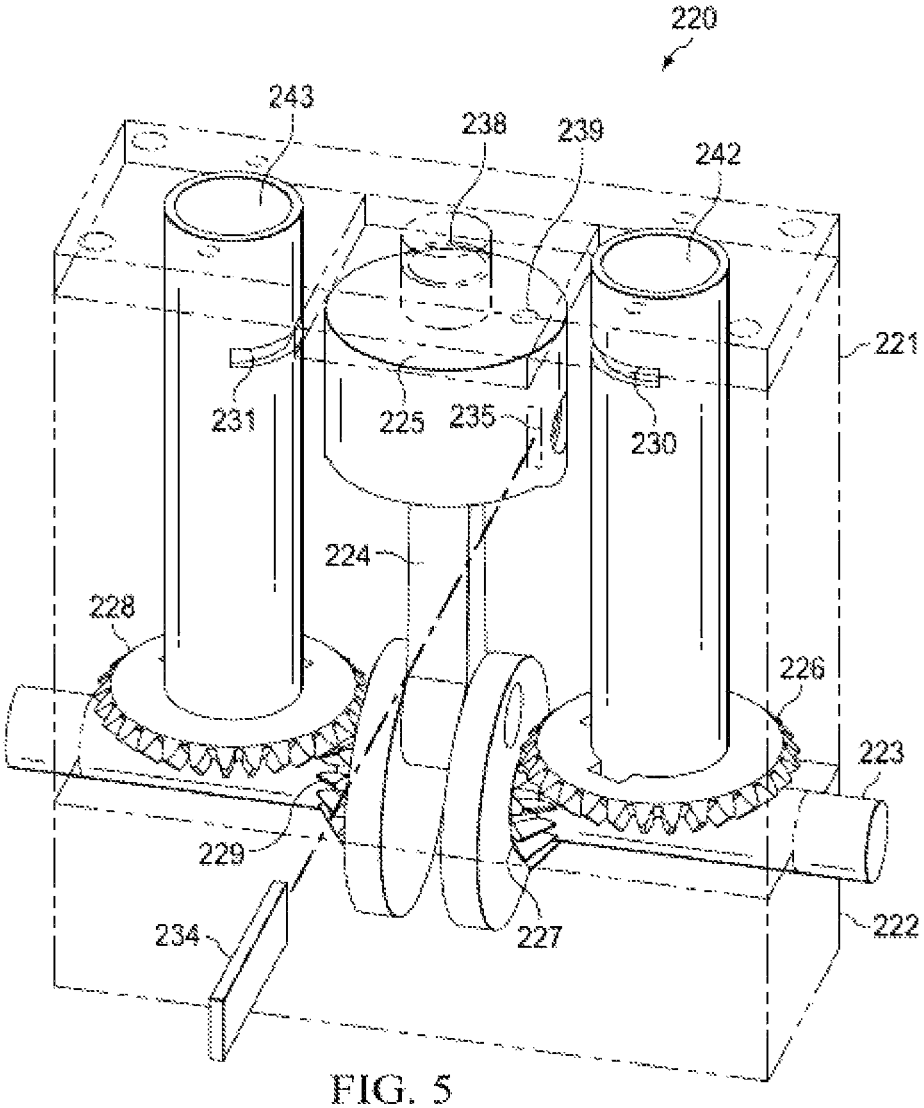
FIG. 5 illustrates an isometric view of a fourth embodiment of the present invention.

FIG. 5 illustrates an isometric view of a fourth embodiment RVP-8 of the present invention, in a second example of a side-placement of the rotating valve port concept. FIG. 5, the isometric view, will be described with reference to FIG. 6, a side cross section view, in the following description. The engine assembly 220 includes in outline an engine block 221, a crankcase 222, and a crankshaft 223 supported in the junction of the engine block 221 and crankcase 222. A piston 225 is coupled to the crankshaft 223 by a connecting rod 224 for reciprocating motion within an engine cylinder. An engine cylinder is not shown in FIG. 5 for clarity of these engine structures. However, reference to FIG. 6 depicts a side cross section view of an engine cylinder 310 that is typical of the Type A side-placement embodiments defined previously, which includes a first fixed port 322 (for the intake side) and a second fixed port 326 (for the exhaust side) disposed through the wall of the engine cylinder 310.

Continuing with FIG. 5, a first side of the assembly 220 is a rotating gear 226 that meshes with a drive gear 227 on the crankshaft 223 such that the rotating gear 226 causes the cylindrical extension 242 attached to the rotating gear 226 along their common axis to rotate and position the rotating port aperture 230 (see also the rotating port 320 in FIG. 6) formed in the cylindrical extension 242 to align with a fixed intake port such as the fixed intake port 322 disposed in the wall of the engine cylinder 310 as shown in FIG. 6. The fixed intake port 322 may be disposed in the upper portion of the engine cylinder 310 leading directly into the combustion chamber 336 above the piston 225 of FIG. 5 (or the piston 308 in FIG. 6) Similarly, a second rotating gear 228 may also be coupled to the drive gear 229 disposed on the crankshaft 223 such that the second rotating gear 228 causes its cylindrical extension 243 attached to the second rotating gear 228 along their common axis to rotate to cause the rotating port aperture 231 formed in the cylindrical extension 243 to align with an fixed exhaust port in the wall of the engine cylinder as is the fixed exhaust port 326 in the engine cylinder 310 of FIG. 6. The fixed exhaust port 326 may be disposed in the upper portion of the engine cylinder 310 leading directly out of the combustion chamber 336.

The inlet and outlet passages for the inlet air/fuel mixture and the exhaust waste gases (not shown in FIG. 5) may be disposed to enter through both sides of the respective valve cylinder for coupling with the respective valve port inside the valve cylinder. The valve timing may be set by the number of teeth on the gears, with the valve cylinder extensions rotating at one-half the crankshaft speed in a four cycle engine. The valve cylinder extensions as depicted in the Figures may be supported in cylindrical bearing surfaces whose diameter is slightly greater than the diameter of the valve cylinders. The valve cylinders may be lubricated by a connection (not shown) with the pressurized lubrication system of the engine in a manner similar to the lubrication of the crankshaft journal bearings that support the crankshaft in the crankcase. The axial length of the valve cylinders may be varied depending on the size of the valve port opening, the space available in the engine block, the position of the second (fixed port) in the wall of the engine cylinder, etc. However, to minimize friction and the loading on the rotating element, the axial length may generally be less than shown in FIG. 4 or 5.

FIG. 6 illustrates a schematic cross section of a conceptual embodiment of a single cylinder internal combustion engine 300 having rotating valve ports according to the present invention. A representation of an engine block 302 includes a crankshaft 304, and a connecting rod 306 connected to the lower end of a piston 308 for imparting reciprocating motion within a cylinder 310. Included next to the walls of the cylinder 310 is a first rotating valve gear 312 driven by a first drive gear 314 on the crankshaft 304. Similarly, a second rotating valve gear 316 is driven by a second drive gear 318 also connected to the crankshaft 304. The rotating valve gear 312 includes an intake valve port 320 aligned with a fixed intake port 322 in the upper portion of the wall of the cylinder 310 just below the cylinder head 330. The rotating valve gear 316 includes an exhaust valve port 324 aligned with a fixed exhaust port 326 in the upper portion of the wall of the cylinder 310 just below the cylinder head 330. An energetic ignition component such as a laser igniter (not shown) or spark plug 332 for igniting the air/fuel mixture is disposed in the top side of the cylinder head 330 and extending into a combustion chamber 336.

Continuing with FIG. 6, the first rotating valve gear 312 may rotate on an axle stub or shoulder bolt 338 set through a bushing 342 into a tapped hole 340 in the wall of the engine cylinder 310. Similarly, the second rotating valve gear 316 rotates on an axle stub or shoulder bolt 344 set through a bushing 348 into a tapped hole 346 in the wall of the engine cylinder 310. The axes of rotation of the rotating valve gears 312, 316 are defined respectively by the shoulder bolts 338 and 344.

Sealing the rotating valve port structure to contain leakage of intake or exhaust mixtures or gases may be developed from several alternatives. As is well-known, sealing the space between an engine cylinder and a piston is provided by piston rings, usually one for controlling the dispersion of lubricating oil and one or two others for preventing combustion gases from entering the crankcase and maintaining the pressure within the cylinder during the two or four cycles of the ICE operation. Other alternatives include gaskets and O-rings.

FIG. 7 illustrates a side view of an engine cylinder 310 as formed in the embodiment of FIG. 6. An intake side face 352, and the exhaust side face 354 are machined flat on opposite sides of the wall of the engine cylinder 310 to provide a smooth surface to receive a sealing mechanism formed by an inner gasket 356 and an outer compression ring 358, which may be disposed between the side of the engine wall around the fixed intake port 322 and the fixed exhaust port 326 respectively. In an alternate embodiment the compression ring 358 may be replaced by a sealing ring by applying a heat-resistant synthetic compound or gasket in the groove formerly occupied by the compression ring 358. The groove for a sealing ring may be machined in the face of the rotating valve disc or the wall of the engine cylinder 310 to provide the sealing structure shown in FIG. 7. In some embodiments the gasket may be an O-ring specifically shaped to fit the machined groove.

In another alternate embodiment, the effectiveness of the seal may be enhanced by coating the facing surfaces of the wall of the engine cylinder 310 and the rotating member embodying the rotating valve port with a high-temperature ceramic material such as a ceramic paint, a powder coating with embedded ceramic material that can be electrostatically applied, or a powder coating alone. The coating may also be applied to the Multi-Stage valve structure to be described in FIGS. 8A through 10. These ceramic or powder coating materials may provide a surface finish that is more resistant to wear, thereby reducing the heat build-up through reduced friction between the rotating valve port member and the side wall of the engine cylinder.

Other methods or structures for sealing the RVP mechanisms may include machined ridges and/or grooves in the surfaces of the wall of the engine cylinder or the face of the rotating valve. For example, the inside face of the rotating valve disc may be equipped with two concentric cylindrical extensions or rings, radially-disposed on either side of the valve port formed in the rotating valve disc. The seal may be completed by forming corresponding grooves in the wall of the engine cylinder to receive the cylindrical extensions (rings). Another example using this ridge-and-groove concept is illustrated in FIG. 15. In FIG. 15, the wall of the engine cylinder around the border of the second valve port may be machined to include a small ridge—for example no larger than about 0.040" above the surface of the wall of the engine cylinder; and the face of the rotating valve disc may be inset by the same 0.040" depth between radii that straddles the radial dimensions of the first valve port in the rotating disc. When assembled, any leakage is contained within the space between the wall of the engine cylinder and the inset face of the rotating disc and bounded by the outer and inner sides of the inset space. This example may be identified as the combination of a ridge around the (fixed) second port and a facial inset around the first (rotating) valve port. It is an example that reduces the required machining to a minimum by including it during the manufacture of the engine cylinder and the rotating valve disc themselves.

In one variation of the structure depicted in FIG. 15, the inset region may be formed in the inner face of the rotating valve disc and the ridge or elevated feature formed in the outer face of the wall of the engine cylinder.

FIG. 8 illustrates four views, FIGS. 8A, 8B, 8C, and 8D, of a multi-stage valve system 360 for use in the embodiment of FIG. 2. Each diagram includes a rotating valve gear 16 and a respective valve port 20. The multi-stage valve ("MSV") system, which is used to vary the cross sectional area of the rotating valve ports 320, 324, provides a way to regulate operation of the RVP engine. The MSV (or MS valve) may be used as a throttle when disposed as part of the rotating intake valve apparatus of the engine. It may also be used to regulate the cross sectional area of the exhaust valve port, not as a throttle valve but for purposes associated with the temperatures of the combustion chamber 336 and the exhaust gases, the emission levels of the engine exhaust, etc. These parameters may be controlled through an appropriate mechanical linkage by computer control that may be configured by software, for example. FIGS. 8A-8D depict four views or states of one embodiment of the multi-stage valve used as a throttle controlled by engine vacuum. As will be described, the MS valve may be configured as a thin baffle attached to a vacuum diaphragm link so that it may be reciprocated toward and away from alignment with the intake valve port, thus providing a mechanism to vary the cross sectional area of the intake valve port into the cylinder thereby to act as a throttle valve.

Figure 8A:
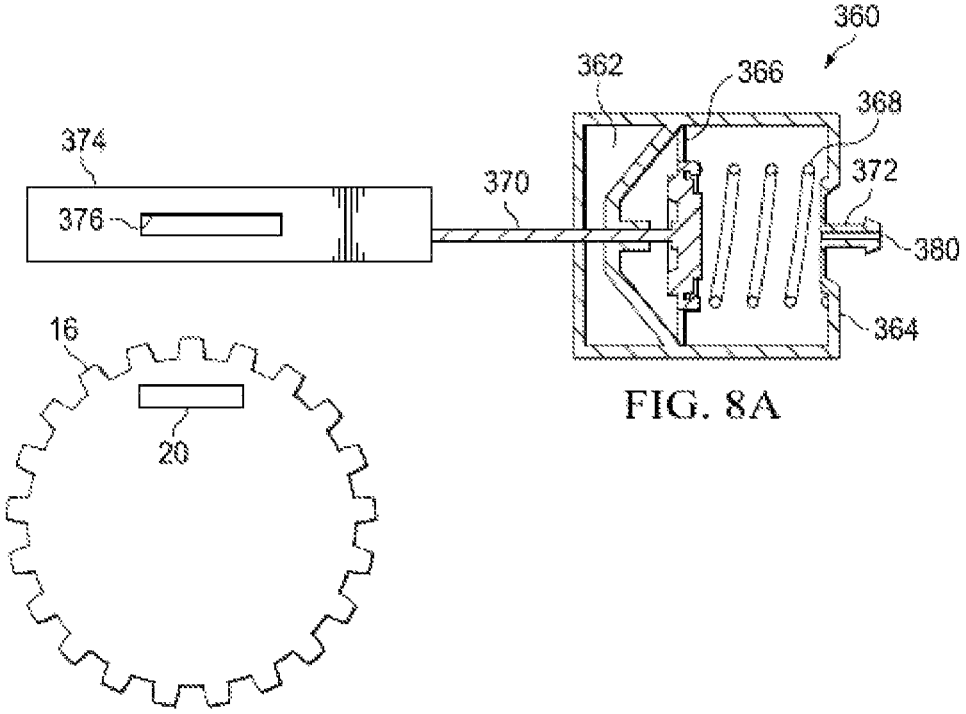
FIG. 8 illustrates four views, FIGS. 8A, 8B, 8C, and 8D, of a multi-stage valve system for use in the embodiment of FIG. 2.
Figure 8B:
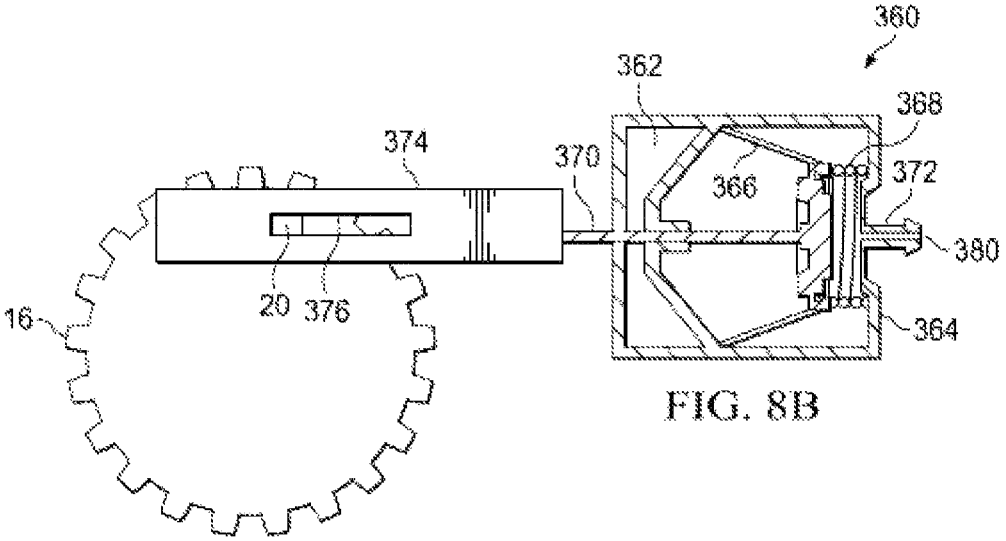
Figure 8C:
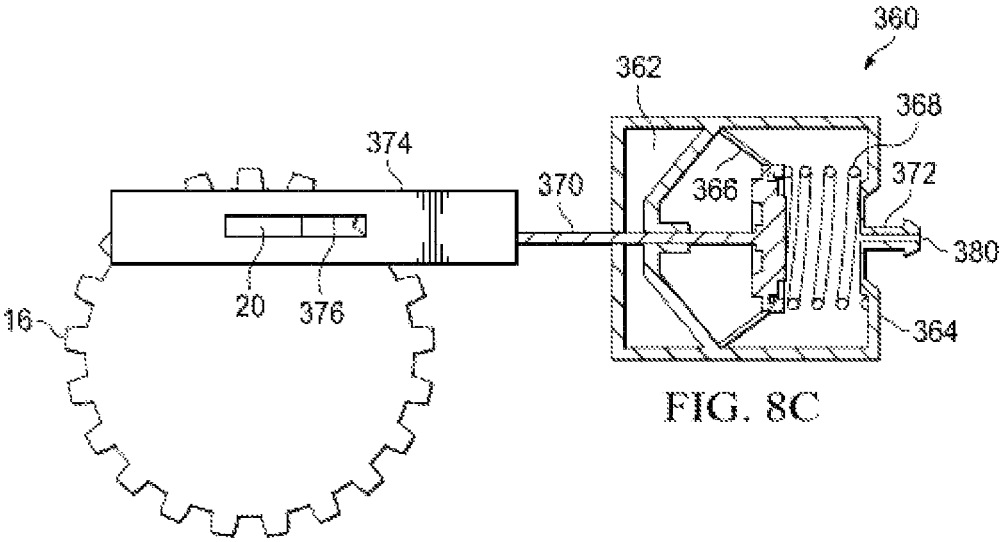

Continuing with FIG. 8A, a vacuum diaphragm assembly 362 includes a housing 364, a vacuum diaphragm 366, a return spring 368, and an operating rod 370 connected at one end to the vacuum diaphragm 366 and the return spring 368, both located within the housing 364. The opposite end of the operating rod 370 is connected to an MSV plate 374. A vacuum port 372 connects the interior of the vacuum diaphragm 366 to a source of vacuum 380 regulated by a throttle or "accelerator" (not shown) if the vacuum diaphragm assembly 360 is used to control the volume of air fuel mixture admitted into the combustion chamber 336 via the rotating intake valve 312. The MSV plate 374 includes a valve port 376 that may be aligned with the rotating valve port 20. Motion of the MSV plate 374 can be varied from fully withdrawn as in FIG. 8A when the engine is not operating, engine vacuum is zero and the spring 368 is fully expanded, to fully-advanced as in FIG. 8D corresponding to wide open throttle when the engine vacuum is at its minimum level and the spring 368 is nearly fully expanded. FIG. 8B depicts the approximate position of the MSV plate 374 provided by the maximum vacuum condition that occurs when the engine is idling. FIG. 8C depicts the approximate position of the MSV plate 374 provided at a part-throttle condition such as when the vehicle or machine is operating under a moderate load. Control of the MS valve may be assisted in its advance by the return spring 368 that supplies the force to advance the MS valve, in opposition to the force applied to the vacuum diaphragm, which acts to retract the MS valve. The MS valve thus can be operated as a throttle valve to vary the engine's power output.

Figure 9:
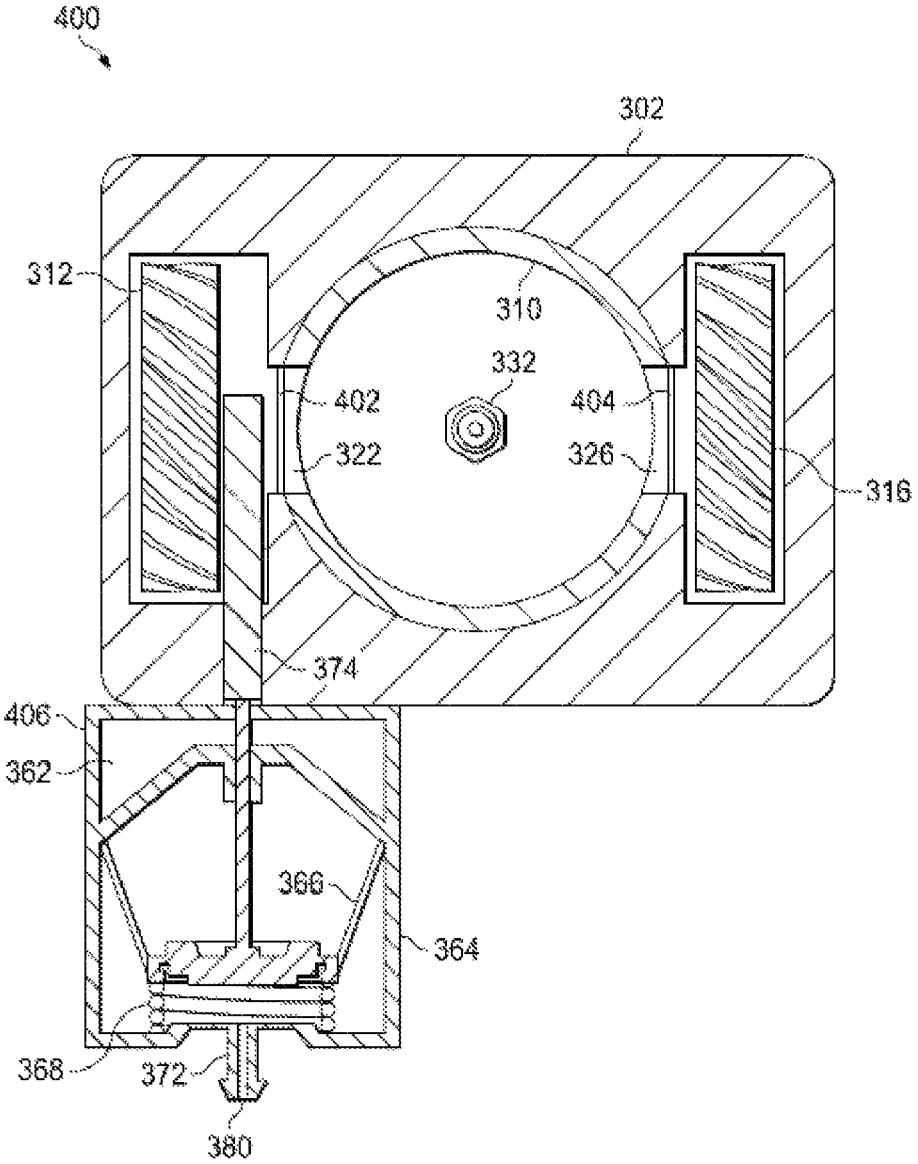
FIG. 9 illustrates a top-down view of a cross section of an engine cylinder according to the embodiment of FIG. 2 that includes the multi-stage throttle valve system depicted in FIG. 8 in a closed-throttle state.

FIG. 9 illustrates a top-down view of a cross section of an engine cylinder 310 according to the embodiment of FIG. 2 that includes an MS intake valve 374 depicted in FIG. 8A in a closed-throttle state. The representation of an engine block 302 includes the engine cylinder 310 and its associated fixed intake 322 and fixed exhaust 326 ports formed in the walls of the engine cylinder 310. The rotating valve gear 312 is shown adjacent the engine cylinder 310. Similarly, a rotating valve gear 316 is shown adjacent the fixed exhaust valve port 326. Also shown in FIG. 9 are edge-wise views of the location of first (intake) 402 and second (exhaust) 404 seals disposed between the adjacent wall of the engine cylinder 310 and the rotating valve gears 312, 316. The seal structure is described briefly in FIG. 7. Disposed next to the engine block 302 is one embodiment of a vacuum diaphragm assembly 362 supported by a bracket 406.

Figure 8D:
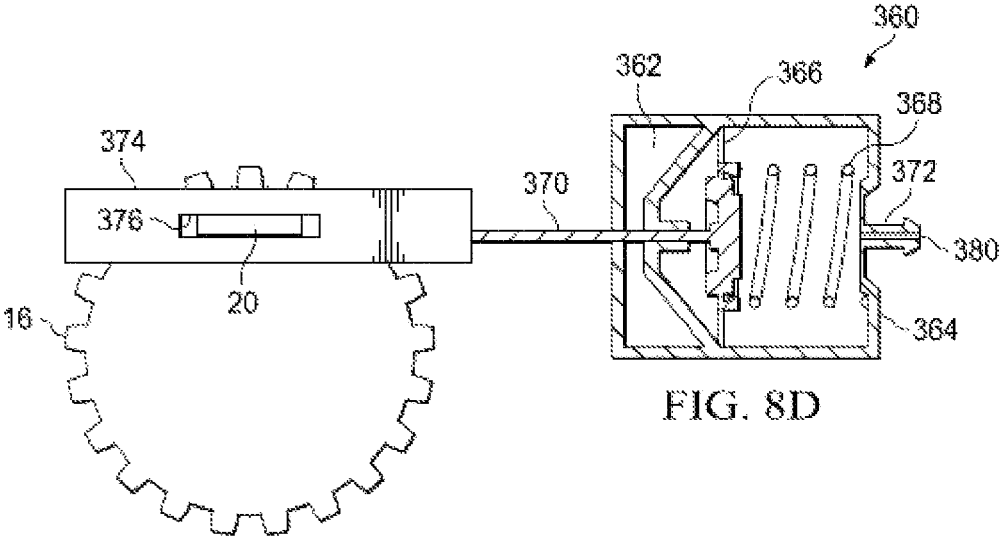
Figure 10:
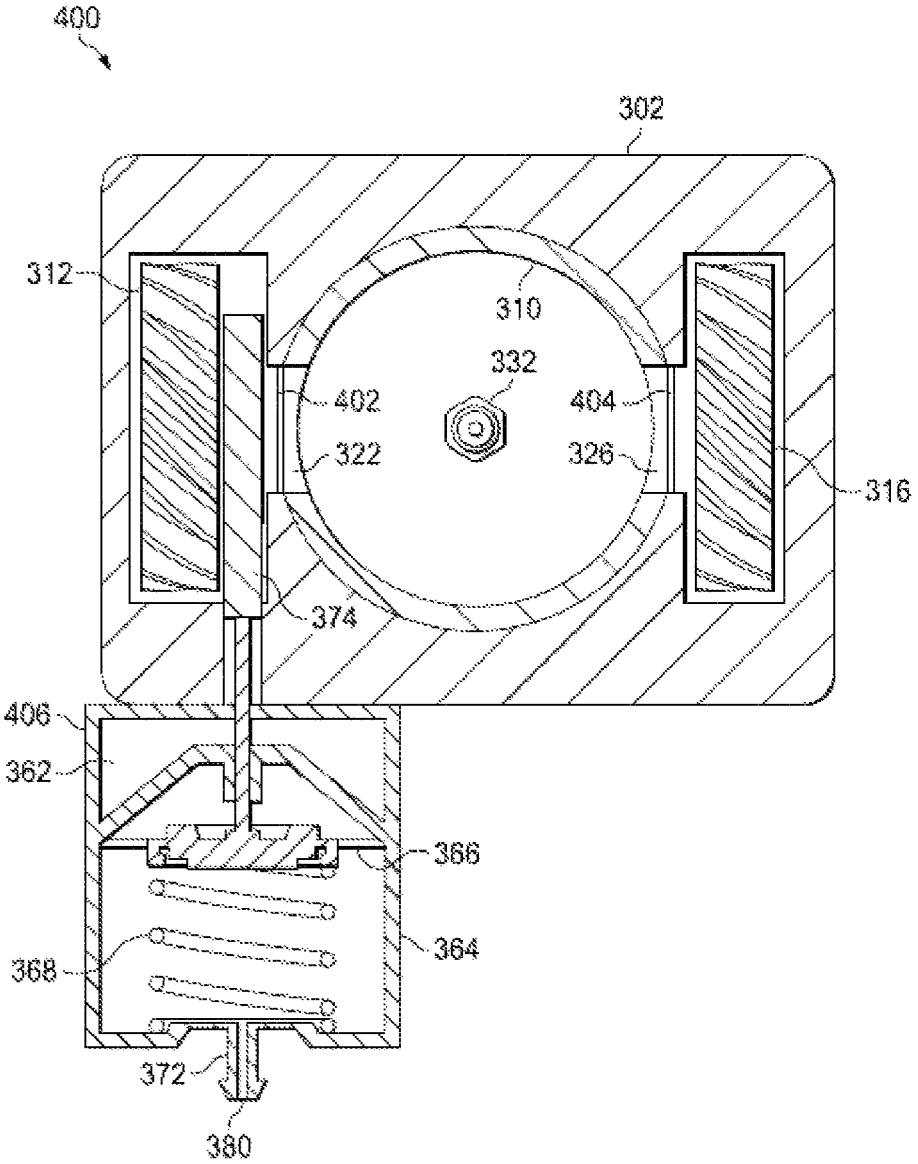
FIG. 10 illustrates a top-down view of a cross section of an engine cylinder according to the embodiment of FIG. 2 that includes the multi-stage throttle valve system depicted in FIG. 8 in an open-throttle state.

FIG. 10 illustrates a top-down view of a cross section of an engine cylinder according to the embodiment of FIG. 2 that includes an MS intake valve depicted in FIG. 8D in a wide-open throttle state. As in FIG. 9, the representation of an engine block 302 includes the engine cylinder 310 and its associated fixed intake 322 and fixed exhaust 326 ports formed in the walls of the engine cylinder 310. The rotating valve gear 312 is shown adjacent the engine cylinder 310. Similarly, a rotating valve gear 316 is shown adjacent the exhaust valve port 326. Also shown in FIG. 9 are edge-wise views of the location of first (intake) 402 and second (exhaust) 404 seals disposed between the adjacent wall of the engine cylinder 310 and the rotating valve gears 312, 316. The seal structure is described briefly in FIG. 7. Disposed next to the engine block 302 is one embodiment of a vacuum diaphragm assembly 362 supported by a bracket 406.

FIG. 11 illustrates a simplified isometric view of a lower portion of the cylinder head assembly formed of a cylinder head 436 and a cylinder head cover 438 of the embodiment of FIG. 4 depicting first 434 and second 444 cylindrical extensions, respectively of rotating valve gears 454 and 464 shown in phantom in FIG. 11. See also FIG. 12). The cylinder head cover 438 is shown in phantom. The illustrated rotating cylindrical extension 434 includes a port aperture 442 formed through the wall of the cylindrical extension 434; similarly, cylindrical extension 444 includes a port aperture 446 formed through the wall of the cylindrical extension 444. Each cylindrical extension 434, 444 rotates on a respective bearing surface 428, 448 that are formed in the cylinder head 436. A spark plug 432 or other energetic component such as a laser igniter may be fitted into a threaded hole in the cylinder head 436. Similarly, a fuel injector 433 may be provided for direct injection of fuel into the combustion chamber as discussed in FIGS. 2 and 4.

The fixed inlet and fixed outlet passages (not shown) for the inlet air/fuel mixture and the exhaust waste gas outlet may be disposed through one side (or either end, in the elongated valve cylinders) of the respective valve cylinder to contact with the respective valve port inside the valve cylinder. The valve timing may be set by the number of teeth on the gears, with the valve cylinders rotating at one-half the crankshaft speed. The valve cylinders may be supported in cylindrical bearing surfaces whose diameter is slightly greater than the diameter of the valve cylinders. The valve cylinders may be lubricated by a connection (not shown) with the pressurized lubrication system of the engine in a manner similar to the lubrication of the crankshaft journal bearings that support the crankshaft in the crankcase. The axial length of the valve cylinders may be varied depending on the size of the valve port opening and the space available in the engine block. However, to minimize friction, the axial length may generally be less than shown in FIG. 4 or 5.

FIG. 12 illustrates a timing gear set 450 for use with the embodiment of FIG. 11. The intake rotating valve or drive gear 454 is attached to the cylindrical extension 434 along an axis common to the rotating valve gear 454 and the cylindrical extension 434. Similarly, the exhaust rotating valve or drive gear 464 is attached to the cylindrical extension 444 along an axis common to the rotating valve gear 464 and the cylindrical extension 444. The rotating drive gears 454, 464 may be disposed to mesh with an intermediate or idler gear 456, which is in turn disposed to mesh with a crankshaft gear 458. In the illustrated example, the driven rotating valve gears 454, 464 have the same number of teeth around the perimeter to preserve the 1:1 timing relationship relative to the intermediate or idler gear 456, which also has twice the number of teeth around its perimeter as the crankshaft drive gear 458, so that the 2:1 timing relationship of crankshaft rotation and rotating valve port are maintained.

FIGS. 13A through 13J illustrate cross section drawings that correspond by reference number to each of the members of the family of embodiments depicted in FIG. 1. As in the series of isometric views of FIGS. 1A through 1J, RVP 1 is identified by reference number 10; RVP 2 by reference number 40; etc. through RVP 10 identified by reference number 280.

Figure 14B:
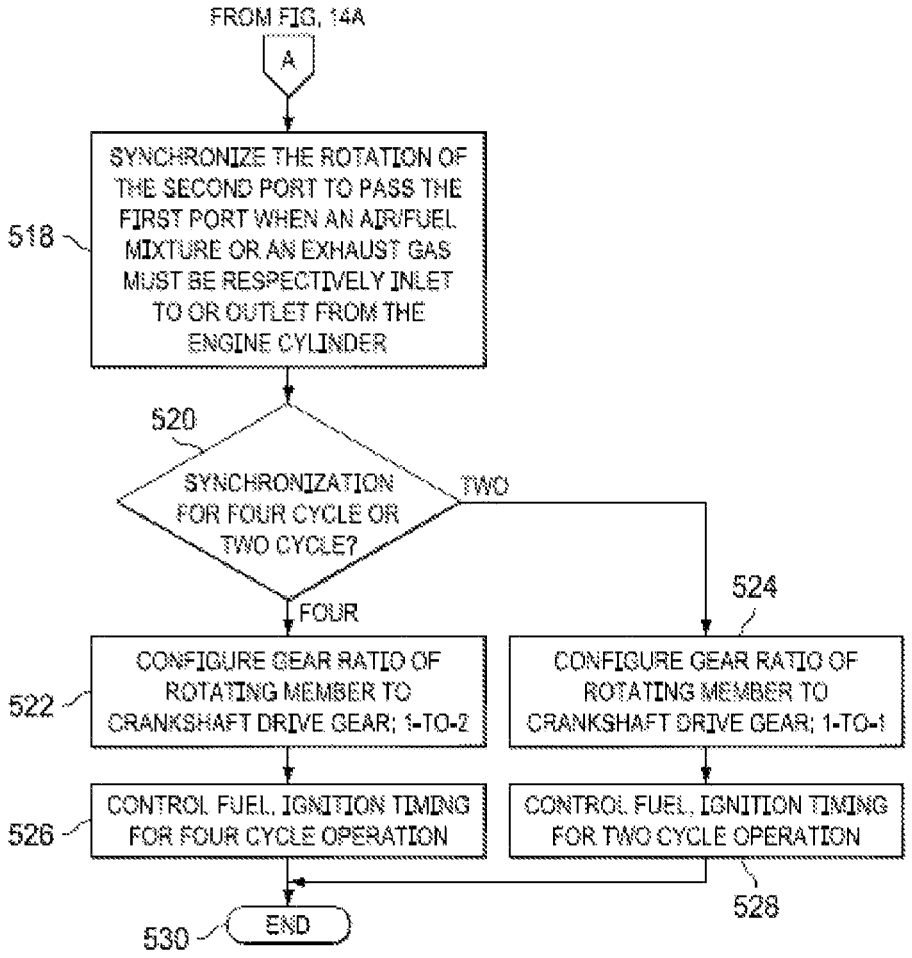
Figure 15:
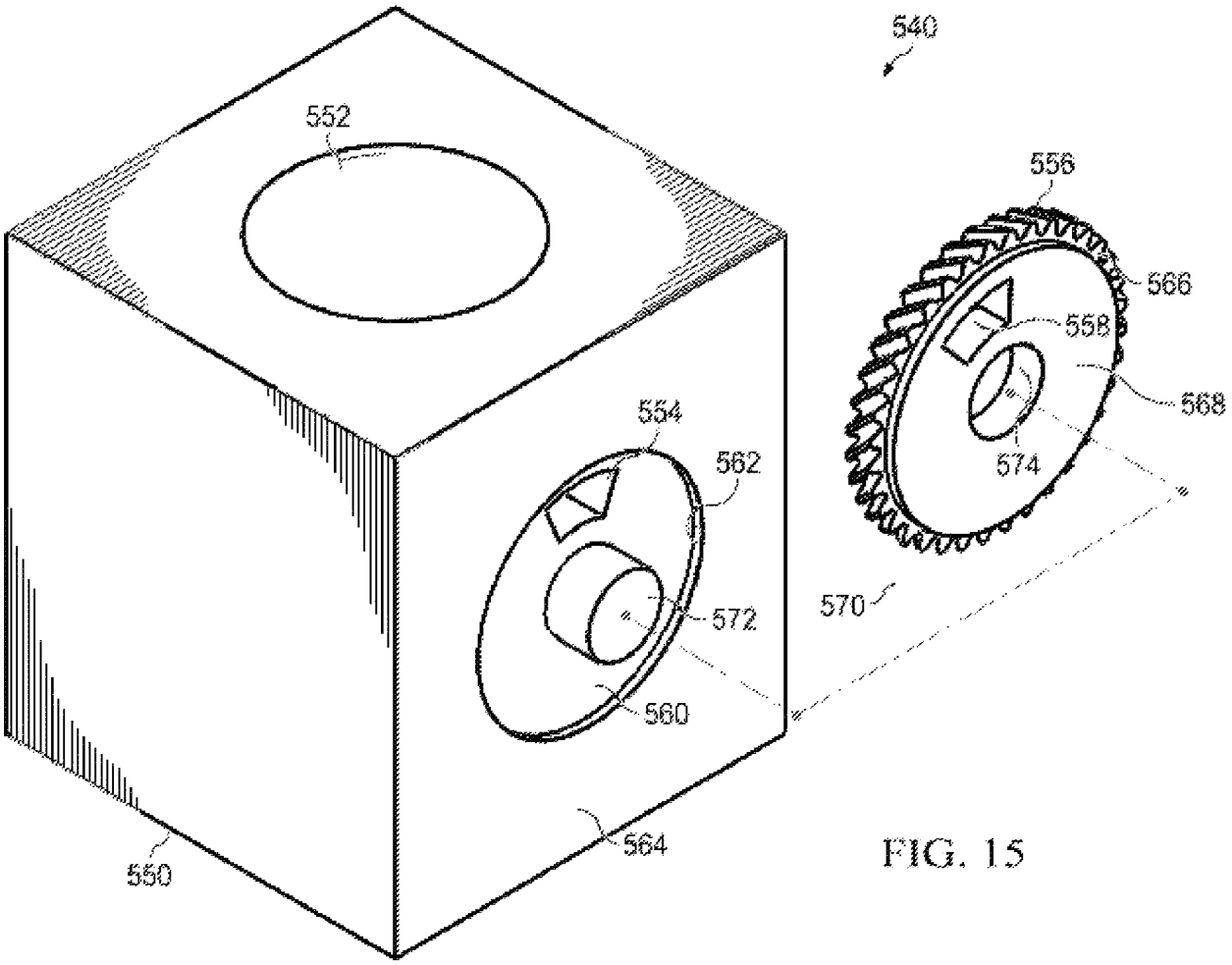
FIG. 15 illustrates an alternate structure for sealing the intake and exhaust ports according to the present invention.

FIGS. 14A and 14B illustrate a method for timing the operation of intake and exhaust valves of an internal combustion engine according to the present invention. This embodiment is directed to one of the three kinds of timing functions that must be satisfied in an internal combustion engine and depicted in the flow chart of FIGS. 14A and 14B. In an internal combustion engine having a crankshaft rotatably mounted in a crankcase portion of an engine block, an engine cylinder formed within the engine block and open at a lower end thereof into the crankcase, and a combustion chamber formed in an upper end of the engine cylinder, the method may comprise the steps of forming a first fixed valve port in a side wall of the engine cylinder proximate the combustion chamber; forming a valve port mechanism having a second valve port in a rotating member disposed against the side wall of the engine cylinder; and causing the rotating member to rotate in synchronism with the crankshaft such that the second rotating valve port periodically aligns with the first fixed valve port to permit passage of intake or exhaust substances. In another aspect, the method may include the steps of forming first and second valve port mechanisms for the intake and exhaust substances, and disposing the respective first and second valve port mechanisms or combinations on respective fixed first and rotating second opposite sides of the engine cylinder to permit passage of both intake and exhaust substances. A further step may include coupling inlet and outlet passages of a manifold with the respective fixed first and rotating second port valve port mechanisms, respectively for conveying inlet air and outlet exhaust substances.

Accordingly, in one embodiment, the method 500 illustrated in FIGS. 14A and 14B proceeds from the Start 502 point in FIG. 14A as follows, to configure for each cylinder of an internal combustion engine having a crankcase supported in an engine block having an engine cylinder formed therein and open at a lower end thereof into a crankcase, and a combustion chamber formed in an upper end of the cylinder as noted in step 504. The flow advances to step 506 to locate a first port near an upper end of the engine cylinder near the combustion chamber, followed by step 508 to form the first fixed port through the side wall of the engine cylinder, shaped to correspond to alignment with a second port in motion past the first port. In step 510, the process locates the second port along a radial portion of a rotating disc configured as a ring gear, the second port shaped to correspond to the first fixed port as the second rotating port passes the first fixed port. The process continues in step 512 wherein the rotating member containing the second port is supported on a bearing disposed adjacent the side wall of the engine cylinder such that the fixed first and rotating second ports automatically align periodically.

Continuing with FIG. 14A, in step 514, one fixed first and rotating second port combination is designated for an engine intake port and another fixed first and rotating second port combination is designated as an engine exhaust port. Thus, the rotating valve port concept may be employed for both an engine intake port and an engine exhaust port. In the following step 516 there may be provided a first manifold passage for an air/fuel mixture coupled to the engine intake port and a second manifold passage provided for an exhaust gas coupled from the engine exhaust port. Proceeding to FIG. 14B, Step 518 of the process functions to synchronize the rotation of the second port to pass the fixed first port when an air/fuel mixture or an exhaust gas must be respectively inlet to or outlet from the engine cylinder. A related part of step 518 includes adapting in step 520 the synchronization for a four cycle engine or a two cycle engine. If the synchronization is for a four cycle engine the process advances to step 522 to configure the gear ratio of the rotating member to the crankshaft at a 1 to 2 ratio, followed by step 526 to control the fuel and ignition timing for four cycle operation of the engine. Similarly, if the synchronization is for a two cycle engine the process advances to step 524 to configure the gear ratio of the rotating member to the crankshaft at a 1 to 1 ratio, followed by step 528 to control the fuel and ignition timing for four cycle operation of the engine. Thereafter, the process ends at step 530.

FIG. 15 depicts one embodiment of a sealing structure 540 that confines leakage gases to the immediate region around the joint in the port passages between the rotating and fixed portions of the port structure. The engine block 550 includes an engine cylinder 552 and a second fixed port 554 formed in an inset region 560 of the face 564 of the engine block 550. The face 564 in this example is coincident with and may also be called the outer wall of the engine cylinder 552. The inset region 560 may be defined by a low elevation ridge 562 formed between an axle 572 and a position just beyond the location of the fixed second valve port 554. The low elevation ridge may have an elevation for example between approximately 0.010" and 0.060" above the surface of the inset region 560.

Alternatively, the face 566 of the rotating valve disc 556 may include a low-elevation raised region 568 formed to the same 0.010" to 0.060" dimension between the hub 574 and a ridge 570 formed at a radius just short of the inner-most radial dimensions of the first valve port in the rotating valve disc 556.

When assembled, any leakage is contained within the space between the inset region 560 of the face 564 of the engine block 550 and the inner face 566 of the rotating valve disc 556 and bounded by the outer 560 and inner 570 edges of the inset region 560. This example may be identified as the combination of the ridge 562 around the (fixed) second port and the ridge 570 around the hub 574 of the rotating first valve port 558.

The embodiment illustrated in FIG. 15 is one example that reduces the required machining to a minimum by including it as part of the manufacture of the engine cylinder block 550 and the rotating valve disc 556. Thus, in one variation of the structure depicted in FIG. 15, the inset region may be formed in the outer face 564 of the wall of the engine cylinder block 550 and the inner face 566 of the rotating valve disc 556, such that the sealing apparatus comprises a circular ridge 570 formed on an inner face of the rotating valve disc 556 between a central hub 574 and the first port 558; and a circular inset region 560 disposed in an outer face 564 of the wall of the engine cylinder block 550 between the axle 572 and extending to the ridge 562 disposed at a radius just beyond the fixed second port 554.

In one variation of the structure depicted in FIG. 15, the inset region may be formed in the inner face 566 of the rotating valve disc 556 and the ridge or elevated feature formed in the outer face 564 of the wall of the engine cylinder block 550. Thus, the sealing apparatus may comprise a circular inset region disposed in an inner face of the rotating valve disc between the central hub 574 and extending to a radius just beyond the rotating first port 558; and a circular ridge formed on an outer face 564 of the wall of the engine cylinder block 550 between the axle 572 and the fixed second port 554.

The disclosed invention described herein eliminates the conventional camshaft and reciprocating valve train to control the timing of the intake and exhaust cycles of an internal combustion engine ("ICE") such as the well-known two or four cycle, spark ignition engines. The system includes intake and exhaust port valves for admitting the air/fuel mixture into the cylinder and exhausting the burned gases of combustion from the cylinder. It is important to note that the valve structure of the present invention ensures free and direct flow through both the intake and exhaust valves when the valves are fully open, without obstruction to such flow by the open valve as in conventional poppet valve trains. The valve ports are located adjacent the engine cylinder and the timing of the valve operation is operated directly from the crankshaft, without any intervening valve train mechanism, thereby reducing the number of moving parts to a minimum. A camshaft is not needed, nor are lifters, pushrods, valve springs, valves with keepers and retaining washers, and features provided for adjusting valve clearances, nor any of the supporting structure required to support the components of a valve train, etc. Valve timing upon assembly is as simple as lining up two marks on the valve gear drive.

In its simplest form, the invention comprises a method for controlling valve timing in an internal combustion engine, comprising the step of providing separately, for each intake and exhaust system, a rotating valve port disc adjacent a fixed valve port formed in a side of an engine combustion cylinder, wherein the rotating valve port disc rotates in synchronism with a crankshaft in the engine to periodically align a port in the rotating valve port disc with the fixed valve port, and wherein the port in the rotating valve port disc is coupled through a conduit to the atmosphere.

While the foregoing invention has been shown and described in a few of its forms, it is not thus limited but is susceptible to various changes and modifications without departing from the spirit thereof. For example, the rotating member containing the valve port (intake or exhaust) has been described in several examples as a valve gear even though other embodiments may employ a rotating disc or cylinder that is configured with a different means of coupling it to the crankshaft rotation to preserve the necessary timing relationship between the crankshaft and the opening and closing of the valves. Moreover, the basic concepts of the invention may be extended and enhanced by the addition of a variety of structural embodiments that may be coupled to the rotating intake and exhaust valve ports of the engine. Some illustrative but not limiting embodiments are described as follows.

Alternate Intake and Exhaust Embodiments

In the following detailed description, beginning with FIG. 16, several alternate embodiments of the rotating valve port concept for providing utilization and timing of the intake and exhaust valve structures described herein for an internal combustion engine are described. The embodiments concern the structure and operation of several types of an intake or exhaust device added to the rotating valve port structure already described and disposed at the intake to or the exhaust from the engine. These added embodiments include mechanisms for increasing the flow of intake air or exhaust gases to improve the volumetric efficiency of the engine, thereby overcoming restrictions to flow, such as fluid-friction or boundary layer losses, or obstructions within the intake passages and surfaces, that cause a drop in pressure at the intake valve. Some embodiments may include structures for increasing the pressure of air into the intake valve; others may include tuning the intake or exhaust systems to meet specific performance or efficiency goals by exploiting the acoustic resonances within the intake or exhaust passages to time the pressure waves with the valve timing. These mechanisms may be used alone or in combination. Many variations are possible. In some embodiments to be described the added structure includes features for circulating engine coolant such as, without limitation, water or anti-freeze mixtures to the engine. Thus, the several alternate embodiments provide choices for an engine designer to select an intake or exhaust device that is best suited to a particular application of the rotating valve port concept.

The structures to be described involve components or assemblies that rotate relative to fixed or stationary structures such as an engine block and any apparatus external to the engine and its rotating assemblies. These rotating assemblies include a rotating valve disc (RVD) or rotating valve cylinder (RVC) that may include various intake or exhaust devices that are attached to the rotating valve disc or rotating valve cylinder. The fixed or stationary apparatus includes the engine block and may include engine coolant systems coupled to a containment housing that encloses an RVD or RVC assembly within it. The containment housing may surround the intake and exhaust devices and the respective RVD to which they are attached. The stationary apparatus may also include a duct leading into the RVD or RVC assembly in the path of intake air used by combustion in the engine, or a duct leading out of an RVD or RVC assembly in the path of exhaust gas that is produced by the engine. Thus the applications utilizing the invention as described herein may include interface components between the fixed and rotating structures. These interfaces will in general be devices that seal the passages of engine coolant, inlet air, or exhaust gas through the interface. The interface must typically provide an air-tight or liquid-tight seal between a rotating surface and a fixed surface.

An important distinction between the RVD and RVC series of embodiments is the following: In the RVD embodiments, the valve ports of FIG. 1A lead into the engine cylinder through the side walls of the engine cylinder. Similarly, the valve ports of FIGS. 1D, 1E, 1H, and 1J lead into the engine cylinder through the side wall of the engine cylinder. In the RVC embodiments, the valve ports of FIGS. 1B, 1F, and 1G lead into the engine cylinder through the cylinder head of the engine cylinder. Accordingly, the RVD assemblies may be disposed alongside and above the engine cylinder and the RVC assemblies may be disposed above or alongside the engine cylinder. A review of the simplified illustrations of FIGS. 1A-1J and 13A-13J will provide an overview of the distinctions between the RVD and RVC series of the family of embodiments disclosed herein.

The motivation for devising the variety of intake and exhaust devices described herein arises from the well-known fact that the conventional valve structure for reciprocating internal combustion engines has an inherent disadvantage. This disadvantage is due to the location of the poppet-style intake and exhaust valves within the respective intake and exhaust passages into the engine cylinder during the time the valve is open. During that time the open valves restrict the flow of air or air/fuel mixture into the engine cylinder or the flow of exhaust gases from the engine cylinder during the respective portions of the engine operating cycle. For example, this phenomenon occurs in the ubiquitous overhead valve and overhead cam engines, and even valve-in-block ("flathead") engines, all of which obstruct or restrict the flow of gas into or out of the ports. Accordingly, a way was sought to not only eliminate this blockage and limitation of flow through the valve, but also to combine the solution with any of several intake or exhaust enhancements that would utilize the rotating valve port concept to maximum advantage.

Figure 17:
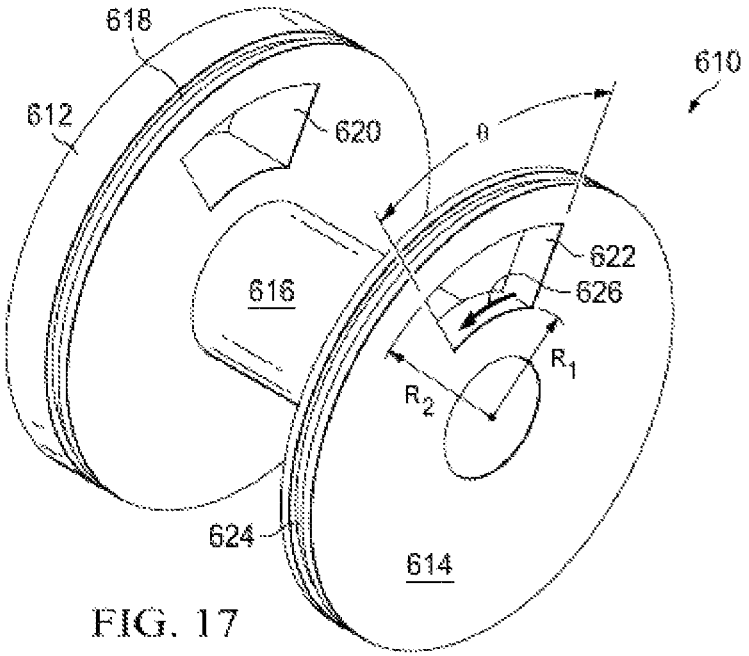
FIG. 17 illustrates a frame configured as a spool for supporting alternative embodiments of an intake or exhaust device structure.

As previously described, a rotating valve port—configured as a disc surrounded by a ring gear around the perimeter of the disc for providing rotary motion to the disc—includes a port opening through the disc. The port opening is formed along a radial of the disc between the central hub of the disc and the ring gear around its perimeter. The port opening may generally be fan-shaped as in a radial sector of the disc, which may extend through an angular width from a few degrees to at least 45 degrees or more, depending on the application and the requisite intake or exhaust valve timing. For example, each first and second valve port formed respectively in the intake and exhaust sides of the engine cylinder may be formed as an opening in a radial sector of the rotating disc bounded by a timing duration angle 626=$\theta_I$ or $\theta_E$, respectively for intake and exhaust, and first $R_1$ and second $R_2$ radii, where $R_1<R_2$ and the radii $R_1$ and $R_2$ are each less than the radius of the respective RVD-1 or RVD-2, as shown in FIG. 17. As noted previously, the port opening in the rotating valve disc may match the size and shape of the first and second valve port opening in the sides of the engine cylinder. However, in some applications it may be an advantage to vary the shape of one or both port openings to achieve certain valve timing, performance, or manufacturing objectives.

In some embodiments, a rotating valve port may also be called a rotating valve disc or RVD. If the RVD is on the intake side of the engine cylinder it may be called an RVD-1 (or, alternatively, RVD-I). If the RVD is on the Exhaust side of the engine cylinder, it may be called an RVD-2 (or, alternately, RVD-E). Further, in some embodiments to be described, an inner RVD (adjacent the engine cylinder) and an outer RVD (disposed away from the engine cylinder as will be described) may be coupled together by an axle housing or hub disposed between them to form a spool configuration. The spool configuration may be used on either the intake side or the exhaust side. The axle housing or hub may enclose an axle and bearing assembly that may, for example, be supported by the engine block structure.

In other embodiments based on the spool configuration the port openings in the inner and outer RVDs may also be connected through a tubular member such as a straight channel or a helical channel. Further, the spool may be enclosed in a containment housing, thereby enclosing the space within the spool for circulating engine coolant. In embodiments wherein the interior of the spool forms part of a liquid cooling system that also includes water jackets in the engine block, sealing components may be required to ensure leak-proof connections. In the accompanying drawings, the coolant passages and the water jackets and the connections between them and other external passages and spaces are not shown to improve the clarity of the drawings illustrating the rotating valve port concepts.

In some embodiments the port opening in the outer RVD may be respectively coupled from an intake manifold or to an exhaust manifold. The intake or exhaust manifold may be an acoustically-tuned pipe structure or simply a tubular passage connected from an air cleaner or to a catalytic convertor respectively. In other embodiments a more complex intake device or exhaust device may be combined with or coupled to the respective RVD-1 or RVD-2.

Expanding this brief description above, various combinations of the RVD-I and RVD-E (collectively, the RVDs), the spool structure, and the tubular channels may be assembled. In each of these alternate embodiments the assembly may be attached to the inner RVD-I or RVD-E; thus the assembly rotates with the inner RVDs as a unit. Recall also that the inner RVDs—those next to the engine block—are preferably driven by and synchronized to the crankshaft rotation to provide the correct timing of the opening and closing of the valves. While parameters such as valve timing angles—the rotational periods of the rotating valve ports in which the valves are opened and closed—are defined in FIG. 17, the structure of the rotating valve disc lends itself to wide variation in the timing parameters. The rotating valve disc concept also permits the direct control of these parameters without complex mechanical assemblies, an important advantage of the present invention. For example, simply varying the radial angle and the radii of the port openings through interchangeable rotating valve discs, a simple and easy way is provided to adjust the valve timing. Persons skilled in the art will recognize various ways to take advantage of the versatility provided by the intake and exhaust devices to be described herein.

The foregoing overview describes some of a series of possible rotating valve port configurations for use with the basic rotating valve disc concept. In a second series of possible rotating port configurations, the rotating valve disc may include a cylindrical extension, rather than a disc, that gives rise to different structural combinations of the same operating concept of a rotating port to control the valve timing of an internal combustion engine. For example, in the preceding descriptions for the rotating valve port (RVP) concept, the embodiments depicted in FIGS. 1B, 1D, 1E, 1F, 1G, 1H and 1J, FIGS. 3-5, 11, 12, 13B, 13D, 13E, 13F, 13G, 13H and 13J all illustrate various ways to deploy a rotating valve disc that includes a cylindrical extension structure, i.e. the rotating valve cylinder (RVC) concept, in an internal combustion engine. The rotating valve cylinder embodiments that include additional intake devices and exhaust devices coupled to or attached to the rotating valve cylinder may be referred to as an RVC or rotating valve cylinder embodiment. The embodiments illustrated in FIGS. 1F and 4 will be described and illustrated subsequently for FIGS. 31-34 as representative examples of the RVC concept.

Returning to the basic RVD series, it is also possible to combine features of a centrifugal compressor with the rotating valve port concept. For example, the addition of compressor elements may add utility to the intake side of the engine to be described. There are two examples to be described, one configured as a version A and an alternate embodiment as a version B. These versions differ depending on the configuration of the compressor relative to the rotary valve port disposed next to the engine cylinder. The redirect of the air goes through the impeller wheel on the version A style, while the redirect of the air goes around the perimeter of the impeller wheel on the version B style due to the configuration of the compressor relative to the rotary valve port.

Briefly, a centrifugal compressor is formed by a rotating assembly of blades disposed on a hub and fanning radially outward. The blades style may, however not limited to, be as a spiral impeller, a backwards curved impeller, even with a compound curvature to achieve a desired flow and diffusion of air. The assembly of blades may be formed on a conical hub. The impeller generally rotates within a compressor/impeller housing. Air may be drawn into the impeller along its axis, wherein the air is captured by the spinning blades. The spinning blades direct the air outward from the hub to increase the velocity of the air within the compressor. The housing that contains the impeller, called a centrifugal compressor housing (or, simply, compressor housing or impeller housing) may be formed to include a surrounding circumferential chamber called a volute. Air is drawn into the center of a rotating impeller with radial blades and is pushed toward the center by centrifugal force. This radial movement of air results in a pressure rise at the diffuser and the resultant kinetic energy accumulates in the volute, before discharging it into the intake apparatus of the engine, once the rotary valve port (RVP) aligns with the fixed valve port resident on the side of the engine block. The volute receives the low velocity, high pressure air from the outer blade tips of the impeller, which is after the diffuser area of the impeller blades converts the higher velocity air to a higher pressure at a lower velocity before discharging it into the volute and then, once the port mechanisms are aligned, discharging it into the next structure in the intake apparatus of the engine.

If the impeller is driven independently of the RVD, for example at a higher RPM (revolutions per minute) with the incorporation of a transmission, (i.e. a planetary gear set, for example), then the compressor can provide a pressure increase well above the atmospheric pressure as in a supercharger. There also is the advent of using multiple impellers driven in the same manner as one singular impeller and so configured that it generates more air pressure. Also, increasing the size of the impeller/volute assembly will deliver greater volumes of inlet air pressures into the combustion chamber. The resultant pressure increase in the compressor may be minutely comparable to the supercharger, or perhaps a pre-supercharger, along with the fuel to cause a more efficient combustion of the said air and/or fuel mixture. However, in the present concept a compressor impeller structure is utilized to augment the pressure of the air admitted to the engine cylinder, thereby compensating for flow restriction or pressure losses in the air intake passages of the engine. In this application, the impeller is attached to the RVD and driven at the same RPM as the RVD because the RVD rotation must be synchronized with the crankshaft to maintain the correct valve timing.

In some embodiments the compressor housing enclosing the impeller may take on several forms. The volute may be a tubular passage around the circumference of the impeller housing that has a gradually expanding cross section wherein the discharge outlet exits from a cross section slightly larger than the initial portion of the volute surrounding the impeller. In other forms illustrated herein, the volute may be a cylindrical tube having a constant cross section that surrounds the compressor housing, which encloses the impeller. In some embodiments, the volute is formed as a cylindrical extension of the compressor housing, surrounding the perimeter of the housing and including an open slot around its inner circumference that opens into the interior of the compressor housing. The open slot, like the discharge outlet, permits release of the diffuse air flow and directs it toward the intake valve port in the RVD when the rotating valve port and the fixed valve port are aligned during the intake timing cycle.

The containment housing is configured to surround the RVD and enclose a straight or helical air passage or channel to conduct inlet air to the port in the associated RVD Similarly, a containment housing may be used to enclose a straight or helical passage or channel to conduct exhaust gases away from the exhaust port in the associated RVD. The containment housing may also include passage space outside of the straight or helical channel for use as part of an engine coolant system to maintain the intake and exhaust system at a prescribed temperature. In some embodiments the containment housing may be attached to the engine block so that the RVD rotates within the containment housing and the impeller rotates within an impeller or compressor housing. The volute may be disposed adjacent to the inner RVD or it may be spaced away from the inner RVD, depending upon the style and shape of the impeller blades at their outer edges or other factors that affect the flow of air. In either case the diffused and decreased velocity air from the impeller is gathered into the volute space and thus generates a higher pressure air to be discharged through the port opening in the inner RVD once the rotary valve port lines up with the fixed port. In some of the embodiments to be described, the impeller assembly may be attached to the inner RVD; the assembly thus rotates at the same RPM.

DETAILED DESCRIPTIONS OF THE DRAWINGS

The drawings to be described herein are not to exact scale but show the relative proportions of the depicted components with fair accuracy to illustrate the structural features embodied in the invention. In many cases, the relative proportions and dimensions are scalable to suit particular embodiments. Variations in dimension, shapes or profiles, and proportions will of necessity occur in various implementations.

Figure 16:
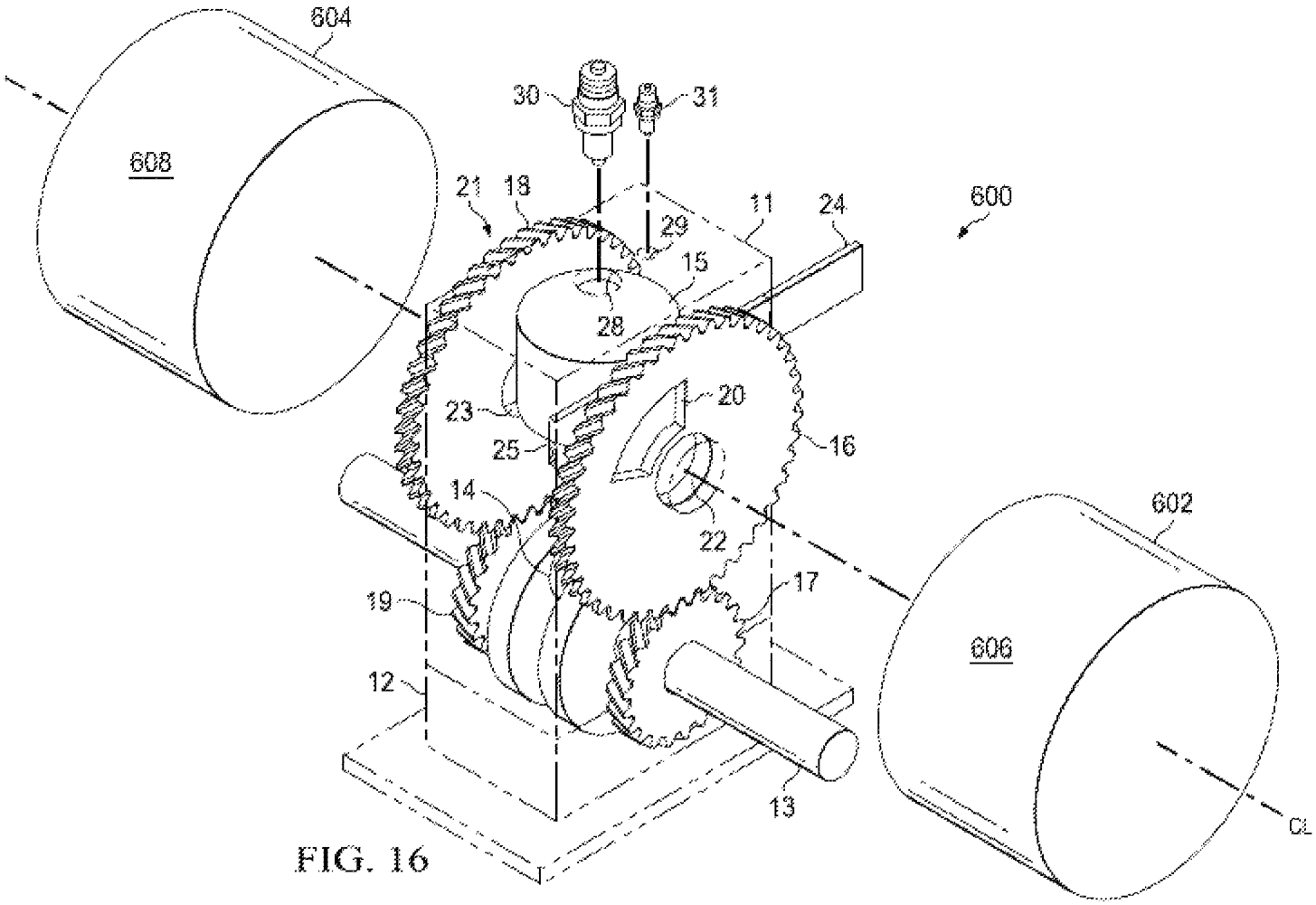
FIG. 16 illustrates a basic rotating valve port (RVP) engine structure to depict the relationship of added intake and exhaust device structures according to various embodiments of the basic RVP engine.
Figure 30:
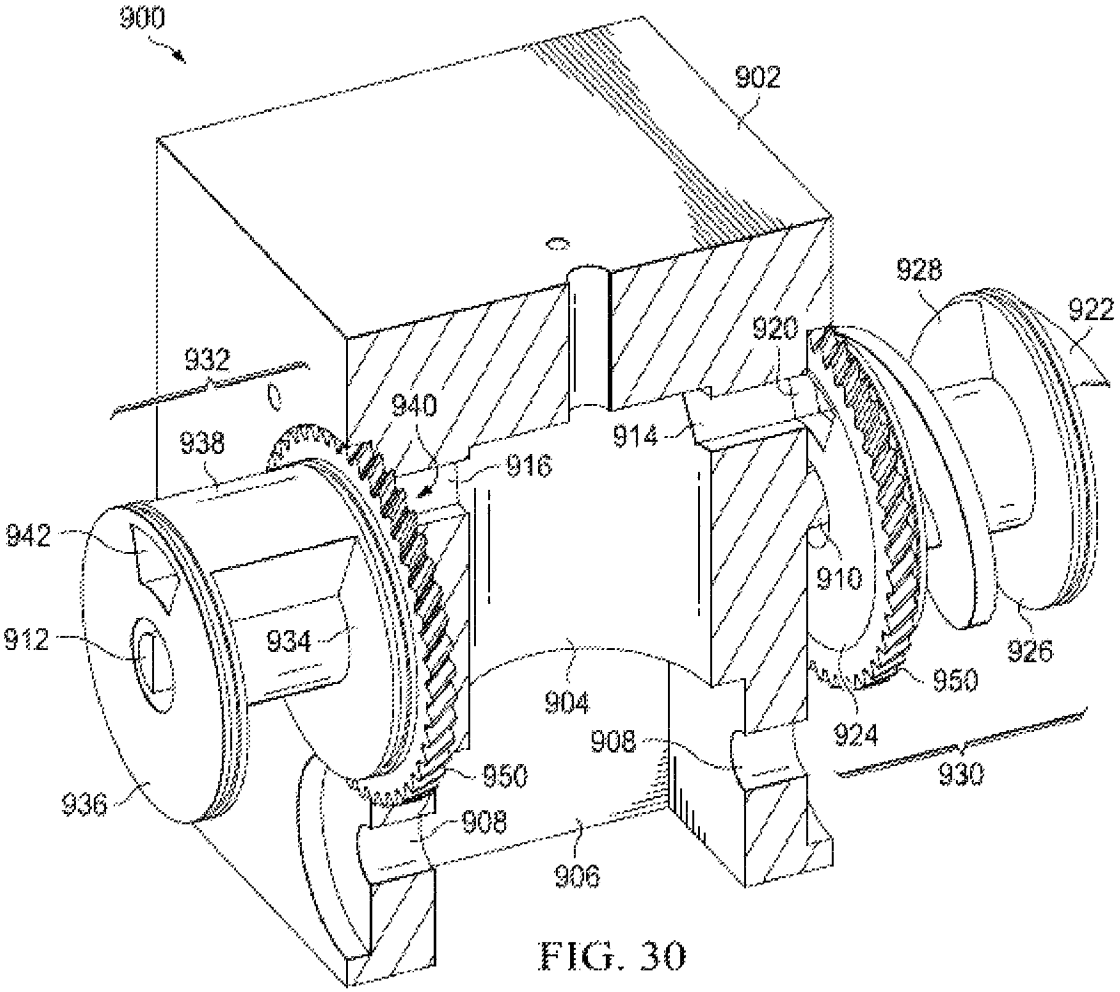
FIG. 30 illustrates a composite perspective diagram of an engine block have attached intake and exhaust devices respectively configured according to FIGS. 19 (tubular helical channel for the intake side) and 18 (tubular straight channel for the exhaust side)

FIG. 16, which is adapted from FIG. 2 herein, illustrates a basic rotating valve port (RVP) engine 600 structure to depict the relationship to the engine of an added intake device 602 and an added exhaust device 604 structures according to various alternative embodiments of the basic RVP engine to be described herein. Reference to FIG. 30 to be described illustrates a cut-away view of an engine cylinder 904 in an engine block 902 along with valve ports 914 and 916 (respectively intake and exhaust) into and out of the engine cylinder 904.

The details of the intake 602 and exhaust 604 devices of FIG. 16 are described with reference to certain of the following figures. In these descriptions, the RVP—a rotating disc that usually includes a fan-shaped valve port opening formed as a radial sector—will be identified by the term RVD, for "rotating valve disc" and may alternately be called an "RVD." Some embodiments may include an inner RVD or outer RVD; others an RVD-1 or RVD-I for an intake RVD and an RVD-2 or RVD-E for an exhaust RVD. When an intake device or an exhaust device is configured as a spool as in FIG. 17, having inner and outer rotating valve discs, the inner and outer discs will be termed respectively inner RVD 612 and outer RVD 614.

The intake device 602 and the exhaust device 604 to be described are shown in FIG. 16 by the outlines 606 and 608, aligned along a centerline common to the RVD axis of rotation. These intake and exhaust devices, which are generally attached to the inner RVD and thus rotate with it, may include the rotating valve disc(s) and a frame configured as a spool for supporting additional intake or exhaust features to be described. Some embodiments may be enclosed by a containment housing attached to the engine block. In some embodiments a containment housing may provide a cooling fluid basin surrounding the straight and helical channels that pass between an inner RVD and an outer RVD in a spool configuration.

The basic purpose of the spool embodiments combined with a containment housing is to provide an enclosed space that enable the intake or exhaust passages to pass through a surrounding basin of engine coolant. Engine coolant flowing through the containment housing is thus available to maintain the temperature of the intake air or exhaust gases and the engine block. The engine coolant may circulate through sealed inlet and outlet connections (not shown) between the containment housing and the engine cooling system. The straight and helical air flow channels themselves (shown in FIGS. 18, 19, and 26-30) may provide a moderate auxiliary pumping action as they rotate to aid in circulating the cooling fluid. The straight channel may be disposed between the inner and outer RVDs, like a blade in a squirrel-cage type of fan; the helical channel may function similarly to a screw-type pump. The straight and helical air flow channels may form part of the length of the inlet or exhaust passages, as part of an engine tuning technique that takes advantage of the acoustical resonance of the intake or exhaust passages.

In other embodiments to be described that are contemplated within the rotating valve port concept of the present invention, a centrifugal compressor structure may be provided as part of the intake device. See, for example, FIGS. 20 through 30. In its' basic form a centrifugal compressor includes an inlet, an impeller/diffuser, and a compressor housing, usually in combination with a volute. The inlet may be coupled through some sort of conduit from the atmosphere. The impeller/diffuser is a set of blades attached to an axle or hub. The blades of the impeller may be a spiral impeller, flat or curved, or formed with a compound curvature, or oriented forward or backward relative to the rotation of the impeller, and preferably separated at uniform radial angles around the hub to achieve a desired flow and diffusion of air. The blades may further be formed with a compound curvature. The space between each pair of blades typically increases toward the perimeter of the impeller, thus creating a diffuser area. This arrangement of the blades enables the increase in velocity of the air flow as it passes into the rotating impeller and the decrease in velocity of the air flow as it passes through the outer area/diffuser portion of the impeller blades.

Figure 35A:
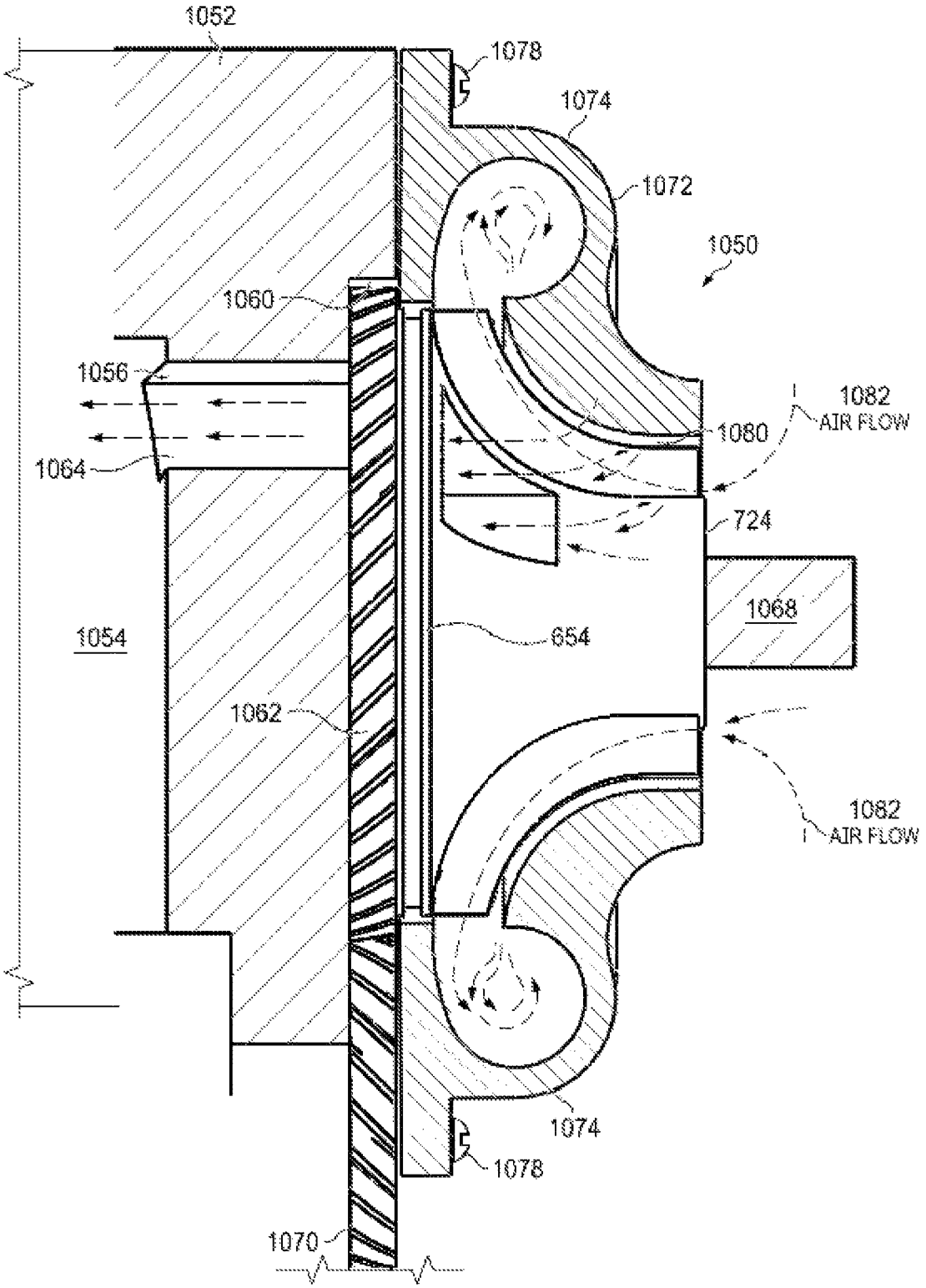
FIG. 35A illustrates a simplified cross section diagram of a compressor structure of several embodiments of the present invention depicting air flow when port openings are aligned.
Figure 35B:
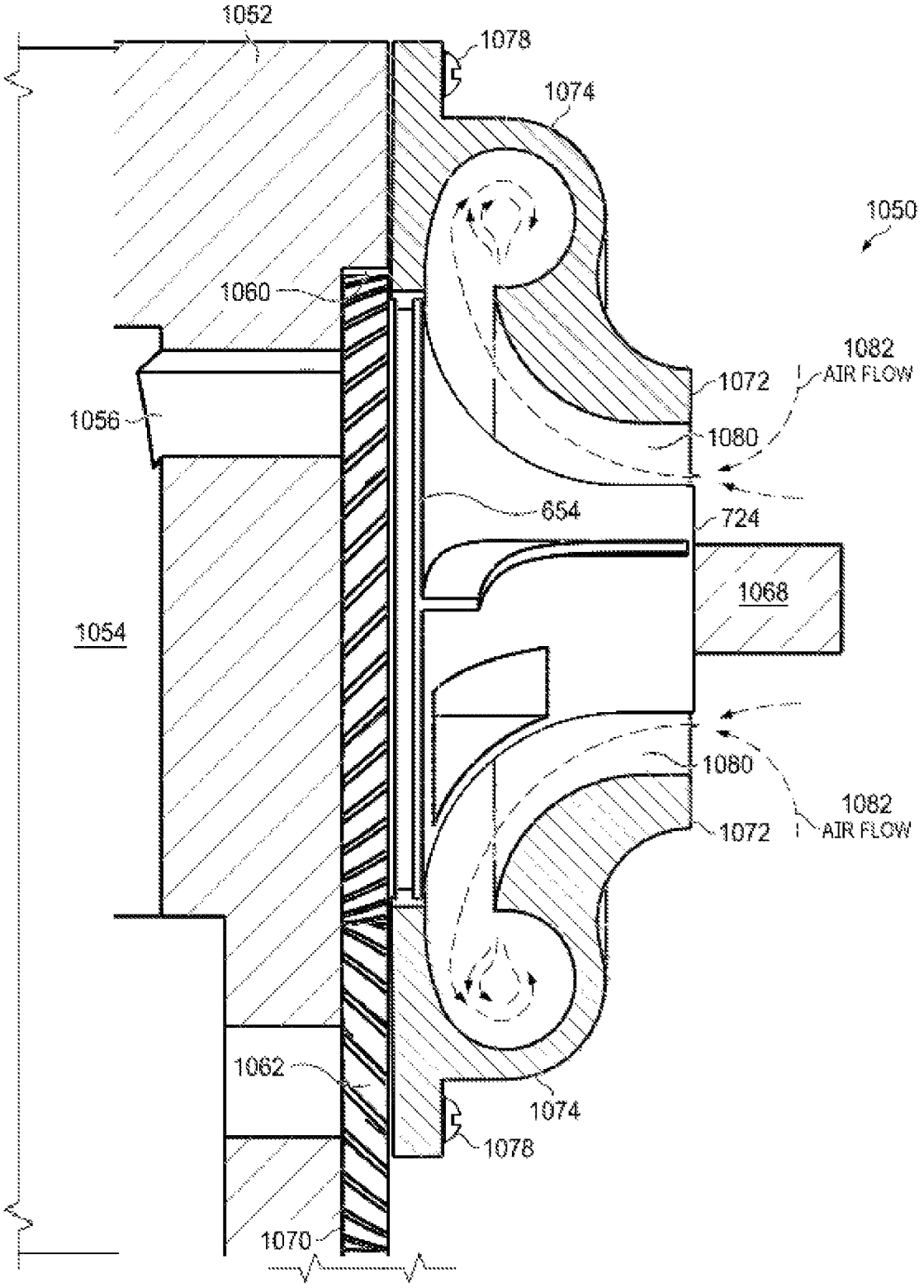
FIG. 35B illustrates a simplified cross section diagram of a compressor structure of several embodiments of the present invention depicting air flow when port openings are not aligned.

A centrifugal compressor can provide an increase the pressure (and the volume) of the air flow directed into the engine cylinder. In the rotating valve port configuration, the inlet air enters the rotating impeller of the compressor along its axis, typically flowing from the apex of a conical hub, inward and outward along the hub between the blades of the impeller. The rotation of the impeller increases the velocity of the air as it flows radially outward due to centrifugal action and the angle and shape of the blades. The moving air is allowed to expand—i.e., diffuse (at the increased impeller blade section)—into a fixed circumferential passage called a volute that surrounds the impeller. The volute in concert with the location of the outlet directs the flow of air toward an outlet of the compressor into the rotating valve port for use in the engine cylinder. FIGS. 35A and 35B to be described herein illustrate simplified cross section views of one embodiment of a compressor structure attached to a rotating valve port on the engine during the two conditions when the rotating valve ports are aligned (open) and when they are not aligned (closed). This illustration provides an example of a functional illustration of air flow under the stated conditions and is not intended to be limiting. The Volute opening is raised up away from its normal position of alignment with the outer ends of the impeller blades and the compressor housing is elongated to illustrate the presence of the impeller blades for illustrative purposes.

Continuing with FIG. 16, the housings 606, 608 may enclose the components of the spool configurations (to be described) or structures next to the engine block. In typical cases the volute and compressor housing are stationary, being fixed with respect to the engine block. The basic purpose of the centrifugal compressor structural features is to augment the atmospheric pressure that urges the inlet air flow into the engine cylinder when the intake valve ports are open to overcome residual air flow restriction within the air intake system and provide opportunities for improvements in engine performance, efficiency, emission control, fuel consumption, etc.

FIG. 17 illustrates a frame configured as a spool for supporting alternative embodiments of an intake or exhaust device structure. The spool 610 forms a frame for supporting an intake device 602 or exhaust device 604. The spool 610 includes an inner RVD 612 and an outer RVD 614 connected to a hub 616 at each end thereof. The hub 616 may serve as a housing for an axle and bearing assembly (not shown). Each RVD may include a seal 618 around an offset portion of the perimeter of the inner RVD 612 and a seal 624 around the perimeter of the outer RVD 614. It should be understood that, in general, the outer RVD—the one disposed away from the engine cylinder—does not include a ring gear because the rotational drive for the RVD is through a ring gear around the inner RVD 612. However, it is possible to include a ring gear surrounding the outer RVD 614 to provide the synchronized rotational drive for the rotating port or to enable drive for additional accessories to the engine 600.

Figure 18:
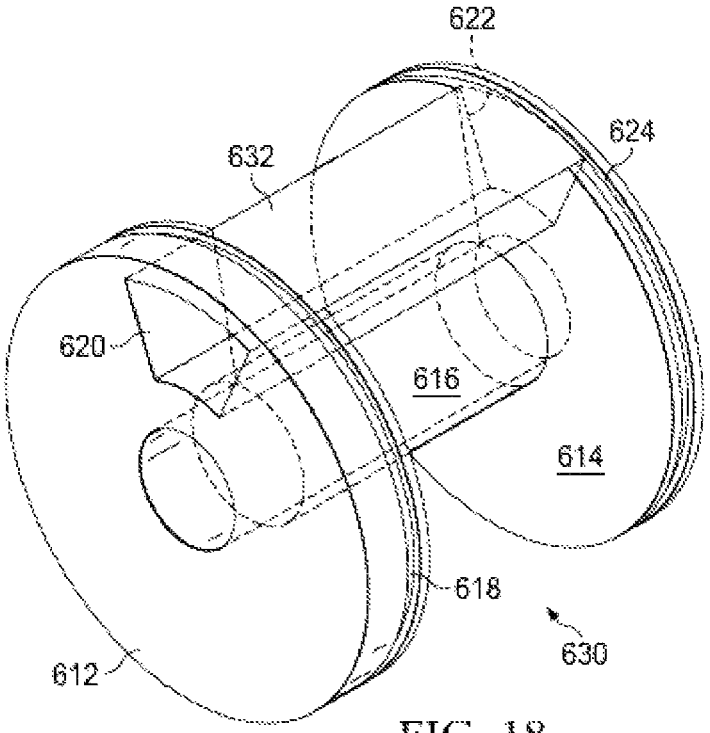
FIG. 18 illustrates a frame configured as a spool for supporting a tubular straight channel connecting valve port openings in each inner and outer disc of the spool.
Figure 19:
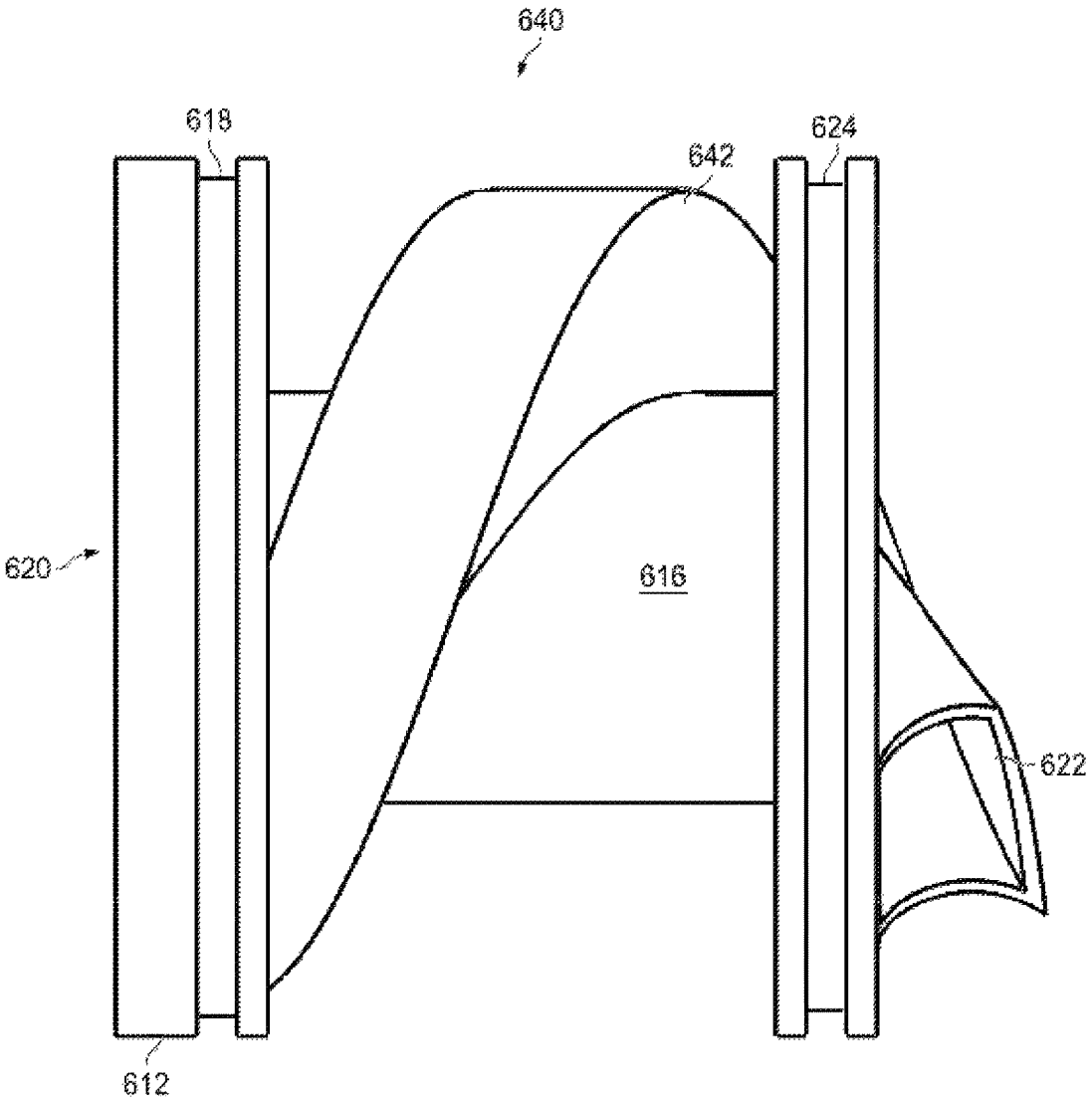
FIG. 19 illustrates a frame configured as a spool for supporting a tubular helical channel connecting valve port openings in each inner and outer disc of the spool.

Continuing with FIG. 17, the inner RVD 612 includes a port opening 620 and the outer RVD 614 includes a port opening 622, which may be joined by a tubular channel to be described as in FIGS. 18 and 19. The intake air is introduced to the port opening 622 in the outer RVD 614. In the illustrated embodiment, the port openings 620, 622 may generally be positioned directly opposite each other, i.e., along a line in parallel with the axis of the spool, across the space within the spool 610. The seals 618, 624 may be configured—as one example—as resilient O-rings formed with a Shore A durometer rating or other specification of resilience as appropriate for the particular application. Other sealing structures are possible too. Such seals 618, 624 may be provided to seal the rims of the inner RVD 612 offset and the outer RVD 614 to the inside surface of a spool containment housing 606, 608 as described in FIG. 16. The spool 610 may serve as a platform or frame for either an intake device 602 or an exhaust device 604.

The shape of the valve ports 620, 622 may be configured to provide a maximum of aperture area for the flow of air inlet or exhaust outlet through the respective port. Thus, the rotating disc suggests that the port shape be a radial sector portion of the rotating disc. For example, for first and second fixed valve ports formed respectively in the intake and exhaust sides of the engine cylinder, the fixed ports may be formed as a radial sector bounded by a timing duration angle 626=$\theta_I$ or $\theta_E$, respectively for intake and exhaust, and first $R_1$ and second $R_2$ radii, where $R_1<R_2$ and the radii $R_1$ and $R_2$ are each less than the radius of the respective RVD-1 or RVD-2, as shown in FIG. 17. The term $\theta_I$ corresponds to the timing duration angle of the intake port and $\theta_E$ corresponds to the timing duration angle of the exhaust port. In both cases, the radial dimensions $R_1$ and $R_2$, where $R_1<R_2$, are defined for each rotating valve port disc. These parameters enable setting the duration and flow volume of the open-aperture valve timing of the engine. The timing of the opening and closing of the intake and exhaust valves, as is well known in the art, may be set in correspondence with the intake and exhaust cycles of the internal combustion engine. This timing may, for example be set by the angular relationship of the RV discs' rotation relative to the crankshaft.

FIG. 18 illustrates a frame configured as a spool 630 for supporting a tubular straight channel 632 connecting valve port openings 620, 622 in the respective inner RVD 612 and outer RVD 614 of the spool 630. The tubular straight channel may be parallel with the hub 616 that supports the inner RVD 612 and outer RVD 614. The RVD 612 and 614 are connected to the hub 616 at each end thereof. The function of the tubular straight channel 632 is to provide a sealed passage between the rotating port opening 622 to the rotating port opening 620 in the inner RVD 612. When the spool 630 is enclosed within a containment housing such as depicted in FIG. 16 (Ref No. 606 or 608), the space inside the containment housing 606 of FIG. 16 and outside the straight channel 632 may be used to provide a basin or passage for engine coolant around the tubular straight channel 632. Coolant connections (not shown) to the containment housings 606 or 608 may be configured as needed according to methods well-known in the art.

FIG. 19 illustrates a frame configured as a spool 640 for supporting one example of a tubular helical channel 642 connecting valve port opening 620 in an inner RVD 612 and valve port opening 622 in the outer RVD 614 disc of the spool 640. The tubular helical channel 642 may be disposed or wrapped around the hub 616 that supports the inner RVD 612 and outer RVD 624. The RVD 612 and 624 are connected to the hub 616 at each end thereof. The function of the tubular helical channel 642 is to provide a sealed passage between the rotating port opening 622 to the rotating port opening 620 in the inner RVD 612. The port opening 622 may be coupled to an intake conduit (not shown) or formed as a scoop as shown. The tubular helical channel 642 shown in FIG. 19 may be formed as approximately one revolution within the spool 640 between the ports 620, 622. In other embodiments the tubular helical channel 642 may be formed as less than one revolution or more than one revolution. In such alternate embodiments the angular position of the port opening 622 may shift to accommodate a different configuration. The spool 640 with the tubular helical channel 642 may be enclosed within a containment housing 606 (or containment housing 608) as described herein above. Coolant connections (not shown) to the containment housings 606 or 608 may be configured as needed according to methods well-known in the art.

The straight and helical channel structures depicted in FIGS. 18 and 19 (and in FIGS. 26-30) may, in some embodiments, be modified by eliminating or collapsing the tubular configuration to form a blade disposed between the inner and outer RVDs out of the direct path between the inner 620 and outer 622 port openings. The blade may be straight or helical for directing the air flow within the spool between the inlet opening 622 in the outer rotating disc to the rotating valve port 620 in the inner rotating disc. As noted previously the straight and helical channel structures may be configured to form part of the length of the inlet or exhaust passages, to take advantage of the acoustical resonance of the intake or exhaust passages.

Further with respect to FIGS. 18 and 19, the use of the frame or spool 630 as described thus provides a basin or passage outside the tubular straight channel 632 or the tubular helical channel 642 for engine coolant, circulating within the containment housing 606 or 608, to flow through the intake device 602 or the exhaust device 604. If such configuration is used, the engine coolant may be coupled into and out of the containment housing 606, 608 through leak-proof connections (not shown). As is well known in the art, keeping the intake air cool takes advantage of the greater density of colder air to maximize power output. Similarly, keeping the engine in the vicinity of the exhaust device from overheating prevents hot spots and uneven thermal expansion that may lead to leakage of combustion gases, oil or cooling fluids, or impairing combustion efficiency.

Figure 20:
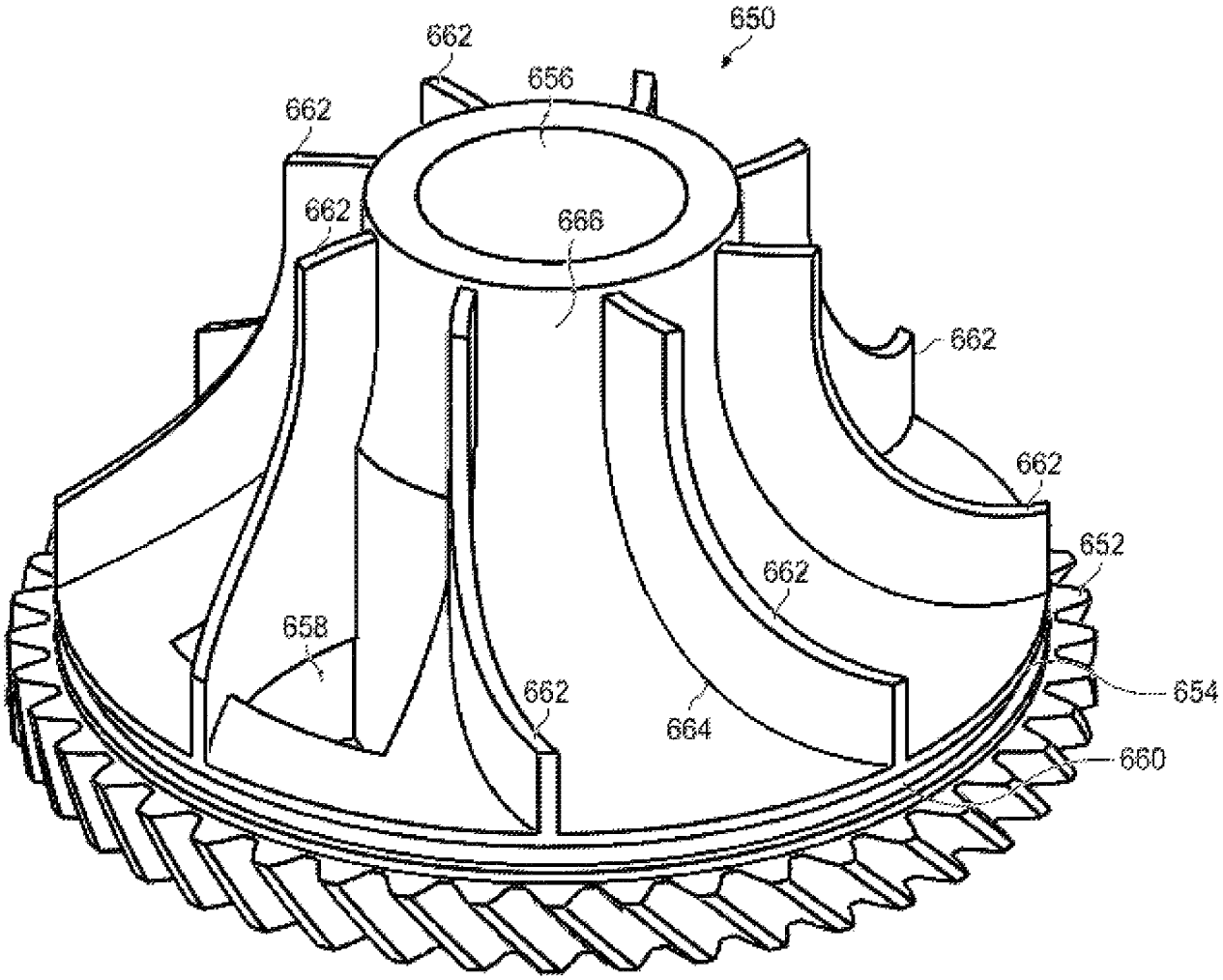
FIG. 20 illustrates a first version A of an alternate embodiment of a compressor impeller attached to an inner rotating disc of the RVP.

FIG. 20 illustrates a first version A (or type A) of an alternate embodiment of a compressor impeller attached to an inner RVD. The impeller 666 in this view is configured generally with a conical cross section or profile. This profile may be chosen to efficiently receive inlet air along its axis and direct the flowing air outward along the surfaces of the impeller and the impeller blades 662 (alternately vanes 662) and into a volute space to be described. The specific profiles of the impeller and the attached blades or vanes may be configured according to particular requirements.

Figure 21A:
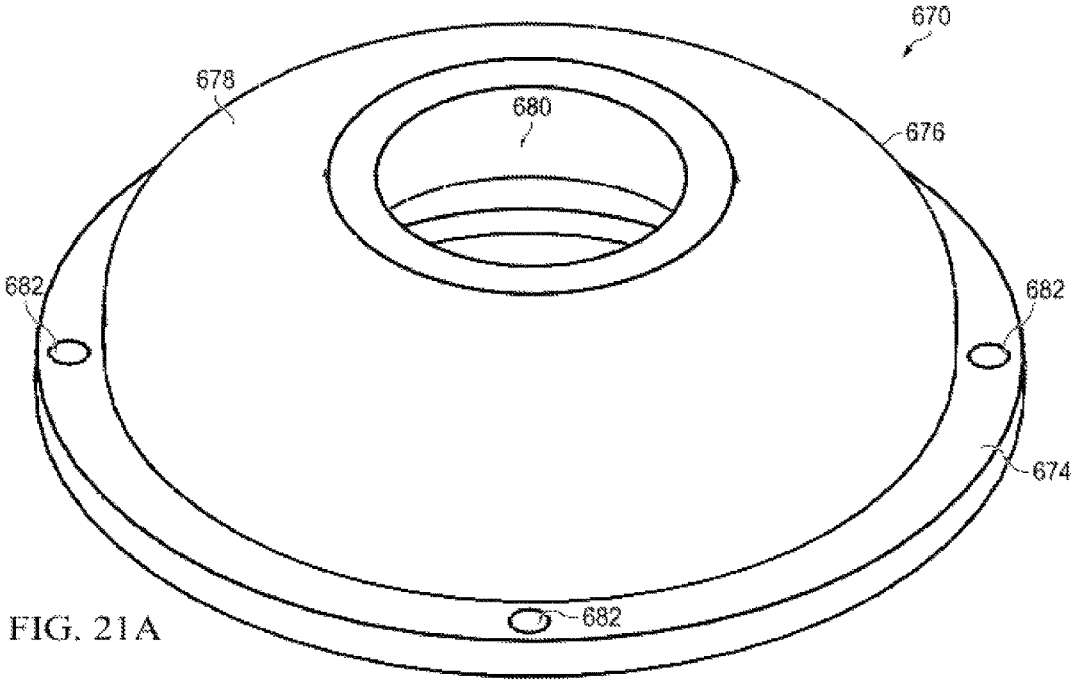
FIG. 21A illustrates a perspective view of an impeller housing with integral volute for use with the version A embodiment of FIG. 20.

The impeller assembly 650 of FIG. 20 includes an inner RVD 652 having the required ring gear teeth and an offset face 654 to receive a seal 660. The impeller 666 is shown attached to the offset face 654 of the inner RVD 652. The impeller 666, which includes a hub 656, may be formed integral with the offset face 654. The RVD 652 includes a port opening 658 in the manner of the basic RVP rotating valve port configuration. Attached to the impeller 666 is a plurality of impeller blades 662 disposed uniformly around the hub 656. The impeller blades 662 may be integral with the impeller 666 and the hub 656 and attached to the impeller 666 at a joint 664 for each impeller blade 662. Each impeller blade 662 may be shaped or configured as needed for a particular air flow profile within the impeller housing (See FIGS. 35A and 35B to be described). As shown in FIG. 20, the impeller assembly 650 forms part of a centrifugal compressor assembly to be described. The impeller assembly 650 may rotate within a compressor housing assembly 670 as shown in FIG. 21A. The impeller assembly 650 may be manufactured from separately formed parts and assembled by means well-known in the art, or formed by various manufacturing processes such as subtractive (i.e., machining), additive (i.e., 3D printing), casting, or molding processes. Note: the impeller blades shown are not drawn to exact size or shape on purpose to show the presence of an impeller blade as illustrative depictions only. The actual size and shape of the impeller blades are dependent on the application and coincidence of their respective use in the present invention.

Figure 21B:
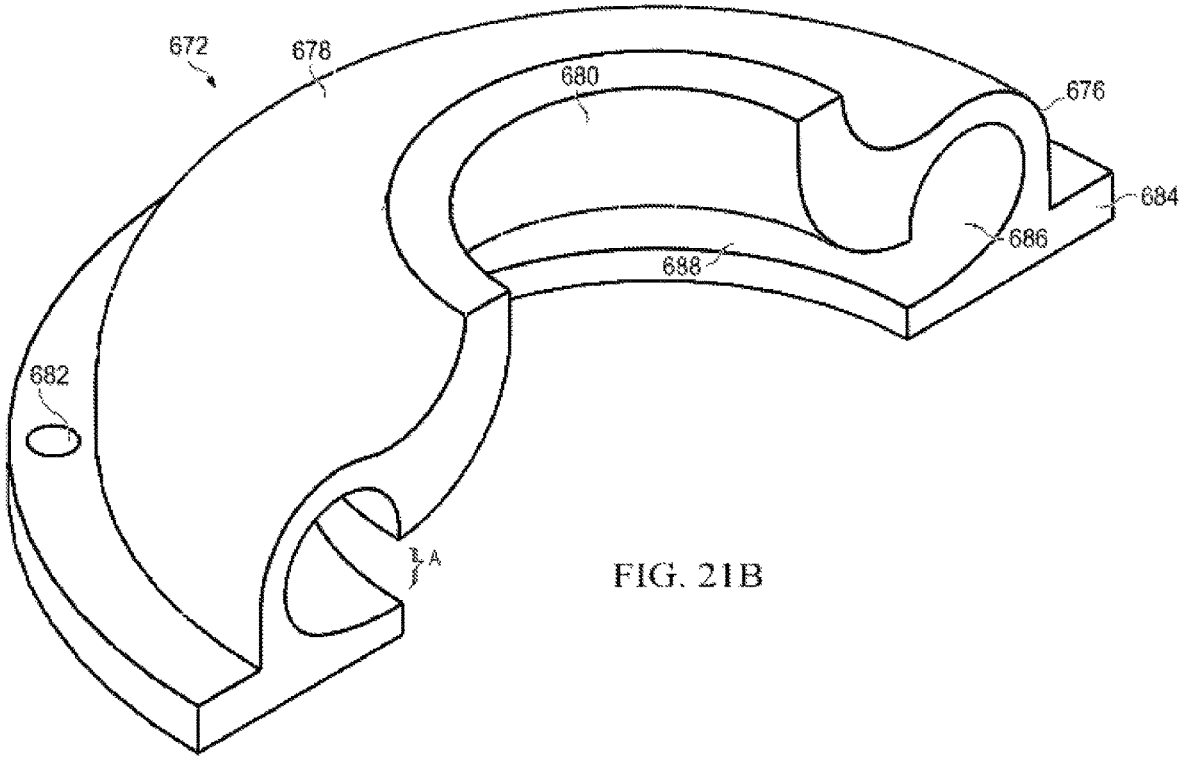
FIG. 21B illustrates a cut-away perspective view of the impeller housing of FIG. 21A.
Figure 22:
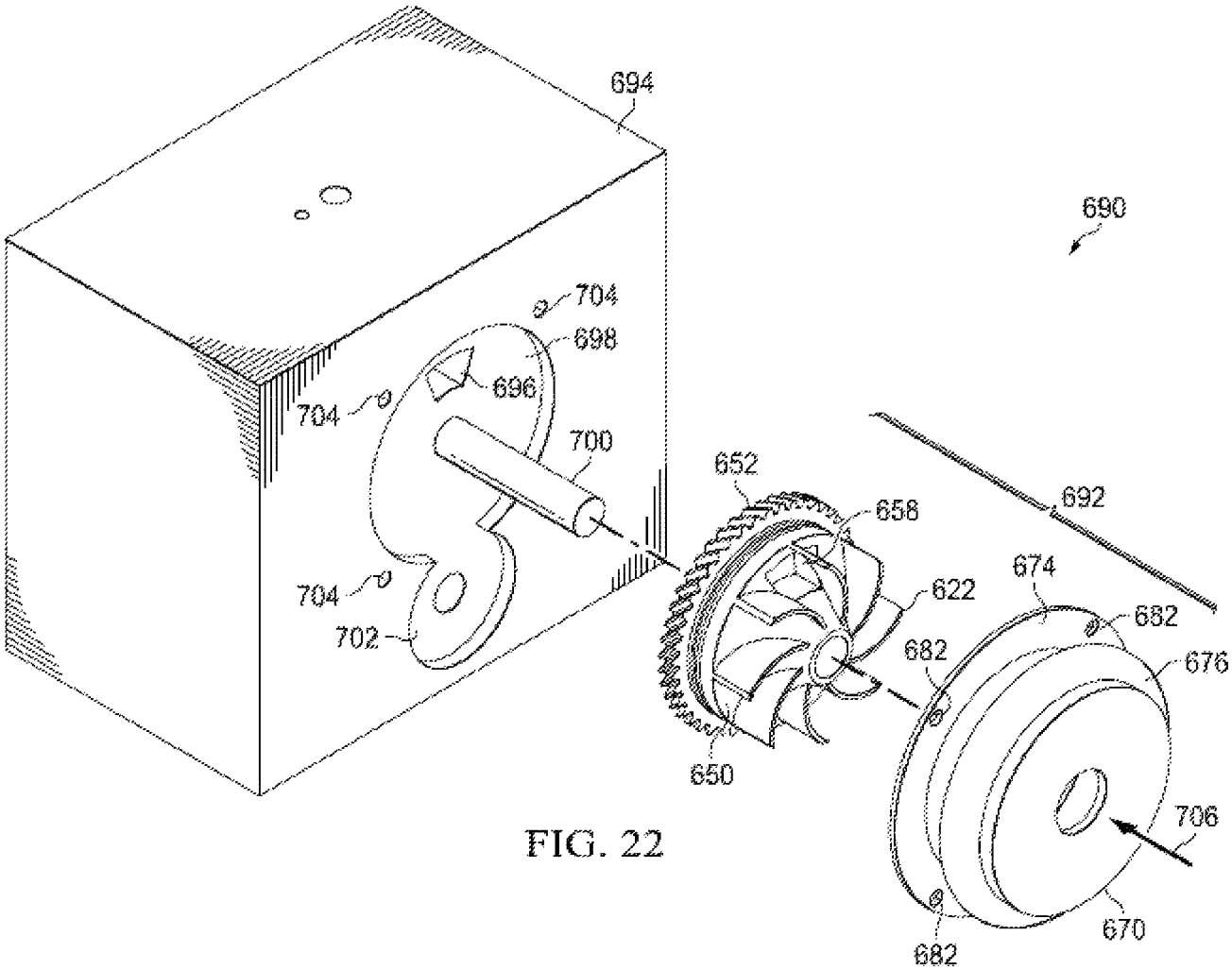
FIG. 22 illustrates an exploded perspective view of an RVP assembly of the embodiments of FIGS. 20 and 21A.

In one example of a centrifugal compressor FIGS. 21A and 21B illustrate two views of a compressor housing 678 with an integral volute 676 for use with the version A embodiment of FIG. 20, as part of the assembly of a modified centrifugal compressor 690 as shown in FIG. 22. Referring now to FIG. 21A, a compressor housing assembly 670 is shown in perspective having a mounting flange 674, an integral volute 676 formed in the outer perimeter of the compressor housing 678, and the compressor housing 678. The compressor housing 678 includes a central air inlet opening 680 that may surround a hub or axle assembly (not shown) of an impeller assembly. The flange 674 of the compressor housing assembly 670 may be attached to an engine block using screws as shown in FIGS. 35A and 35B through the holes 682.

The compressor housing assembly 672 shown in FIG. 21B in a cut-away perspective view depicts the compressor housing 678 and the volute 676. The volute 676 is shown as a cylindrical tube 686 having a slot opening 688 around its inner circumference to allow the passage of air circulated by the impeller blades 662 (referring to FIG. 20) to be directed into the volute 676 for later release from the volute 676 toward the port opening 658 (referring to FIG. 20) when the rotating valve port and the fixed engine cylinder port are aligned. The volute 676 is disposed near the flange 674 where it can receive the flow of diffused air from the tips of the impeller blades 662. The compressor housing assembly 670 may be manufactured by an additive (i.e., 3D printing) process or other suitable method of manufacturing. The structures shown in FIGS. 21A and 21B, which will appear in various embodiments to be described, are scalable to accommodate particular configurations of specific embodiments.

FIG. 22 illustrates an exploded perspective view of an RVP-I assembly, version A 690 of the embodiments of FIGS. 20, 21A and 21B. A compressor assembly 692, including impeller assembly 650 and compressor housing assembly 670 are shown aligned with an axle 700 secured in an engine block 694. The engine block 694 includes a fixed intake port 696 formed in a side wall of the engine block 694. The intake port 696 provides a passage into an engine cylinder (not shown) inside the engine block 694. The intake port 696 may be situated within a first circular relief 698 wherein the ring gear of the impeller assembly 650 rotates when driven by a drive gear (not shown in FIG. 22, but see FIG. 2 for the relationship of the ring gear 16 and the drive gear 17 attached to the crankshaft 13) that rotates with the crankshaft. The drive gear in this view rotates within a second circular relief 702.

After the impeller assembly 650 is installed on the axle 700, the compressor housing assembly 670 may be attached to the engine block 694 using screws (not shown in this view), each inserted through a mounting hole 682 in the compressor housing assembly 670 into a corresponding hole 704 formed in the engine block 694. The impeller assembly 650 including the RVD 652 thus rotates within the compressor housing assembly 670. The direction of rotation of the impeller 650 in the illustrated embodiment is clockwise as viewed along the direction of the inlet air flow 706. FIGS. 35A and 35B to be described depict a cross section schematic of a side view of a compressor structure as used in the embodiment of FIG. 22 of the present invention to illustrate the paths of inlet air flow 706 through the compressor structure and into the engine cylinder.

Figure 23:
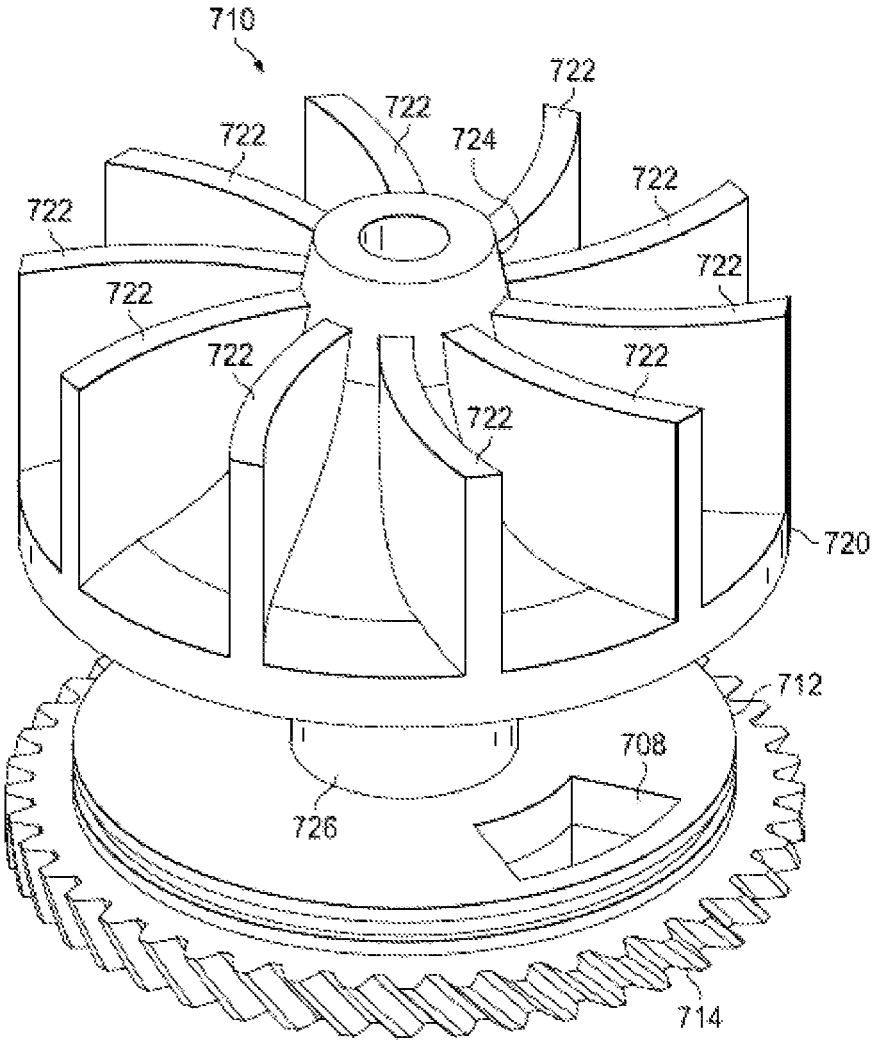
FIG. 23 illustrates a second version B of an alternate embodiment of a compressor impeller attached to an inner rotating disc of the RVP.

FIG. 23 illustrates an alternate embodiment version B (or type B) of a compressor impeller assembly 710. An impeller 720 having a plurality of blades 722 is shown attached to a hub 724 (which may include a housing 726 for an axle) in turn attached to and spaced away from an RVD 712. The RVD 712 includes a valve port 708 and a ring gear 714 surrounding the perimeter of the RVD 712. This embodiment of the impeller assembly 710 is similar to the embodiment 650 shown in FIG. 20 except that the RVD 720 is spaced away from the RVD 712, and the impeller 720. This space permits air to flow around the impeller 720 for improved access to the rotating valve port 708. The blades 722, and the hub 724 are shown as a unitary structure. The impeller 720 includes an axial hub 724 disposed on the end of the axle housing 726. The outer diameters of the impeller 720 and the RVD 712 are scalable and may varied from the proportions shown in FIG. 23 to accommodate particular requirements. The impeller 720 of FIG. 23 may be manufactured by subtractive (i.e., machining from stock) or additive (i.e., by 3D printing) processes, or formed as a cast or molded component.

Figure 24A:
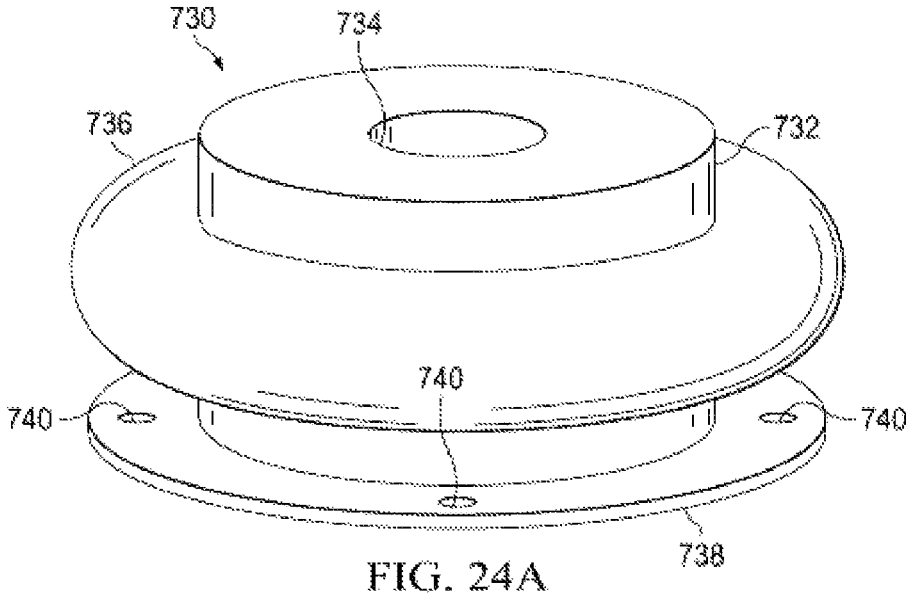
FIG. 24A illustrates an impeller housing with integral volute for use with the version B embodiment of FIG. 23.
Figure 24B:
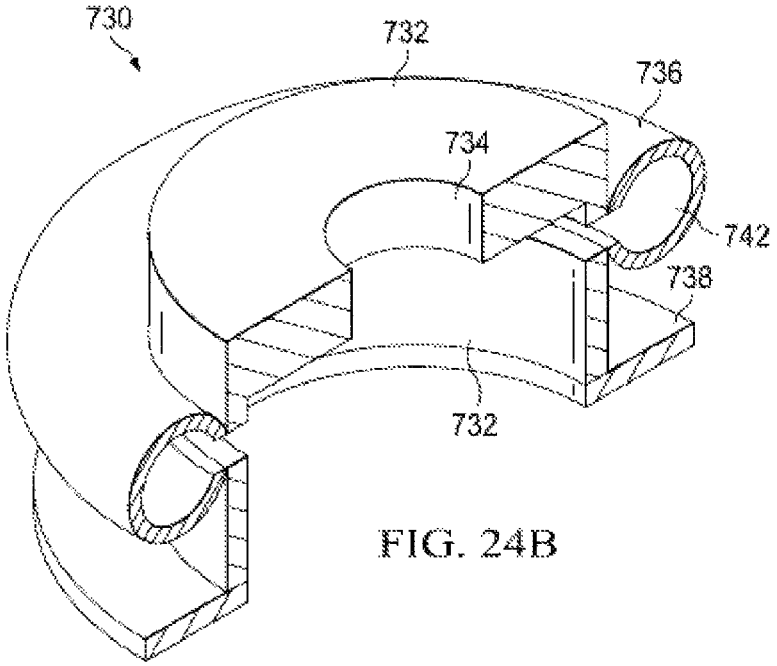
FIG. 24B illustrates a cut-away perspective view of an impeller housing with integral volute for use with the version B embodiment of FIG. 23.

FIGS. 24A and 24B illustrate two views of an alternate compressor housing assembly 730. The compressor housing 732 of FIG. 24A includes an opening 734 for air intake and may be formed with an integral volute 736 for use with the version B embodiment of the impeller assembly 720 shown in FIG. 23. The compressor housing 732 includes a mounting flange 738 and mounting holes 740 similar to the structure described in FIGS. 21A and 21B.

FIG. 24B illustrates a cut-away perspective view of the compressor housing assembly 730 with the integral volute 736 for use with the version B embodiment of the impeller assembly 720 of FIG. 23. The volute 736 is shown in a cut-away cross section to depict the interior channel 742 formed in the volute 736. The mounting flange 738 may include the mounting holes 740 as shown in FIG. 24A. The volute 736 may be spaced away from the flange 738 to position it directly opposite the tips of the video impeller 722. The compressor housing assembly 730 may be manufactured by an additive (i.e., 3D printing) process or other suitable method.

Figure 25:
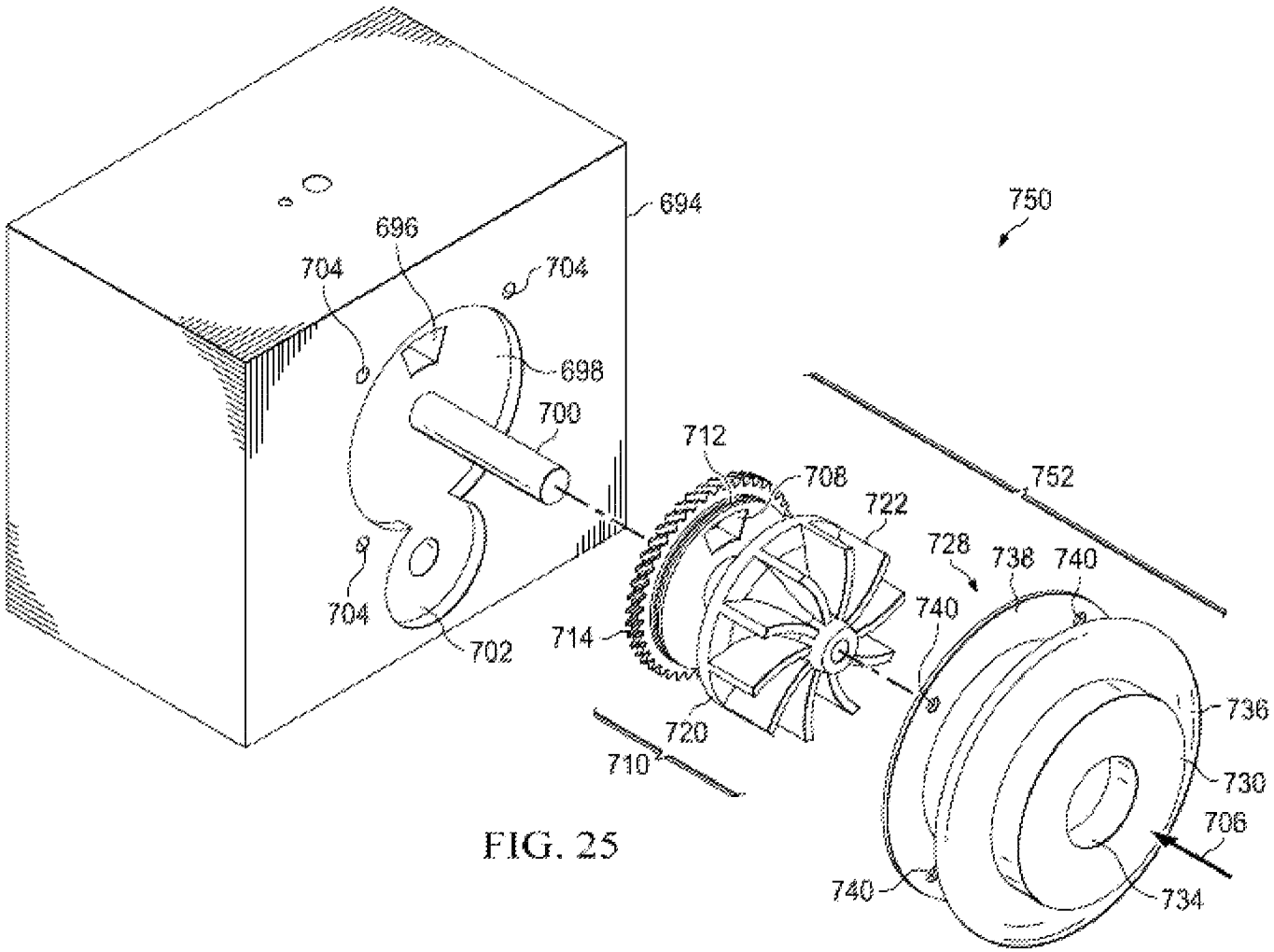
FIG. 25 illustrates an exploded perspective view of an RVP assembly of the embodiments of FIGS. 23, 24A, and 24B.

FIG. 25 illustrates an exploded perspective view of an RVD 1 intake assembly 750, using an impeller assembly 710 of version B of the embodiments of FIGS. 23, 24A and 24B as they may be assembled with an engine block 694. A compressor assembly 752, including impeller assembly 710 and compressor housing assembly 730 are shown aligned with an axle 700 secured in an engine block 694. The engine block 694 includes a fixed intake port 696 formed in a side wall of the engine block 694. The rotating valve disc (RVD) 712 is shown as attached to or part of the ring gear 714. The rotating intake port 708, shaped as a radial sector of the RVD 712 and ring gear 714, provides a passage through the fixed intake port 696 into an engine cylinder (not shown) inside the engine block 694 when the two ports 708, 696 are aligned during the valve timing cycle. The intake port 696 may be situated within a first circular relief 698 wherein the ring gear 714 of the impeller 720 rotates when driven by a drive gear such as drive gear 17 (See FIG. 16) that may rotate with the crankshaft 13 as shown in FIG. 2.

The drive gear 17 (See FIG. 16) in this embodiment may rotate within a second circular relief 702. As in FIG. 22, the direction of rotation of the impeller 720 in the illustrated embodiment is clockwise as viewed along the direction of the inlet air flow 706. After the impeller assembly 710 is installed on the axle 700, the compressor housing assembly 730 may be attached to the engine block 694 using screws inserted through mounting holes 740 in the compressor housing assembly 730 into corresponding holes 704 formed in the engine block 694. The impeller assembly 710 including the RVD 712 and ring gear 714 thus rotates within the compressor housing assembly 730.

Figure 26:
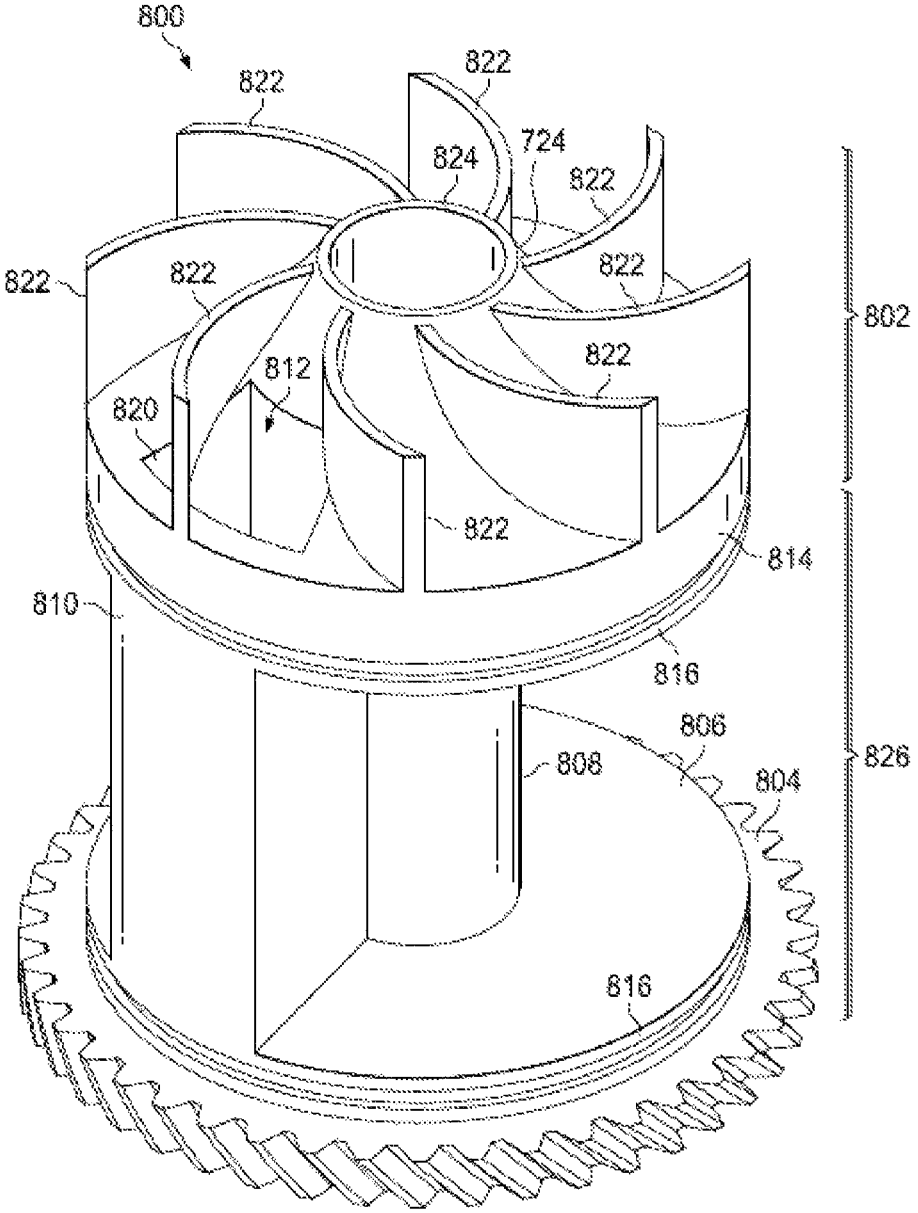
FIG. 26 illustrates a first version A of an alternate embodiment of a compressor impeller attached to an outer disc of a spool frame having a tubular straight channel connecting valve port openings in each inner and outer discs of the spool.

FIG. 26 illustrates an alternate embodiment of an intake device 800. The version A compressor impeller 802 of the intake device 800 is similar to the embodiment of the impeller assembly 650 depicted in FIG. 20. The compressor impeller 802 includes a plurality of blades 822 attached to the curved outer surface of the outer disc 814 of a spool 826 formed by an inner RV disc 806 and the outer RV disc 814. The plurality of blades or vanes 822 may be disposed at uniform intervals around the outer RV disc to form the impeller 802. The hub 824 of the impeller 802 is disposed at the outer end of an axle housing 808 of the spool 826 formed by the inner 806 and outer 814 RV discs. A ring gear 804 for rotating the intake device in synchronism with the crankshaft 13 (See FIG. 16) surrounds the inner RV disc 806.

The spool 826 functions as a frame for the intake device 800. A tubular straight channel 810, attached to the facing sides of the inner RV disc 806 and the outer RV disc 814, encloses a passage 812 between a port (not shown) in the inner RV disc 806 and the port 820 in the outer RV disc 814. The tubular straight channel 810 encloses a passage 812 for conducting inlet air from the impeller assembly 802 into the valve port opening (See port 658 in FIG. 22) in the inner RVD 804. Surrounding the edges of the inner RV disc 806 and the outer 814 RV disc may be a resilient seal 816 such as an O-ring as previously described. The intake device 800 may be enclosed within a containment housing 606 attached to the engine block in the manner of the embodiment illustrated in FIG. 16.

Figure 27:
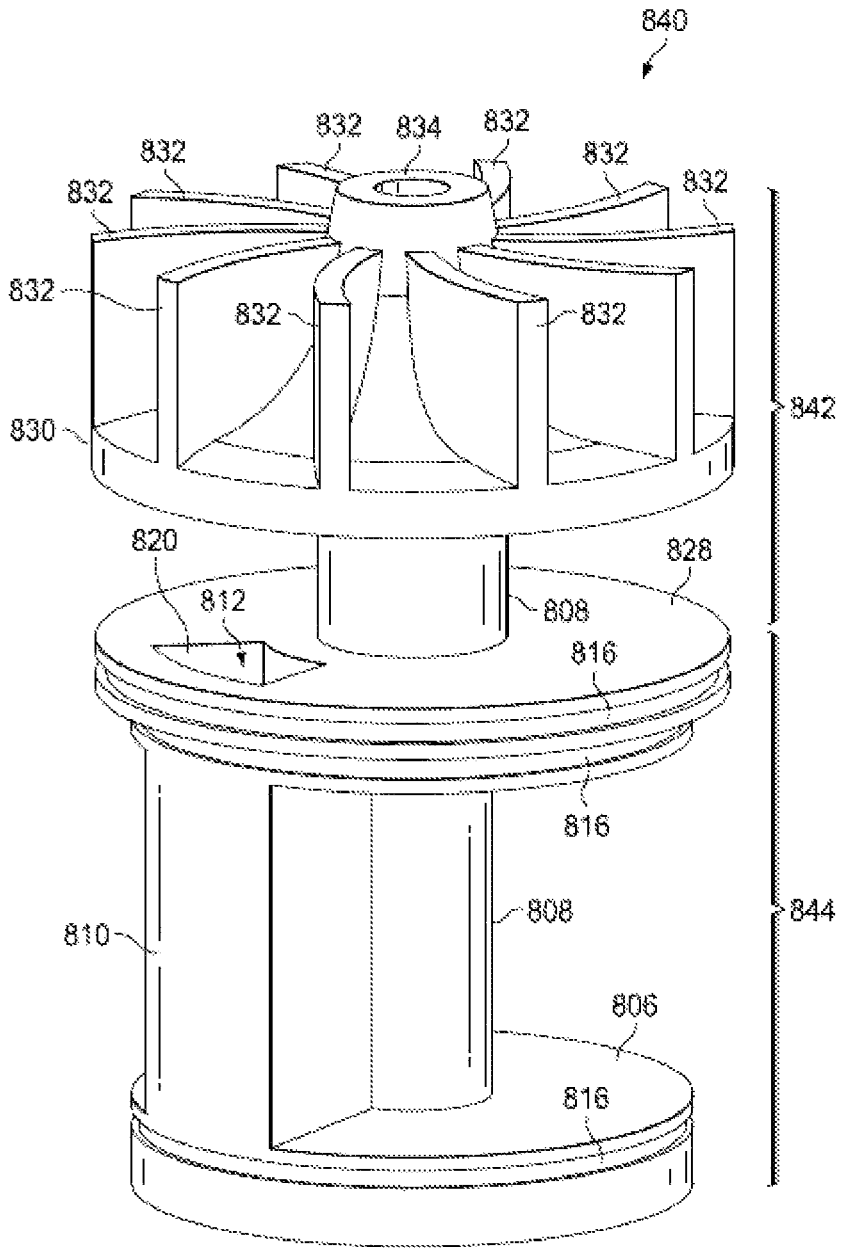
FIG. 27 illustrates a second version B of an alternate embodiment of a compressor impeller spaced away from its attachment to an outer disc of a spool frame having a tubular straight channel connecting valve port openings in each inner and outer discs of the spool.

FIG. 27 illustrates a second alternate embodiment of an intake device 840, which includes a type B compressor impeller assembly 842 spaced away by an axle housing extension (part of axle housing 808) from its attachment to an outer disc, RV disc 828. The outer RV disc 828 forms a spool 844 with an inner RV disc 806 (shown without a ring gear in this view) and an axle housing 808 connected between them. The spool 844 includes a tubular straight channel connecting the valve port openings formed in the inner 806 and outer 828 RV discs of the spool assembly 844. The tubular straight channel 810 includes an internal passage 812 connected between the RV port (not shown in this view) in the inner RV disc 806 and the RV port 820 in the outer RV disc 828. The impeller assembly 842 is similar to the impeller assembly 710 of FIG. 23, such that the blades 832 of the impeller assembly 842 are attached to a curved surface of the impeller assembly 842 formed of a base 830 and hub 834 disposed on the outer end of axle housing 808. The inner RV disc 806 and the outer RV disc 828 each may include a resilient seal 816 to provide a water/air tight seal between the inside surface of a containment housing 606 (See FIG. 16) and the rims of the inner RVD 806 and outer RVD 828.

Figure 28:
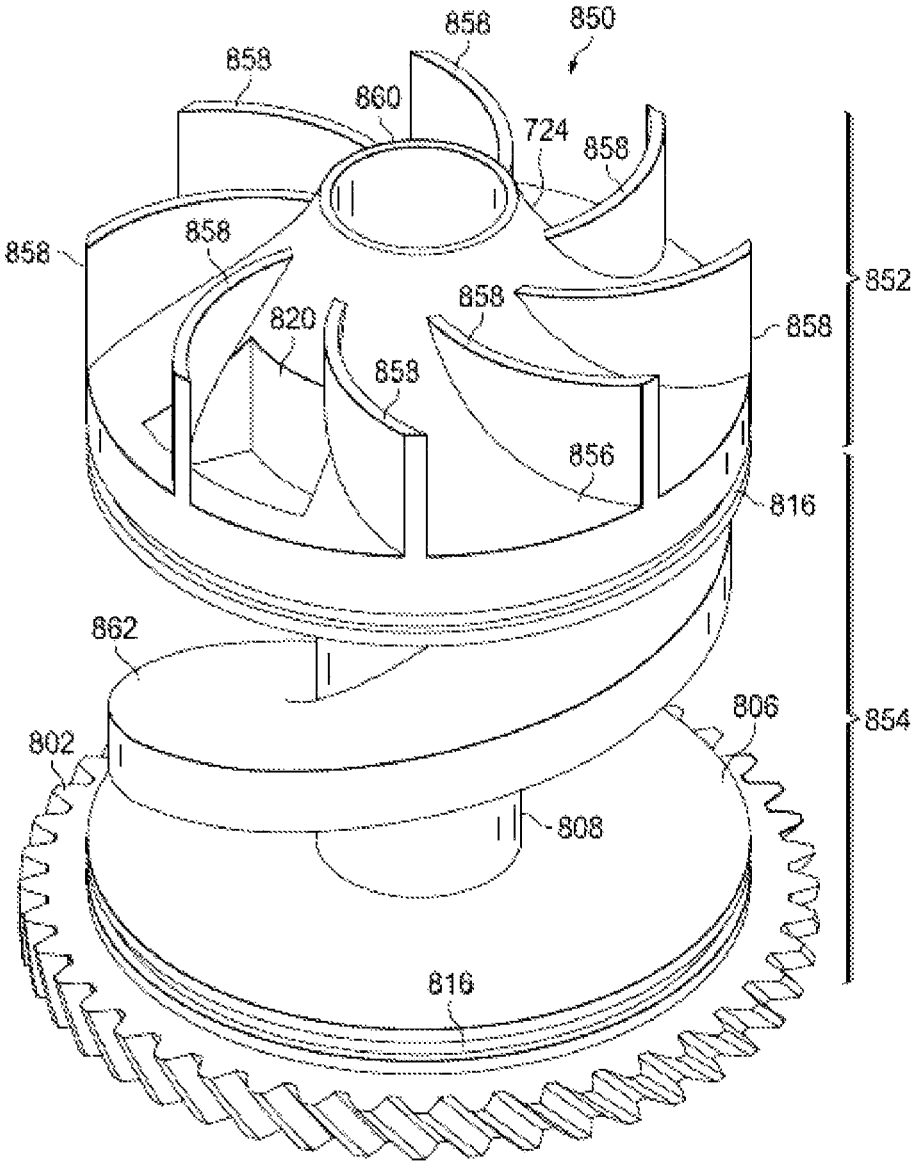
FIG. 28 illustrates a first version A of an alternate embodiment of a compressor impeller attached to an outer disc of a spool frame having a tubular helical channel connecting valve port openings in each inner and outer discs of the spool.

FIG. 28 illustrates an alternate embodiment of an intake device 850, which is similar to the embodiment of FIG. 26 except the tubular helical channel 862 of FIG. 28 is used in place of the tubular straight channel 810 depicted in FIG. 26. In FIG. 28 a compressor impeller assembly 852 is attached to an outer disc of a spool assembly 854 having the tubular helical channel 862 connecting the valve port opening in the inner RVD 806 (Similar to the port opening 658 in FIG. 22) to the valve port opening 820 in the outer RVD 856. The compressor impeller assembly 852 includes a plurality of blades 858 disposed at uniform intervals around a hub 860 and attached to the curved surface of the outer RVD 856 of the spool assembly 854 formed by inner RVD 806 and the outer RVD 856. The tubular helical channel 862 is an enclosed passage for conducting inlet air from the impeller assembly 852 into the valve port opening in the inner RVD 806. The inner RVD 806 and the outer RVD 856 each may include a resilient seal 816 to provide a water/air tight seal between the inside surface of a containment housing 606 (See FIG. 16) and the rims of the inner RVD 806 and outer RVD 856.

Figure 29:
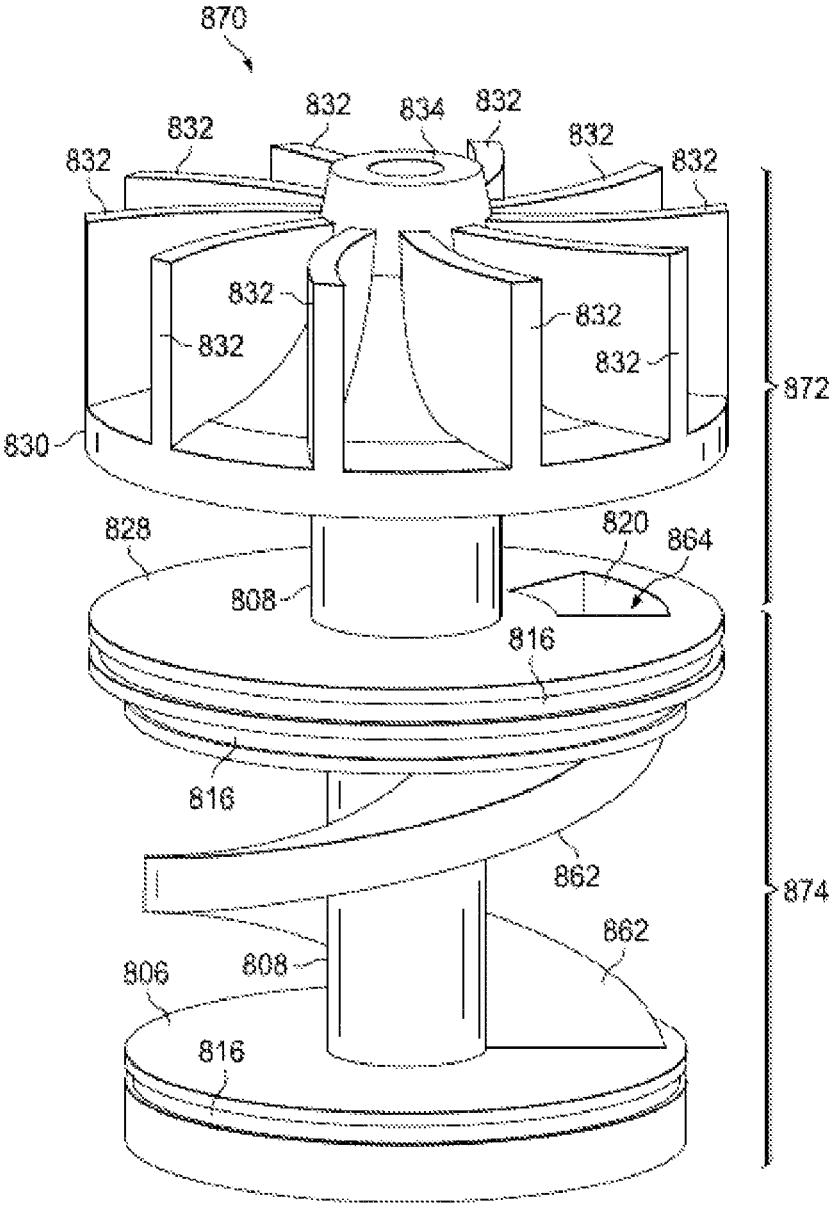
FIG. 29 illustrates a second version B of an alternate embodiment of a compressor impeller spaced away from its attachment to an outer disc of a spool frame having a tubular helical channel connecting valve port openings in each inner and outer discs of the spool.

FIG. 29 illustrates a second alternate embodiment of an intake device 870 that combines a type B compressor impeller assembly 872 (similar to the compressor impeller assembly 842 of FIG. 27) with a spool assembly 874 (similar to the spool assembly 854 of FIG. 28). Like the embodiment of FIG. 27, the compressor impeller assembly 842 may be spaced away from the outer RVD 828 by an extension of the axle housing 808. The axle housing 808 is capped by a hub 834. As in FIG. 27 the plurality of blades 832 of the compressor impeller 872 are disposed uniformly around the curved surface of a base 830, integral with the hub 834, wherein the base 830 is spaced away from the outer face of the RVD 828. A port opening 820 is formed in the RVD 828 at the outlet of the tubular helical channel 862. The tubular helical channel 862 encloses a passage 864 to conduct the passage of inlet air into the engine cylinder via a port opening (not shown but similar to the port opening 708 in FIG. 23) located at the outlet of the tubular helical channel 862. The inner RV disc 806 and the outer RV disc 828 each may include a resilient seal 816 to provide a water/air tight seal between the inside surface of a containment housing 606 (See FIG. 16) and the rims of the inner RVD 806 and outer RVD 828.

Manufacturing processes for the embodiments of FIGS. 26-29 may be similar to the ones suggested for the embodiments of FIGS. 20, 21A and 21B, 23, 24A and 24B.

FIG. 30 illustrates a composite perspective diagram of an engine 900 including an engine block 902 with an attached intake device 930 configured similar to FIG. 19 (having a tubular helical channel 642) and an attached exhaust device 932 configured according to FIG. 18 (having a tubular straight channel 632). The intake device 930 and the exhaust device 932 rotate in synchronism with the crankshaft, each one driven by a drive gear (not shown but is similar to the drive gears 17 and 19 of FIG. 2) attached to a crankshaft (similar to crankshaft 13 of FIG. 2) that meshes with the ring gears on the RVD 924 and RVD 934. The engine block 902 includes an engine cylinder 904, a crankcase 906, and crankshaft bearing journals 908 to support a crankshaft (not shown). The engine block 902 includes axle assemblies 910 on the intake side and 912 in the exhaust side for supporting the intake device 930 and the exhaust device 932. The axle assemblies 910 and 912 may be provided by shoulder bolts having threads that match tapped holes in the engine block 902 or an equivalent structure. The engine block 902 further includes an intake port 914 providing a passage for intake air into the engine cylinder 904 and an exhaust port 916 providing a passage for exhaust gases from the engine cylinder 904. The engine block 902 may be manufactured using subtractive, additive, or casting or molding processes, or a combination of these. As in previous embodiments, the intake and exhaust devices may be enclosed within containment housings 606, 608 in the manner of FIG. 16.

Continuing with FIG. 30, the intake device 930 rotates on the axle assembly 910 attached to the engine block 902. The tubular helical channel 928 of the intake device 930 receives inlet air at an inlet 922 and conducts the inlet air through the tubular helical channel 928 and the port opening 920 in the RVD 924 into the engine cylinder 904 of FIG. 30 when the intake device 930 is aligned with the cylinder port opening 914 of the engine cylinder 904. The inlet air may be provided from an intake manifold (not shown) or other intake conduit (not shown). Similarly, the exhaust device 932 rotates on an axle assembly 912 attached to the engine block 902. The tubular straight channel 938 of the exhaust device receives exhaust gases from the engine through the port opening 940 in the RVD 934, the tubular straight channel 938 and outputs the exhaust gases via the port 942. The port 942 may be connected to an exhaust pipe (not shown) or manifold (not shown).

In other illustrative embodiments to be described next with FIGS. 31-34, the concept of the rotating valve cylinder or RVC is depicted. The embodiments to be described are not intended to be limiting of the variety of ways the rotating valve cylinder concept may be used or implemented, such as are also illustrated by FIGS. 1B, 1D-1H and 1J; and FIGS. 13B, 13D-13H, and 13J. In this modification to the basic rotating valve port concept as described in the foregoing, a hollow cylindrical member is attached to one face of the rotating valve disc or RVD so that it may be oriented proximate the cylinder head of the engine, thereby forming in combination the rotating valve cylinder or RVC. This configuration provides a way to adapt the rotating valve concept to rotating cylindrical valve ports located above the engine piston as part of the cylinder head structure. In this way the rotating valve port concept may be extended to embodiments that position the rotating valve near—and usually above—the engine cylinder head so that the rotating valve may align with a stationary valve port in the cylinder head to introduce the inlet air above the piston and extract the exhaust gases from above the piston.

As an example, the rotating valve cylinder modification can be summarized as the basic rotating valve port structure, wherein:

- a fixed first valve port is formed in a first side of a cylinder head of the engine cylinder and a fixed second valve port is formed in a second side of the cylinder head of the engine cylinder;
- an RVD-I and an RVD-E are each configured as a rotating disc having a ring gear disposed around its perimeter; and
- a rotating valve cylinder (RVC), its axis aligned along the axis of each RVD-I and RVD-E, is attached at a first end thereof to a face of the respective RVD-I or the RVD-E and oriented proximate the respective first and second valve ports formed in the cylinder head of the engine, thereby forming respectively the RVC-I and the RVC-E; wherein the inner valve port of each RVC-I or RVC-E is formed in a side wall thereof and disposed adjacent the respective first and second fixed valve ports formed in the cylinder head; and each RVC-I and RVC-E is disposed to rotate in synchronism with the rotation of the crankshaft such as to align the inner valve port of each RVC-I or RVC-E respectively with the first fixed valve port and the second fixed valve port in the cylinder head.

In the foregoing example, the shape of the valve ports may be varied from the radial sector outline described for the rotating valve disc embodiments as shown, for example, in FIG. 17. For example, the valve ports in the RVC-I and RVC-E embodiments may be circular, oval, radial (Pie-Shaped) or rectangular, depending on the particular application. Nevertheless, the dimensions and position of the valve port parameters enable setting the duration of the open aperture valve timing of the engine. The timing of the opening and closing of the intake and exhaust valves, as is well known in the art, may be set in correspondence with the intake and exhaust cycles of the internal combustion engine. This timing may, for example be set by the angular relationship of the RV cylinder's (RVC-I and RVC-E) rotation relative to the crankshaft.

The following descriptions of FIGS. 31-34 illustrate several embodiments of the RVD as modified with a cylindrical extension—thereby forming an RVC (for rotating valve cylinder). The drawings are not drawn to exact scale. Duplication of reference numbers in multiple drawings identifies identical structural elements described previously.

Figure 31:
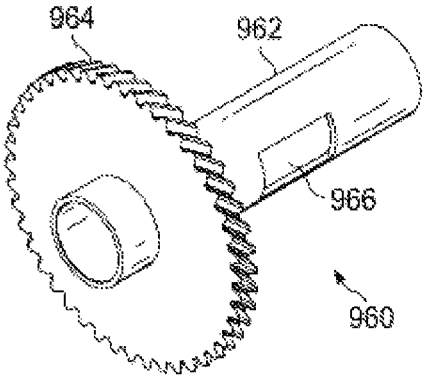
FIG. 31 illustrates a simplified perspective view of a rotating valve cylinder according to the embodiment of FIGS. 1B, 1D, 1E, 1F, 1G, 1H, 1J, 3, 4, 5, 11, 13B, 13D, 13E, 13F, 13G, 13H, and 13J.

FIG. 31 illustrates a simplified perspective view of a rotating valve cylinder (or RVC) assembly 960 according to the embodiments shown in FIGS. 1F, 1G, 4, 13F, and 13G. The rotating valve cylinder 962 having a valve port 966 is attached to a rotating valve disc 964 such that the rotating valve cylinder 962 and the rotating valve disc 964 share the same axis of rotation. The illustrated structure is similar to the embodiment depicted in FIGS. 1F, 1G, 4, 13F, and 13G.

Figure 32:
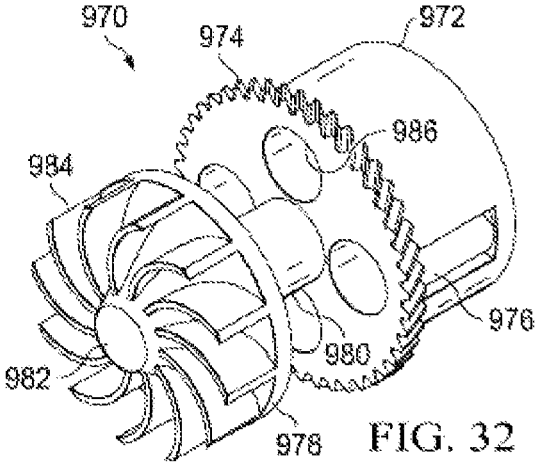
FIG. 32 illustrates a simplified perspective view of a rotating valve cylinder according to the embodiment of FIGS. 1B, 1D, 1E, 1F, 1G, 1H, 1J, 3, 4, 5, 11, 13B, 13D, 13E, 13F, 13G, 13H, and 13J with an added impeller structure.

FIG. 32 illustrates a simplified perspective view of a rotating valve cylinder assembly 970 according to the exemplary embodiments of FIGS. 1F, 1G, 4, 13F, and 13G, or FIG. 11 with an added impeller structure. The rotating valve cylinder 972 having a valve port 976 is shown attached to a ring gear 974 by an axle housing 980. Also attached to an end of the axle housing 980 is an impeller 978 that includes a plurality of impeller blades 984 attached to a hub 982 of the impeller 978. The rotating valve cylinder 972, ring gear 974, and rotating valve disc 978 may all share the same axle housing 980. The ring gear 974 and the attached rotating valve cylinder 972 may include multiple equalizing apertures 986. Four equalizing apertures 986 are shown in the illustrated embodiment, although the number may vary in practice with the particular application. Inlet air enters the center of the impeller blades in the center-most region of the impeller blades and passes through the equalizing apertures 986 to be released through the rotating valve port 976 into the engine cylinder head port (not shown). The equalizing apertures 986 are provided to balance the pressure within the rotating valve cylinder when one or two impeller structures are used with a rotating valve cylinder, respectively as in FIGS. 32 and 33.

Figure 33:
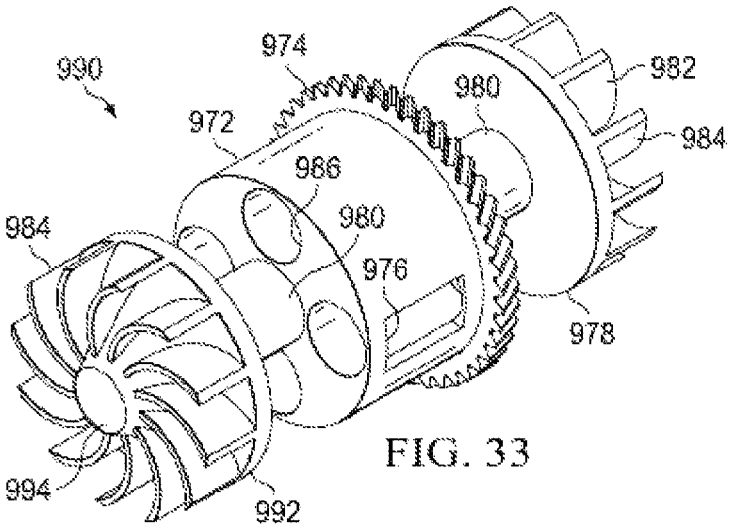
FIG. 33 illustrates a simplified perspective view of a rotating valve cylinder according to the embodiment of FIGS. 1B, 1D, 1E, 1F, 1G, 1H, 1J, 3, 4, 5, 11, 13B, 13D, 13E, 13F, 13G, 13H, and 13J with added first and second impeller structures.

FIG. 33 illustrates a simplified perspective view of an alternate rotating valve cylinder assembly 990 according to the embodiment of FIG. 1B or FIG. 11 with additional first and second impeller structures. It may be observed that the embodiment depicted in FIG. 33 is the same as the embodiment of FIG. 32 except the alternate rotating valve cylinder assembly 990 is reversed end-for-end in FIG. 33 and includes a second impeller structure 992 mounted on a hub 994 on the opposite end of the axle housing 980 from the impeller 978. The rotating valve cylinder 972, ring gear 974, rotating valve disc 978, impeller 992 may share the same axle housing 980. The ring gear 974 and rotating valve cylinder 972 may also include multiple equalizing apertures 986 as described herein. As in FIG. 32, inlet air enters at the impeller hub 962 and passes through the equalizing apertures 986 to be released through the rotating valve port 976 into the engine cylinder head port (not shown).

Figure 34:
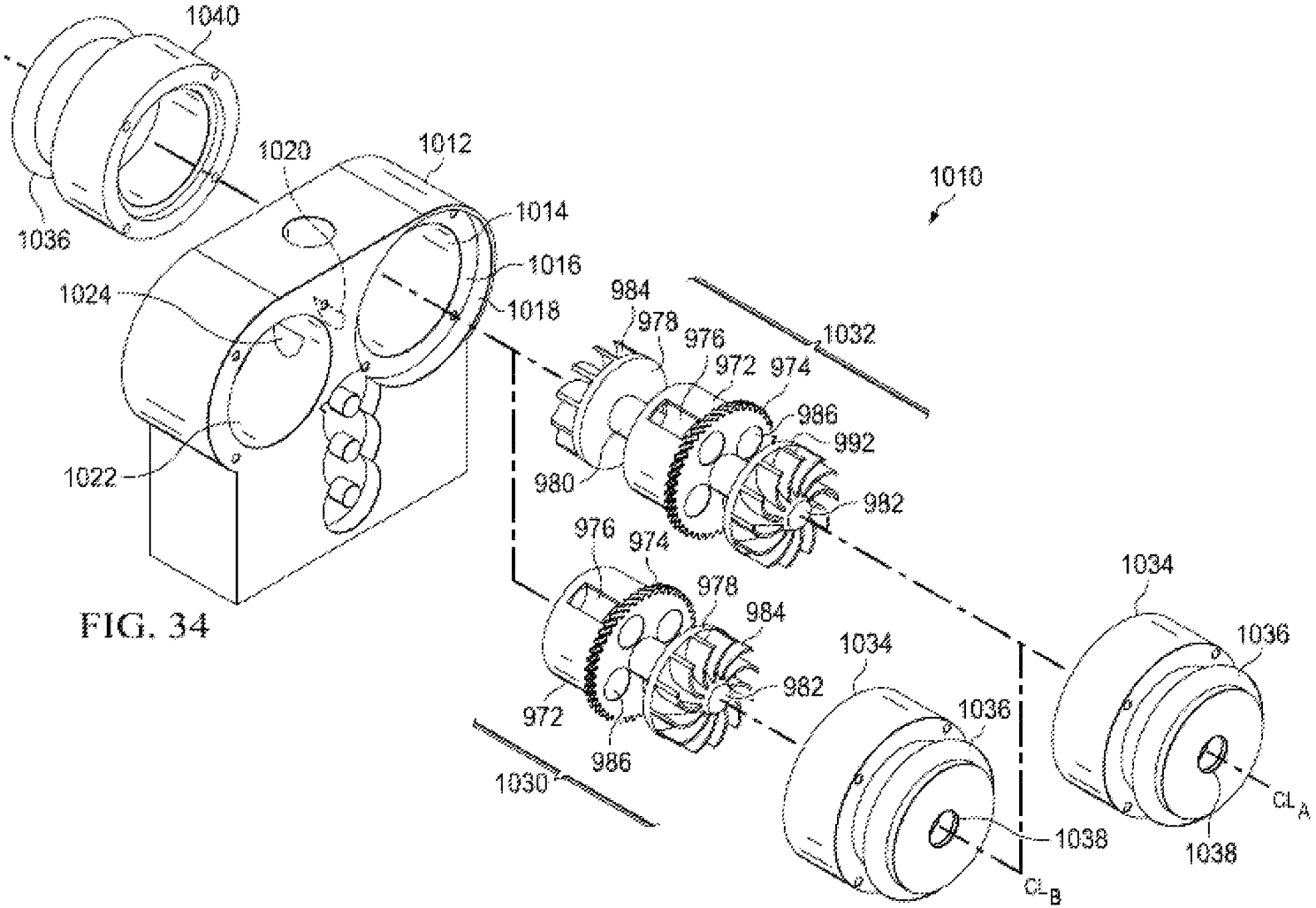
FIG. 34 illustrates an exploded perspective view of an engine block assembly including alternative rotating valve cylinder structures as depicted in FIGS. 32 and 33.

FIG. 34 illustrates an exploded perspective view of an engine block assembly similar to the embodiment of FIG. 4 including alternative intake rotating valve cylinder (RVC) structures 1030 and 1032 as depicted respectively in FIGS. 32 and 33. The engine block assembly 1010 includes engine block 1012 that is configured with an intake bay 1014 and an exhaust bay 1022. The intake bay 1014 is shown with a mounting land 1016 and a guard ring 1018. The intake bay 1014 includes a fixed intake port 1020 formed in the inner surface of the intake bay 1032. Similarly, the exhaust bay, which may include a rotating valve cylinder structure similar to FIG. 3 or 4, preferably includes a fixed exhaust port 1024 formed in the inner surface of the exhaust bay 1022. The fixed intake port 1020 and the fixed exhaust port 1024 may open respectively into corresponding fixed ports (not shown) into the engine cylinder through the cylinder head (not shown).

When the cylindrical rotating intake assembly 1030 or its alternate cylindrical rotating intake assembly 1032 is installed within the intake bay 1014, the ring gear 974 may be installed within the RVC disc recess 1018. Then the compressor housing 1034 may be installed over the rotating intake assembly 1030 or 1032 installed in the intake bay 1014. As installed, the rotating intake assembly 1030 or 1032 is positioned to align the valve port 976 in the RVC 972 with the valve port 1020 inside the intake bay 1014. The illustrated compressor housing 1034 includes a volute 1036 formed in to the periphery of the compressor portion of the compressor housing 1034. The compressor housing 1034 further includes a central air inlet aperture 1038. A second compressor housing 1040 is similar to the compressor housing 1034, including the volute 1036 and central air inlet aperture 1038. The structure and operation of a cylindrical rotating exhaust assembly (not shown) in the exhaust bay 1022 are generally similar to the intake rotating valve cylinder assembly 1030 or 1032.

Continuing now with several additional embodiments, FIGS. 35A and 35B illustrate a simplified cross section schematic of a side view of a compressor structure 1050 that may be used in several embodiments of the present invention. These illustrations depict schematically the approximate paths of inlet air flow through the compressor structure. These views are not to scale. One portion of an engine block 1052, including an engine cylinder 1054 and a fixed cylinder port 1056 formed in the cylinder 1054 are shown in both figures. Set into the engine block 1052 next to the cylinder 1054 is an RV disc recess 1060 within which the RVD 1062 rotates when driven by a drive gear 1070. The drive gear 1070 includes gear teeth that mesh with corresponding gear teeth (not shown) formed around the rim of the RVD 1062. The RVD 1062 with its' rotating valve port 1064 rotates on an axle 1068 that is shown extending from the engine block 1052. The axle 1068 may be supported in the engine block 1052 by means well known in the art.

FIGS. 35A and 35B respectively illustrate the timing interval when the intake ports in both the rotating valve disc and the engine cylinder are in alignment (FIG. 35A) so that air may enter the engine cylinder, and not aligned (FIG. 35B) during all other portions of the engine's operating cycle. Each view is of a side cross section coincident with the axis of rotation of the rotating valve assembly which, for this example, is aligned with the fixed valve port 1056 in the engine cylinder 1054.

Attached to the RVD 1062 in FIGS. 35A and 35B are two of a plurality of impeller blades 1080 of an impeller 654 (See, e.g., FIG. 20) that rotate with the RVD 1062 when driven by the drive gear 1070. See, for example, FIG. 20 for a perspective view of a similar RVD and its' impeller. The assembly of the rotating impeller blades 1080, the RVD 1062 and its intake valve port 1064 enables the periodic alignment of the RVD port 1064 with the fixed engine cylinder port 1056 according to the engine valve timing sequence. When so aligned, the fixed cylinder port 1056 and intake RVD 1064 admit the inlet air 1082 into the cylinder portion of the engine block 1052 as shown in FIG. 35A. During the portions of the engine cycle when the rotating RVD port 1064 is not aligned with the fixed engine cylinder port 1056, as in FIG. 35B, the air flow is blocked from entering the engine and accumulates in the volute 1074. The accumulated intake air is released into the engine cylinder from the volute when the rotating intake port in the RVD 1064 is again aligned with the fixed engine cylinder port 1056.

The assembly of the RVD 1062 and the impeller blades 1080 may be enclosed within a compressor housing 1072, which attaches to the engine block 1052 using screws 1078 as shown. The compressor housing 1072 may preferably be formed to include a volute 1074 to receive and guide or direct the diffuse higher velocity air produced by the impeller blades 1080 toward the intake RVD port 1064. Inlet air 1082 is introduced into the compressor housing 1072 along the axis of rotation of the impeller blades 1080 and spun by centrifugal action outward toward the volute 1074 where it is redirected toward the rotating valve port 1064 and the fixed cylinder port 1056 into the engine.

Figure 36:
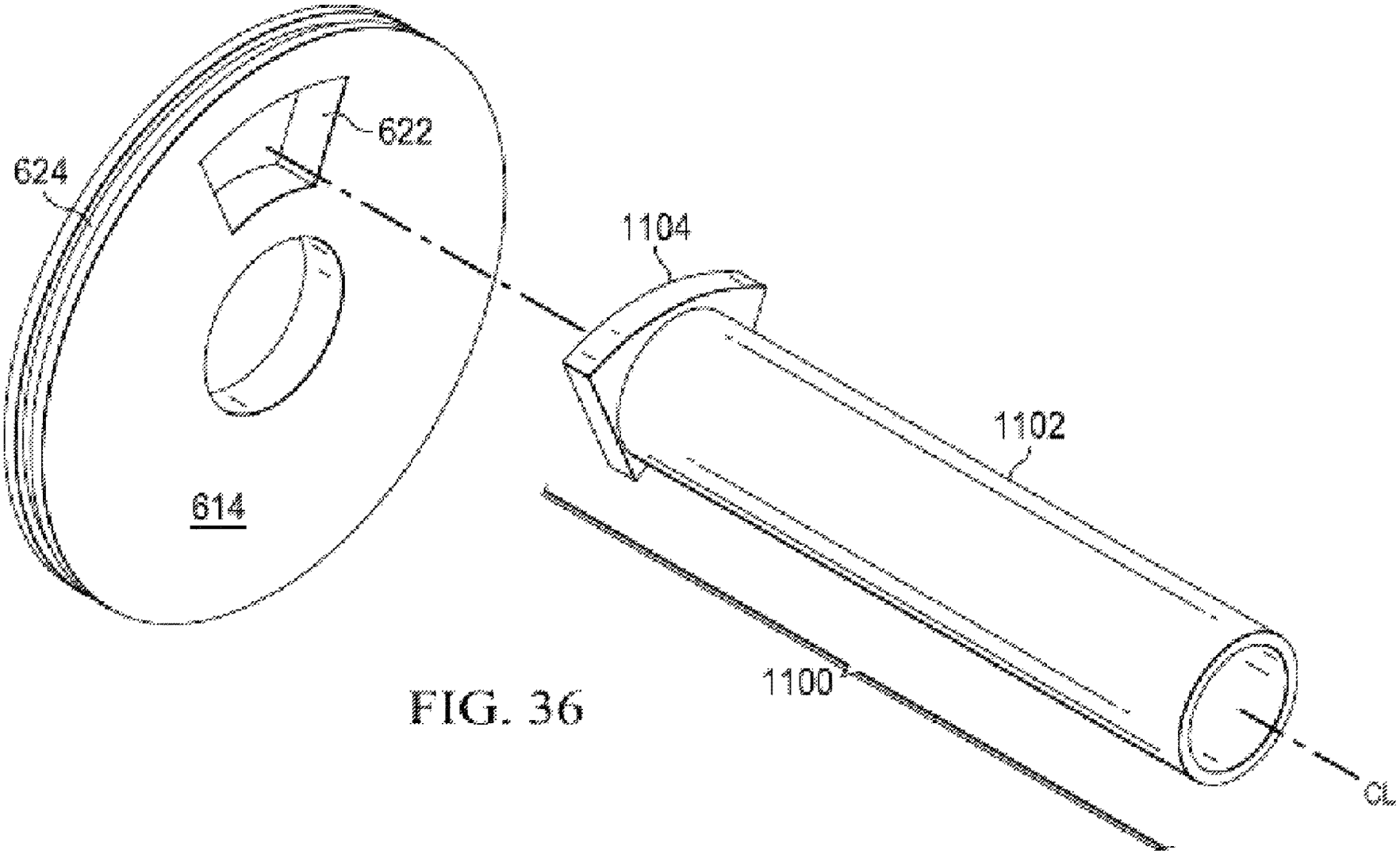
FIG. 36 illustrates a simplified interface for coupling a fixed conduit to a rotating surface.

FIG. 36 illustrates how a simplified interface may be provided for coupling a fixed conduit for directing inlet air to a rotating surface such as an RVD or RVC. The fixed conduit represented by the tube 1102 may be a stationary passage or duct, plenum, or other device having an enclosed space. A rotating disc such as the outer RVD 614 of FIG. 17 is shown with a valve port 622 and a perimeter seal 624 surrounding the perimeter of the RVD 614. Aligned along a centerline CL is a tube 1102 representing a fixed conduit, and an interface seal 1104 attached to the end that interfaces with the rotating RVD 614. The tube 1102 may be any form of an air inlet or an exhaust outlet conduit from a simple short length of pipe to a plenum or a more complex manifold, muffler, or emission control device (not shown). The interface seal 1104 may be any type of resilient gasket or seal or a coupling device that forms an airtight joint between the conduit 1102 and the rotating RVD 614. Other examples include a flexible coupling joint, or a rigid coupling as may be dictated by a particular application.

The purpose of FIG. 36 is to disclose that if such fixed conduit or similar device is used, an interface device such as an interface seal 1104 is needed to couple the fixed conduit or tube 1102 to the rotating RVD 614 so that the inlet air is introduced into an inlet rotating port, or that the exhaust gas is directed out of the respective rotating port, without leakage. The structure illustrated in FIG. 36 may also be readily adapted to interface with the compressor housing 670 of FIG. 22 and other similar embodiments where the compressor housing 670 is stationary because it is typically attached to the engine block or containment housing as shown in FIG. 16, 22 or 25 for example.

Persons skilled in the art will recognize that various alternative methods may be adapted to provide the interface suited to a particular application of the engine described herein. For example, a hand-held appliance such as a weed trimming tool may have a minimum inlet and/or outlet conduit apparatus. A more complex engine for powering a vehicle or generator may have a more complex inlet and/or outlet conduit structure. Either case is represented by the simplified structure depicted in FIG. 36.

Figure 37:
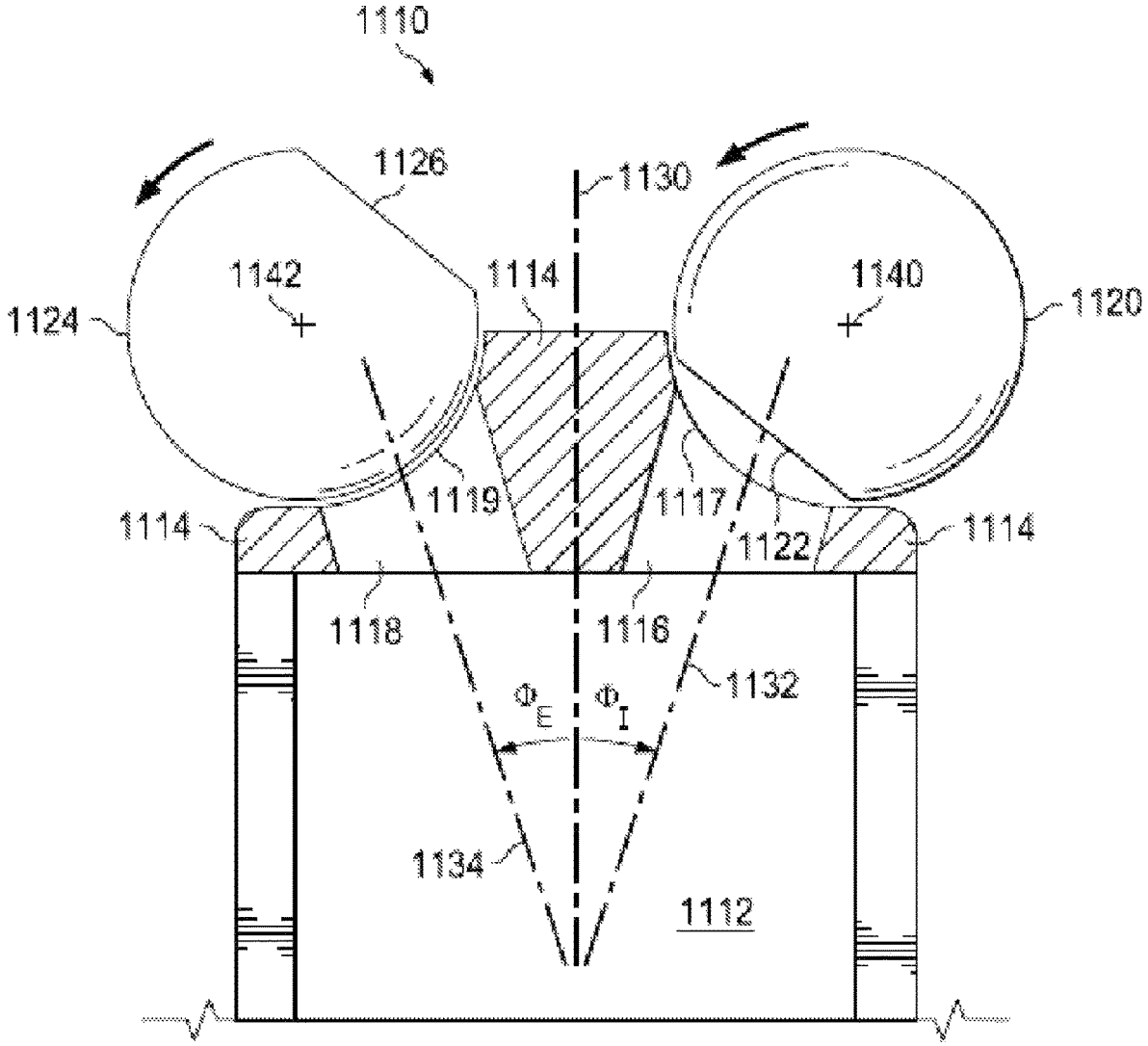
FIG. 37 depicts a cross section schematic diagram of rotating cylinder valve ports installed next to a cylinder head of the embodiment of FIG. 4.

Referring now to FIG. 37, an example of the relationship of the rotating cylinder embodiments and an engine cylinder head will be described. FIG. 37 depicts a cross section schematic diagram of rotating cylinder valve ports 1122, 1126 installed on a cylinder head of the embodiment similar to that depicted in FIG. 4. The rotating cylinder assembly 1110 of FIG. 37 includes an engine cylinder 1112, a cylinder head 1114 installed on the cylinder 1112, a rotating intake valve cylinder 1120 (i.e., RVC-I), and a rotating exhaust valve cylinder 1124 (i.e., RVC-E) installed on the cylinder head 1114. The cylinder head 1114 forms a cover or cap of the engine cylinder 1112. The portion of the engine cylinder 1112 is shown aligned along its axis 1130. The cylinder head 1114 includes a fixed intake valve port 1116 and a fixed exhaust valve port 1118.

In FIG. 37 the intake 1116 and exhaust 1118 valve ports, fixed in the engine cylinder head 1114, are shown inclined or offset relative to the axis 1130 at respective angles of inclination $\Phi_I$ and $\Phi_E$ as indicated by the angle $\Phi_I$ between the axis 1130 and the axis of inclination 1132 for the intake port 1116 and indicated by the angle $\Phi_E$ between the axis 1130 and the axis of inclination 1134 for the exhaust port 1118. The angles of inclination $\Phi_I$ and $\Phi_E$ may be approximately within the range of 10 degrees to 45 degrees in this example, depending on the particular application, but are not so limited. The fixed intake 1116 and fixed exhaust 1118 ports are inclined in this illustrative embodiment to allow more room for the rotating valve cylinders 1120 and 1124. The space required for the rotating valve cylinders 1120, 1124 may also depend on the diameter of the rotating cylinders. Thus the cylinder head 1114 can be modified in size and shape to accommodate different diameters of the rotating valve ports.

The rotating intake valve cylinder 1120 includes an intake valve port 1122, shown in this view in an open position aligned with an entrance aperture 1117 leading into the intake valve port 1116 in the cylinder head 1114. Similarly, the rotating exhaust valve cylinder 1124 includes an exhaust valve port 1126. The rotating exhaust valve cylinder 1124 is shown in this view as leading the timing of the rotating intake valve port 1120 by some number of degrees depending on the desired valve overlap for a typical four-cycle internal combustion engine. When aligned with a fixed inlet aperture 1117 in the cylinder head 1114 the intake valve ports 1122, 1117, and 1116 are open to admit the inlet air into the engine cylinder 1112. When aligned with a fixed outlet aperture 1119 in the cylinder head 1114 the exhaust valve ports 1118, 1119, and 1126 are open to permit the exhaust gases of combustion to escape. The rotating exhaust valve port 1126 is shown in the corresponding position for a four cycle engine that is leading the rotating intake valve port

1122 wherein the rotating intake valve cylinder 1120 and exhaust valve cylinder 1124 rotate at ½ crankshaft rotation.

CONCLUSION

The foregoing detailed description of alternative embodiments of the basic rotating valve port concept highlights the adaptability of the concept to a variety of enhancements to the intake port and exhaust port structures. All of these embodiments provide different ways to solve the fundamental problem of relieving the inherent restriction of the intake and exhaust port structures commonly used in conventional internal combustion engines by eliminating the poppet-style valve situated within the intake or exhaust passages. The embodiments including their various features and modifications described and illustrated are intended to be exemplary of the concepts of the rotating valve port in an internal combustion engine but not limiting of modifications that remain consistent with the basic concepts depicted herein.

The apparatus described herein for controlling valve timing in an internal combustion engine locates a fixed first valve port in a first side of the engine cylinder and a fixed second valve port in a second side of the engine cylinder. The engine includes an engine block forming a crankcase open to a lower end of an engine cylinder, a crankshaft rotatingly disposed in the crankcase, and a piston disposed within the engine cylinder and reciprocatingly coupled to the crankshaft. A first rotating valve disc and a second rotating valve disc are respectively disposed next to the first and second fixed valve ports in the engine cylinder on the first and second sides of the engine cylinder. Each rotating valve disc includes a valve port aperture. Each disc is driven by and rotates in synchronism with the crankshaft to align its valve port with the respective first and second fixed valve ports. Described in detail are a variety of intake devices coupled to the first rotating valve disc to control intake air flow into the engine cylinder, and a variety of exhaust devices coupled to the second rotating valve disc to control exhaust gas flow from the engine cylinder.

The intake and exhaust devices may be used in various combinations and scales to particularly suit a specific application. The intake devices range from a simple conduit or manifold that couples to the rotating valve disc, through several spool-configured devices that rotate with the rotating valve disc and route intake passages through an enclosed basin of engine coolant, to several embodiments that may include a centrifugal compressor assembly. Similarly, the exhaust devices range from a simple conduit or manifold that couples to the rotating valve disc, through several spool-configured devices that rotate with the rotating valve disc and route intake passages through an enclosed basin of engine coolant. While a compressor embodiment is not envisioned as part of an exhaust device at this time, it is contemplated that a combination such as described herein may, in some form, have utility in some future application.

The invention and its features are recited in the appended claims. While the invention has been shown and described in several of its forms and embodiments, it is not thus limited but is susceptible to various modifications without departing from the spirit of the invention as set forth herein. For example, the port opening in the rotating valve disc generally matches the size and shape of the fixed port opening in the side of the engine cylinder. However, in some applications it may be an advantage to vary the shape of one or both port openings to achieve certain valve timing, performance, or manufacturing objectives.

Similarly, varying the shape, cross-section, scales, and passage volume of the tubular straight or helical channels, or the configurations of the impeller components such as the impeller, or its blade structure and disposition, the volute space, or the compressor housing may be employed to satisfy certain operating conditions. Further, the drive mechanism for rotating the rotating valve ports in synchronism with the engine crankshaft is illustrative as a basic concept. It is contemplated that various means of providing such rotating synchronism may be used for controlling the timing of the valve operation. Moreover, certain structural features such as the seals required for the joints among air, gas, and fluid passages, or the details of engine coolant passages, water jackets, coolant pumps, etc. are susceptible to modification based on the general concepts described herein.

I claim:

1. An apparatus for controlling valve timing in an internal combustion engine, comprising:

an engine block forming a crankcase open to a lower end of an engine cylinder, a crankshaft rotatingly disposed in the crankcase, and a piston disposed within the engine cylinder and reciprocatingly coupled to the crankshaft;

a first fixed valve port formed in a first side of the engine cylinder and a second fixed valve port formed in a second side of the engine cylinder opposite the first side;

a first rotating valve disc (RVD-1) and a second rotating valve disc (RVD-2) rotatably disposed on a hub adjacent each respective first and second fixed valve port formed in the engine cylinder;

wherein:

each RVD-1 and RVD-2 respectively includes an inner valve port and rotates in synchronism with the crankshaft to align the inner valve port formed in the RVD-1 and the RVD-2 with the respective first and second fixed valve ports formed in the first and second sides of the engine cylinder;

an intake device, coupled between a first conduit and the RVD-1, for controlling intake air flow into the engine cylinder; and an exhaust device, coupled between a second conduit and the RVD-2, for controlling exhaust gas flow from the engine cylinder.

2. The apparatus of claim 1, wherein the first and second fixed valve ports comprise:

an aperture in the respective side of the engine cylinder defined by a radial sector bounded by first and second radii $R_1$ and $R_2$ and a timing duration angle $\theta_I$ for the first fixed valve port on the intake side and $\theta_E$ for the second fixed valve port on the exhaust side;

wherein:

each radius $R_1$ and $R_2$ is less than the full radius of the RVD-1 or RVD-2.

3. The apparatus of claim 1, wherein the inner valve port comprises:

an aperture in the respective RVD-1 and RVD-2 defined by a radial sector bounded by first and second radii $R_1$ and $R_2$ and a timing duration angle $\theta_I$ for the inner valve port on the intake side and $\theta_E$ for the inner valve port on the exhaust side;

wherein:

the apertures in the respective RVD-1 and RVD-2 define substantially the same areas as the first fixed valve port and the second fixed valve port formed in the respective side of the engine cylinder.

4. The apparatus of claim 1, wherein the hub comprises:
a cylindrical body for supporting a rotating member on an axle.

5. The apparatus of claim 1, wherein:
the RVD-1 and RVD-2 are aligned along a common axis oriented at a right angle to the longitudinal axis of the engine cylinder such that the RVD-1 and the RVD-2 are disposed on opposite sides of the engine cylinder.

6. The apparatus of claim 1, wherein the first conduit comprises:
a stationary duct coupled to a rotating surface of the RVD-1 through a first interface between the duct and the RVD-1.

7. The apparatus of claim 6, wherein the first interface comprises:
a coupling device selected from the group consisting of a rigid sealing device, a resilient seal, and a flexible coupling joint.

8. The apparatus of claim 1, wherein the second conduit comprises:
a stationary duct coupled to a rotating surface of the RVD-2 through a second interface between the duct and the RVD-2.

9. The apparatus of claim 8, wherein the second interface comprises:
a coupling device selected from the group consisting of a rigid sealing device, a resilient seal, and a flexible coupling joint.

10. The apparatus of claim 1, wherein the intake device comprises:
an intake manifold coupled between the RVD-1 and the first conduit.

11. The apparatus of claim 1, wherein the intake device comprises:
a spool formed by an inner RVD-1 having an inner valve port, an outer RVD-1 having an outer valve port substantially identical to the inner valve port, and the hub connected between the inner RVD-1 and the outer RVD-1 along a common axis; and
a straight tubular channel disposed within the spool, approximately parallel to the hub, and connected between the inner and outer valve ports.

12. The apparatus of claim 1, wherein the intake device comprises:
a spool formed by an inner RVD-1 having the inner valve port, an outer RVD-1 having the outer valve port substantially identical to the inner valve port, and the hub connected between the inner RVD-1 and the outer RVD-1 along a common axis; and
a helical tubular channel disposed within the spool around the hub and connected between the inner and outer valve ports.

13. The apparatus of claim 12, wherein the intake device comprises:
an impeller formed by a plurality of blades attached to the inner RVD-1 on the side opposite the engine cylinder, wherein the pluralities of blades are disposed radially around the hub of the inner RVD-1;
an outer RVD-1 attached to an outer end of the hub; and
a compressor housing attached to the engine block and enclosing the impeller disposed on top of the inner RVD-1 or on top of outer RVD-1.

14. The apparatus of claim 13, wherein the intake device further comprises:
a volute formed within the outer perimeter of the compressor housing for receiving the flow of diffused air from the blades of the impeller to be directed into the inner valve port in the inner RVD-1.

15. The apparatus of claim 13, wherein the plurality of blades comprises:
an array of vanes disposed radially on the hub of the inner RVD-1 at uniform angular intervals and formed to a predetermined profile;
wherein:
the vanes are shaped with a slight curvature around the axis of the hub in a direction opposite the direction of rotation of the inner RVD-1.

16. The apparatus of claim 13, wherein the impeller comprises:
a component of a centrifugal compressor configured for increasing air pressure directed into the engine cylinder through the inner valve port of the RVD-1 and the first fixed valve port to compensate for pressure losses within the intake device.

17. The apparatus of claim 12, wherein the intake device comprises:
an impeller formed by a plurality of blades attached to the inner RVD-1 on the side opposite the engine cylinder, wherein the plurality of blades are disposed radially around the hub of the inner RVD-1; and
a compressor housing attached to the engine block and enclosing the impeller disposed between the inner RVD-1 and the outer RVD-1.

18. The apparatus of claim 17, wherein the plurality of blades comprises:
an array of vanes disposed radially on the hub of the inner RVD-1 at uniform angular intervals and formed to a predetermined profile;
wherein:
the vanes are shaped with a slight curvature around the axis of the hub in a direction opposite the direction of rotation of the inner RVD-1.

19. The apparatus of claim 17, wherein the impeller comprises:
a component of a centrifugal compressor configured for increasing air pressure directed into the engine cylinder through the inner valve port of the RVD-1 and the first fixed valve port to compensate for pressure losses within the intake device.

20. The apparatus of claim 1, wherein the intake device comprises:
a centrifugal compressor impeller attached to the hub of the RVD-1 on the side opposite the engine cylinder;
an axial inlet to the impeller along the hub of the RVD-1; and
a perimeter outlet coupled from the impeller housing volute area to the first fixed valve port in the engine cylinder through the inner valve port in the RVD-1.

21. The apparatus of claim 20, wherein the intake device comprises:
a compressor housing including a volute and having an inlet aperture formed around the axial inlet, and surrounding the RVD-1 and the centrifugal compressor impeller, wherein:
the compressor housing is attached to the engine block.

22. The apparatus of claim 1, wherein the exhaust device comprises:
an exhaust manifold coupled between the RVD-2 and the second conduit.

23. The apparatus of claim 1, wherein the exhaust device comprises:
a spool formed by an inner RVD-2 having an inner valve port, an outer RVD-2 having an outer valve port substantially identical to the inner valve port, and the hub connected between the inner RVD-2 and the outer RVD-2 along a common axis; and a straight tubular channel disposed within the spool between the inner and outer valve ports of the inner RVD-2 and the outer RVD-2.

24. The apparatus of claim 1, wherein the exhaust device comprises:

a spool formed by an inner RVD-2 having an inner valve port, an outer RVD-2 having an outer valve port substantially identical to the inner valve port, and the hub connected between the inner RVD-2 and the outer RVD-2 along a common axis; and a helical tubular channel disposed within the spool between the inner and outer valve ports.

25. The apparatus of claim 1, further comprising:

a first rotating drive member for coupling the rotation of the crankshaft to rotation of the RVD-1 to control timing of the alignment of the inner valve port formed in the RVD-1 with the respective first fixed valve port formed in the first side of the engine cylinder.

26. The apparatus of claim 25, wherein the first rotating drive member comprises:

a first ring gear attached to the crankshaft, aligned with the axis of the crankshaft, and having a plurality of gear teeth to mesh with corresponding gear teeth formed around the RVD-1.

27. The apparatus of claim 26, wherein:

the ratio of the number of gear teeth around the RVD-1 to the number of gear teeth around the first ring gear is a whole number equal to 2 or 1.

28. The apparatus of claim 25, further comprising:

a second rotating drive member for coupling the rotation of the crankshaft to rotation of the RVD-2 to control timing of the alignment of the inner valve port formed in the RVD-2 with the second fixed valve port formed in the second side of the engine cylinder.

29. The apparatus of claim 27, wherein the second rotating drive member comprises:

a second ring gear attached to the crankshaft, aligned with the axis of the crankshaft, and having a plurality of gear teeth to mesh with corresponding gear teeth formed around the RVD-2.

30. The apparatus of claim 29, wherein:

the ratio of the number of gear teeth around the RVD-2 to the number of gear teeth around the second ring gear is a whole number equal to 2 or 1.

31. The apparatus of claim 1, wherein:

the first fixed valve port is formed in a first side of a cylinder head of the engine cylinder and the second fixed valve port is formed in a second side of the cylinder head of the engine cylinder;

the RVD-1 and the RVD-2 are each configured as a rotating disc having a ring gear disposed around its perimeter; and a rotating valve cylinder (RVC), its axis of rotation aligned along the axis of each RVD-1 and RVD-2, is attached at a first end thereof to a face of the respective RVD-1 or the RVD-2 and oriented proximate the cylinder head of the engine, thereby forming respectively an RVC-I and an RVC-E;

wherein:

the inner valve port of each RVC-I or RVC-E is formed in a side wall thereof and disposed adjacent the respective first and second fixed valve ports; and each RVD-1 and RVD-2 is configured to rotate in synchronism with the rotation of the crankshaft such as to align the inner valve port of each RVC-I or RVC-E respectively with the first fixed valve port and the second fixed valve port formed respectively in the first side and the second side of the cylinder head.

32. The apparatus of claim 31, wherein the cylinder head comprises:

a cap on the engine cylinder having the first and second fixed valve ports formed in the cylinder head as respective first and second passages aligned at an offset angle Φ relative to the longitudinal axis of the engine cylinder.

33. The apparatus of claim 32, wherein the offset angle Φ comprises:

a non-zero angle defining the inclination of a respective intake and exhaust passage within the cylinder head leading to each first and second fixed valve port.

34. The apparatus of claim 31, further comprising:

a fuel injector disposed in the engine cylinder head for supplying fuel directly into the engine cylinder to mix with the intake air to form a combustible air/fuel mixture; and an igniter for initiating combustion of the air/fuel mixture.

35. The apparatus of claim 34, wherein the igniter is selected from the group consisting of a spark plug, a glow plug, and a laser igniter.

36. The apparatus of claim 1, further comprising:

a fuel metering device disposed in the first conduit for supplying fuel into the first conduit to mix with the intake air flow into the engine cylinder to form a combustible air/fuel mixture; and an igniter for initiating combustion of the air/fuel mixture.

37. The apparatus of claim 36, wherein the igniter is selected from the group consisting of a spark plug, a glow plug, and a laser igniter.

38. The apparatus of claim 1, wherein the RVD-1 comprises:

an impeller assembly centered on the axis of rotation of the RVD-1 and attached to the RVD-1 on a face opposite the engine.

39. The apparatus of claim 1, wherein the RVD-1 comprises:

an impeller assembly centered on the axis of rotation of the RVD-1; and an axle housing disposed on the axis of rotation of the RVD-1 and connected between the RVD-1 and the impeller assembly.

40. The apparatus of claim 1, wherein the RVD-1 comprises:

a second rotating valve disc having an outer valve port and disposed on the axis of rotation of the first rotating valve disc;

an axle housing disposed along the axis of rotation of the RVD-1 and connected between the first rotating valve disc and the second rotating valve disc, an enclosed straight channel connected between the inner valve port and the outer valve port; and an impeller assembly centered on the axis of rotation and attached to the second rotating valve disc on a face opposite the engine.

41. The apparatus of claim 1, wherein the RVD-1 comprises:

a second rotating valve disc having an outer valve port and disposed on the axis of rotation of the first rotating valve disc;

an axle housing disposed along the axis of rotation of the RVD-1 and connected between the first rotating valve disc and the second rotating valve disc, an enclosed helical channel connected between the inner valve port and the outer valve port; and an impeller assembly centered on the axis of rotation and attached to the second rotating valve disc on a face opposite the engine.

42. The apparatus of claim 1, wherein the RVD-1 comprises:

a second rotating valve disc having an outer valve port and disposed on the axis of rotation of the first rotating valve disc;

an axle housing disposed along the axis of rotation of the RVD-1 and connected between the first rotating valve disc and the second rotating valve disc, an enclosed straight channel connected between the inner valve port and the outer valve port; and an impeller assembly centered on the axis of rotation and attached to an axle housing extension beyond the second rotating disc.

43. The apparatus of claim 1, wherein the RVD-1 comprises:

a second rotating valve disc having an outer valve port and disposed on the axis of rotation of the first rotating valve disc;

an axle housing disposed along the axis of rotation of the RVD-1 and connected between the first rotating valve disc and the second rotating valve disc, an enclosed helical channel connected between the inner valve port and the outer valve port; and an impeller assembly centered on the axis of rotation and attached to an axle housing extension beyond the second rotating disc.

44. A method for controlling valve timing in an internal combustion engine, comprising the step of:

providing separately, for each intake and exhaust system, a rotating valve port disc adjacent a fixed valve port formed in a side of an engine combustion cylinder, wherein the rotating valve port disc rotates in synchronism with a crankshaft in the engine to periodically align a port in the rotating valve port disc with the fixed valve port, and wherein the port in the rotating valve port disc is coupled through a conduit to the atmosphere;

wherein:

the port in the rotating valve port disc comprises a radial sector;

the radial sector comprises an annular sector;

the annular sector is comprised of a region between two concentric circles;

the two concentric circles comprise circles with the same center point origin or common center.

* * * * *